US005298089A

United States Patent [19]

Bowe et al.

[11] Patent Number: 5,298,089

[45] Date of Patent: Mar. 29, 1994

[54] IN-SITU GENERATION OF HEAT TREATING ATMOSPHERES USING NON-CRYOGENICALLY PRODUCED NITROGEN

[75] Inventors: Donald J. Bowe, Macungie; Brian B. Bonner, Nesquehoning; Diwakar Garg, Macungie, all of Pa.

[73] Assignee: Air Products and Chemicals, Inc., Allentown, Pa.

[21] Appl. No.: 966,258

[22] Filed: Oct. 26, 1992

Related U.S. Application Data

[63] Continuation-in-part of Ser. No. 727,806, Jul. 8, 1991, Pat. No. 5,211,369.

[51] Int. Cl.[5] ..... F27D 23/00; C21D 1/00

[52] U.S. Cl. ..... 148/208; 148/206; 266/81

[58] Field of Search ..... 148/206, 208; 266/81

[56] References Cited

U.S. PATENT DOCUMENTS 5,069,728 12/1991 Rancon et al. ..... 266/81
5,160,380 11/1992 Vocke et al. ..... 148/206

OTHER PUBLICATIONS

P. M. Wizyn & L. Flores, Carburizing with Membrane $N_2$: Process and Quality Issues, Mar. 1988, pp. 28–32.

H. Walton, New Method of Generating Nitrogen for Controlled Atmosphere, . . . Mar. 1986 pp. 40–46.

P. F. Stratton, The Use of Non-Cryogenically Produced Nitrogen . . . Mar. 1989 pp. 63–67.

D. J. Bowe et al, How PSA Nitrogen Works in a Heat Treating Shop, Nov. 1989 pp. 30–33.

*Primary Examiner*—Upendra Roy

*Attorney, Agent, or Firm*—James C. Simmons; William F. Marsh

[57] ABSTRACT

A process for generating in-situ low-cost atmospheres suitable for annealing and heat treating ferrous and non-ferrous metals and alloys, brazing metals and ceramics, sealing glass to metals, and sintering metal and ceramic powders in a continuous furnace from non-cryogenically produced nitrogen containing up to 5% residual oxygen is presented. The disclosed process involves mixing nitrogen gas containing residual oxygen with a pre-determined amount of a reducing gas such as hydrogen, a hydrocarbon, or a mixture thereof, feeding the gaseous mixture through a non-conventional device into the hot zone of a continuous heat treating furnace, converting residual oxygen to an acceptable form such as moisture, a mixture of moisture and carbon dioxide, or a mixture of moisture, hydrogen, carbon monoxide and carbon dioxide, and using the resultant gaseous mixture for annealing and heat treating metals and alloys, brazing metals and ceramics, sintering metal and ceramic powders, and sealing glass to metals.

22 Claims, 9 Drawing Sheets

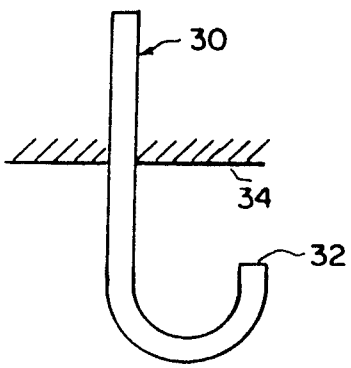
FIG. 3A
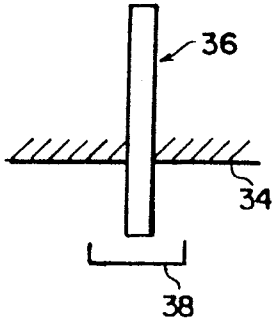
FIG. 3B
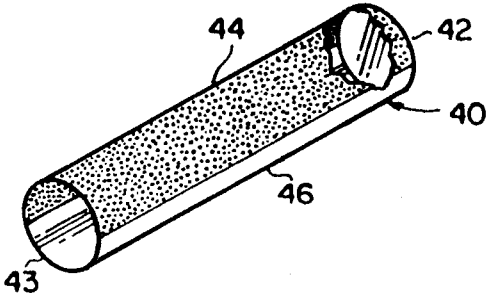
FIG. 3C
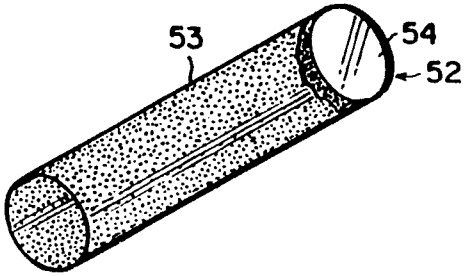
FIG. 3D
FIG. 3E
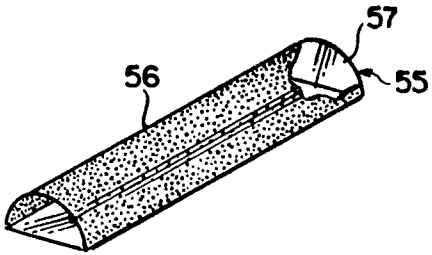
FIG. 3F

750 C TEMPERATURE PROFILE

950 C TEMPERATURE PROFILE

IN-SITU GENERATION OF HEAT TREATING ATMOSPHERES USING NON-CRYOGENICALLY PRODUCED NITROGEN

This is a division, of application Ser. No. 07/727,806 filed Jul. 8, 1991 now U.S. Pat. No. 5,211,369.

TECHNICAL FIELD

The present invention pertains to preparing controlled furnace atmospheres for treating metals, alloys, ceramics, composite materials and the like.

BACKGROUND OF THE INVENTION

Nitrogen-based atmospheres have been routinely used by the heat treating industry both in batch and continuous furnaces since the mid seventies. Because of low dew point and virtual absence of carbon dioxide and oxygen, nitrogen-based atmospheres do not exhibit oxidizing and decarburizing properties and are therefore suitable for a variety of heat treating operations. More specifically, a mixture of nitrogen and hydrogen has been extensively used for annealing low to high carbon and alloy steels as well as annealing of non-ferrous metals and alloys such as copper and gold. A mixture of nitrogen and a hydrocarbon such as methane or propane has gained wide acceptance for neutral hardening and decarburization-free annealing of medium to high carbon steels. A mixture of nitrogen and methanol has been developed and used for carburizing of low to medium carbon steels. Finally, a mixture of nitrogen, hydrogen, and moisture has been used for brazing metals, sintering metal and ceramic powders, and sealing glass to metals.

A major portion of nitrogen used by the heat treating industry has been produced by distillation of air in large cryogenic plants. The cryogenically produced nitrogen is generally very pure and expensive. To reduce the cost of nitrogen, several non-cryogenic air separation techniques such as adsorption and permeation have been recently developed and introduced in the market. The non-cryogenically produced nitrogen costs less to produce, however it contains from 0.2 to 5% residual oxygen, making a direct substitution of cryogenically produced nitrogen with non-cryogenically produced nitrogen in continuous annealing and heat treating furnaces very difficult if not impossible for some applications. Several attempts have been made by researchers to substitute cryogenically produced nitrogen directly with that produced non-cryogenically but with limited success even with the use of an excess amount of a reducing gas. The problem has generally been related to severe surface oxidation of the heat treated parts both in the cooling and heating zones of the furnace, resulting in rusting and sealing. The use of non- cryogenically produced nitrogen has therefore been limited to applications where surface oxidation, rusting and sealing can be tolerated. For example, non-cryogenically produce nitrogen has been successfully used in oxide annealing of carbon steel parts which are generally machined after heat treatment. Its use has, however, not been successful for controlled oxide annealing of finished carbon steel parts due to the formation of scale and rust.

To exploit the cost advantage offered by non-cryogenically produced nitrogen over that produced cryogenically, researchers have been working on processes or methods to substitute non-cryogenically produced nitrogen for that produced cryogenically. For example, furnace atmospheres suitable for heat treating applications have been generated from non-cryogenically produced nitrogen by removing residual oxygen or converting it to an acceptable form in external units prior to feeding the atmospheres into the furnaces. Such atmosphere generation methods have been described in detail in French publication numbers 2,639,249 and 2,639,251 dated Nov. 24, 1988 and Australian patent application numbers AU45561/89 and AU45562/89 dated Nov. 24, 1988. The use of an external unit considerably increases the cost of non-cryogenically produced nitrogen for the user in controlled furnace atmosphere applications. Thus, industry has not adopted non-cryogenically produced nitrogen for these applications.

Researchers have also been experimenting with the addition of a number of reducing gases with non-cryogenically produced nitrogen into the hot zone of furnaces in attempts to produce atmospheres acceptable for heat treating ferrous and non-ferrous metals and alloys. For example, methanol has been added with non-cryogenically produced nitrogen in batch furnaces to successfully generate atmosphere suitable for carburizing carbon steels. This process has been described in detail in papers titled , "Carburizing with Membrane $N_2$: Process and Quality Issues", published in Heat Treating, pages 28–32, March 1988 (P. Murzyn and L. Flores, Jr.), "New Method of Generating Nitrogen for Controlled Atmosphere Heat Treatment at Torrington Shiloh Plant", published in Industrial Heating, pages 40–46, March 1986 (H. Walton), "The Use of Non-Cryogenically Produced Nitrogen in Furnace Atmospheres", published in Heat Treatment of Metals, pages 63–67, March 1989 (P. F. Stratton) and "How PSA Nitrogen Works in a Heat Treating Shop", published in Heat Treating, pages 30–33, November 1989 (D. J. Bowe and D. L. Fung). This process, as mentioned above, is suitable for carburizing carbon steels only in the batch furnaces. It has neither been tried nor used for carburizing parts in continuous furnaces. Furthermore, it has not been used successfully for annealing and heat treating parts made of ferrous and non-ferrous metals and alloys in continuous furnaces with separate heating and cooling zones.

Other reducing gas such as methane has been added into the hot zones of continuous furnaces with non-cryogenically produced nitrogen in attempts to generate atmospheres suitable for oxidation and decarburization-free annealing or hardening of carbon steels. The use of methane has, however, not been successful due to excessive oxidation and decarburization of the parts, as described in the paper by P. F. Stratton referred to above. The author concluded that the oxidation and decarburization problems were related to the slow rate of reaction between oxygen and methane at low temperatures and short residence times in the continuous furnaces used for oxide and decarburize-free annealing. The paper also concluded that non-cryogenically produced nitrogen would be cost competitive to cryogenically produced nitrogen only at residual oxygen levels below about 0.2%, if at all possible.

Hydrogen gas has also been tried as a reducing gas with non-cryogenically produced nitrogen for oxide-free annealing of carbon steels in a continuous furnace. Unfortunately, the process required large amounts of hydrogen, making the use of non-cryogenically produced nitrogen economically unattractive.

Japanese patent application number 62-144889 filed on Jun. 10, 1987 discloses a method of producing non-oxidizing and non-decarburizing atmosphere in a continuous heat treating furnace operated under vacuum by introducing 1% or less hydrogen and low-purity nitrogen with purity 99.995% or less into the hot zone of the furnace through two separate pipes. The key feature of the disclosed process is the savings in the amount of nitrogen gas achieved by increasing the operating pressure form 40 mm Hg to 100–150 mm Hg. This patent application does not set forth any information relating to the quality of the parts produced by using low-purity nitrogen in the furnace nor is there any disclosure in regard to the applicability of such a method to continuous furnaces operated at atmospheric to slightly above atmospheric pressures.

An atmosphere suitable for heat treating copper in a continuous furnace has been claimed to be produced by using a mixture of non-cryogenically produced nitrogen with hydrogen in a paper titled, "A Cost Effective Nitrogen-Based Atmosphere for Copper Annealing", published in Heat Treatment of Metals, pages 93–97, April 1990 (P. F. Stratton). This paper describes that a heat treated copper product was slightly discolored when all the gaseous feed containing a mixture of hydrogen and non-cryogenically produced nitrogen with residual oxygen was introduced into the hot zone of the continuous furnace using an open feed tube, indicating that annealing of copper is not feasible using an atmosphere generated by using exclusively non-cryogenically produced nitrogen mixed with hydrogen inside the furnace. Although there is no explicit mention about residual oxygen in the furnace, the reported experimental results do suggest incomplete conversion of residual oxygen in the furnace to moisture. At best the prior work suggests using atmosphere generated by prereacting residual oxygen present in the non-cryogenically produced nitrogen with a small amount of hydrogen in an external unit for heat treating copper.

Based upon the above discussion, it is clear that there is a need to develop a process for generating low-cost atmospheres inside continuous heat treating furnaces suitable for annealing and heat treating ferrous and non-ferrous metals and alloys using non-cryogenically produced nitrogen and a reducing gas such as hydrogen, a hydrocarbon, or a mixture thereof.

SUMMARY OF THE INVENTION

The present invention pertains to processes for generating in-situ low cost atmospheres suitable for annealing and heat treating ferrous and non-ferrous metals and alloys, brazing metals, sintering metal and ceramic powders, and sealing glass to metals in continuous furnaces from non-cryogenically produced nitrogen. According to the processes, suitable atmospheres are generated by 1) mixing non-cryogenically produced nitrogen containing up to 5% residual oxygen with a reducing gas such as hydrogen, a hydrocarbon, or a mixture thereof, 2) feeding the gas mixture into continuous furnaces having a hot zone operated at temperatures above 550° C. and preferably above 600° C. and above using a non-conventional device, 3) and converting the residual oxygen to an acceptable form such as moisture, a mixture of moisture and carbon dioxide, or a mixture of moisture, hydrogen, carbon monoxide, and carbon dioxide. The processes utilize a gas feeding device that helps in converting residual oxygen present in the feed to an acceptable form prior to coming in contact with the parts to be heat treated. The gas feeding device can be embodied in many forms so long as it can be positioned for introduction of the atmosphere components into the furnace in a manner to promote conversion of the of oxygen in the feed gas to an acceptable form prior to coming in contact with the parts. In some cases, the gas feeding device can be designed in a way that it not only helps in the conversion of oxygen in the feed gas to an acceptable form but also prevents the direct impingement of feed gas with unreacted oxygen on the parts.

According to one embodiment of the invention, copper or copper alloys is heat treated (or bright annealed) in a continuous furnace operated between 600° C. and 750° C. using a mixture of non-cryogenically produced nitrogen and hydrogen. The flow rate of hydrogen is controlled in a way that it is always greater than the stoichiometric amount required for complete conversion of residual oxygen to moisture. More specifically, the flow rate of hydrogen is controlled to be at least 1.1 times the stoichiometric amount required for complete conversion of residual oxygen to moisture.

According to another embodiment of the invention, oxide-free and bright annealing of gold alloys is carried out in a continuous furnace at temperatures close to 750° C. using a mixture of non-cryogenically produced nitrogen and a hydrogen. The flow rate of hydrogen is controlled in a way that it is always significantly greater than the stoichiometric amount required for complete conversion of residual oxygen to moisture. More specifically, the flow rate of hydrogen is controlled to be at least 3.0 times the stoichiometric amount required for complete conversion of residual oxygen to moisture.

According to another embodiment of the invention, controlled, tightly packed oxide annealing without any scaling and rusting of low to high carbon and alloy steels is carried out in a continuous furnace operated at temperatures above 700° C. using a mixture of non-cryogenically produced nitrogen and a reducing gas such as hydrogen, a hydrocarbon, or a mixture thereof. The total flow rate of reducing gas is controlled between 1.10 times to 1.5 times the stoichiometric amount required for complete conversion of residual oxygen to moisture, carbon dioxide, or a mixture thereof.

According to another embodiment of the invention, bright, oxide-free and partially decarburized annealing of low to high carbon and alloy steels is carried out in a continuous furnace operated at temperatures above 700° C. using a mixture of non-cryogenically produced nitrogen and hydrogen. The total flow rate of hydrogen used is always substantially greater than the stoichiometric amount required for the complete conversion of residual oxygen to moisture. More specifically, the flow rate of hydrogen is controlled to be at least 3.0 times the stoichiometric amount required for complete conversion of residual oxygen to moisture.

Still another embodiment of the invention is the bright, oxide-free and partially decarburized, oxide-free and decarburization-free, and oxide-free and partially carburized annealing of low to high carbon and alloy steels carried out in a continuous furnace operated at temperatures above 700° C. using a mixture of non-cryogenically produced nitrogen and a reducing gas such as a hydrocarbon or a mixture of hydrogen and a hydrocarbon. The total flow rate of reducing gas used is always greater than the stoichiometric amount required for complete conversion of residual oxygen to moisture, carbon dioxide, or a mixture thereof. For example, the amount of a hydrocarbon used as a reducing gas is at least 1.5 times the stoichiometric amount required for complete conversion of residual oxygen to a mixture of moisture and carbon dioxide.

According to the invention, the amount of a reducing gas added to non-cryogenically produced nitrogen for generating atmospheres suitable for brazing metals, sealing glass to metals, sintering metal and ceramic powders, and annealing non-ferrous alloys is always more than the stoichiometric amount required for the complete conversion of residual oxygen to moisture or a mixture of moisture and carbon dioxide. The furnace temperature used in these applications can be selected from about 700° C. to about 1,100° C.

The amount of a reducing gas added to non-cryogenically produced nitrogen for generating atmospheres suitable for ceramic co-firing and ceramic metallizing according to the invention is always more than the stoichiometric amount required for the complete conversion of residual oxygen to moisture or a mixture of moisture and carbon dioxide. The temperature used in this application can be selected from about 600° C. to about 1,500° C.

The key features of the processes of the present invention include the use of 1) an internally mounted gas feeding device that helps in converting residual oxygen present in non-cryogenically produced nitrogen to an acceptable form prior to coming in contact with the parts and 2) more than stoichiometric amount of a reducing gas required for the complete conversion of residual oxygen to either moisture or a mixture of moisture and carbon dioxide. The process is particularly suitable for generating atmospheres used in continuous annealing and heat treating furnaces operated at 600° C. and above.

BRIEF DESCRIPTION OF THE DRAWINGS

FIG. 3A is a schematic representation of an open tube device according to present invention for introducing atmosphere into a heat treating furnace.

FIG. 3B is a schematic representation of an open tube and baffle device according to present invention for introducing atmosphere into a heat treating furnace.

FIG. 3C is a schematic representation of a semi-porous device according to present invention for introducing atmosphere into a heat treating furnace.

FIG. 3D is a schematic representation an alternate configuration of a semi-porous device according to present invention used to introduce atmosphere into a furnace.

FIGS. 3E and 3F are a schematic representations of other porous devices according to present invention for introducing atmosphere into a heat treating furnace.

DETAILED DESCRIPTION OF THE INVENTION

The present invention relates to processes for generating low-cost atmospheres suitable for annealing and heat treating ferrous and non-ferrous metals and alloys in continuous furnaces using non-cryogenically produced nitrogen. The processes of the present invention are based on the surprising discovery that atmospheres suitable for annealing and heat treating ferrous and non-ferrous metals and alloys, brazing metals, sintering metal and ceramic powders, and sealing glass to metals can be generated inside a continuous furnace from non-cryogenically produced nitrogen by mixing it with a reducing gas in a pre-determined proportion and feeding the mixture into the hot zone of the furnace through a non-conventional device that facilitates conversion of residual oxygen present in non-cryogenically produced nitrogen to an acceptable form prior to coming in contact with the parts and/or prevents the direct impingement of feed gas on the parts.

Nitrogen gas produced by cryogenic distillation of air has been widely employed in many annealing and heat treating applications. Cryogenically produced nitrogen is substantially free of oxygen (oxygen content has generally been less than 10 ppm) and very expensive. Therefore, there has been a great demand, especially by the heat treating industry, to generate nitrogen inexpensively for heat treating applications. With the advent of non-cryogenic technologies for air separation such as adsorption and permeation, it is now possible to produce nitrogen gas inexpensively. The non-cryogenically produced nitrogen, however, is contaminated with up to 5% residual oxygen, which is generally undesirable for many heat treating applications. The presence of residual oxygen has made the direct substitution of cryogenically produced nitrogen for that produced by non-cryogenic techniques very difficult.

Figure 1:
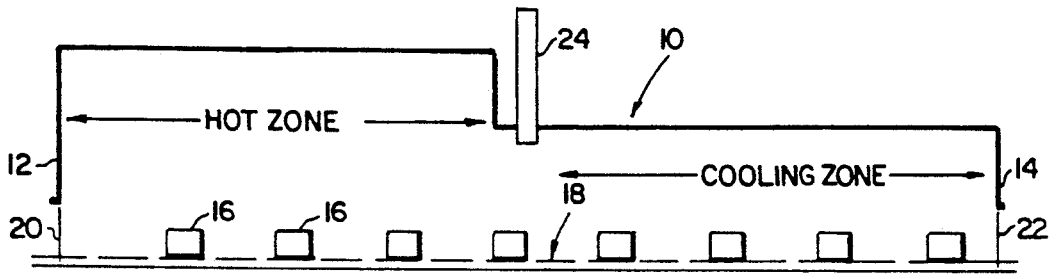
FIG. 1 is a schematic representation of a controlled atmosphere heat teating furnace illustrating atmosphere introduction into the transition or cooling zone of the furnace.

Several attempts to substitute cryogenically produced nitrogen for that produced non-cryogenically in continuous furnaces, have met limited success, even when using additions of excess amounts of a reducing gas. The metallic parts treated with non-cryogenically produced nitrogen were always scaled, rusted, or heavily oxidized. These problems are believed to be caused by the introduction of the gaseous feed mixture through an open tube in the transition (or shock) zone located between the heating and the cooling zones of continuous furnaces. The introduction of non-cryogenically produced nitrogen pre-mixed with a reducing gas in the transition or cooling zone does not allow residual oxygen present in the feed gas to react with the reducing gas, resulting in oxidation of the parts in the cooling zone. This is a conventional way of introducing feed gas into continuous furnaces and is shown in FIG. 1 where 10 denotes the furnace having an entry end 12 and a discharge end 14. Parts 16 to be treated are moved through furnace 10 by means of an endless conveyor 18. Furnace 10 can be equipped with entry and exit curtains 20, 22 respectively to help maintain the furnace atmosphere, a technique known in the art. As shown in FIG. 1 the atmosphere is injected into the transition zone, located between the hot zone and the cooling zone by means of pipe or tube like device 24.

Figure 2:
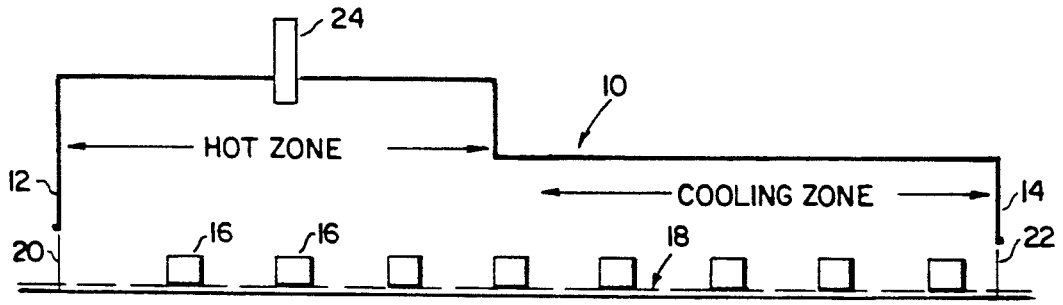
FIG. 2 is a schematic representation of a controlled atmosphere heat treating furnace illustrating atmophere introduction into the hot zone of the furnace.

To improve the rate and extent of reaction between residual oxygen and a reducing gas, attempts have been made to introduce gaseous feed mixture directly into the hot zone of a continuous furnace 10 using a conventional open feed tube 24, as shown in FIG. 2. It was believed that the heat of the furnace would provide necessary thermal energy to facilitate conversion of residual oxygen present in the feed by reaction with the reducing gas to an acceptable form. On the contrary parts were found to be scaled, rusted or heavily oxidized. It was suspected that the feed gas entered the hot zone of the furnace through an open tube at high velocity or as a jet and did not have enough time to heat up and cause the residual oxygen to react with the reducing gas before coming in contact with the parts, resulting in rusting, scaling, or oxidation of the parts.

Figure 3G:
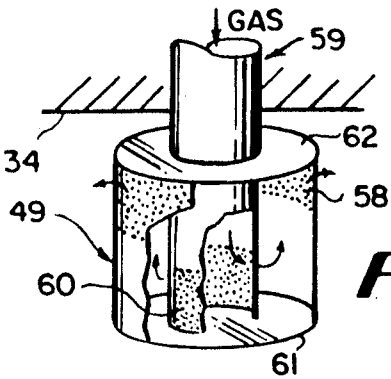
FIG. 3G is a schematic representation of a concentric porous device inside a porous device according to present invention for introducing atmosphere into a heat treating furnace.
Figure 3H:
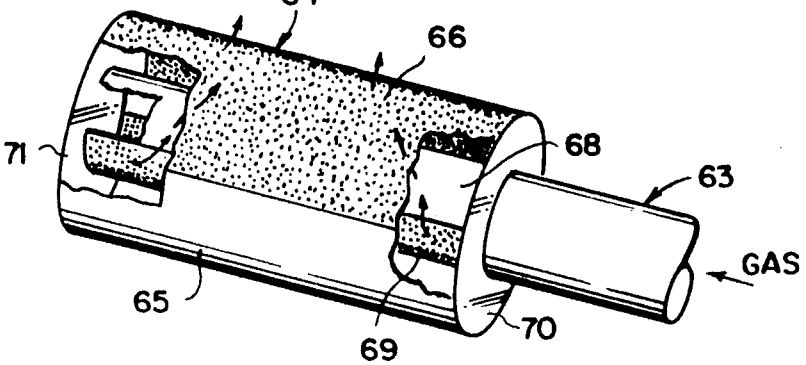
FIGS. 3H and 3I are schematic representations of concentric porous devices according to present invention for introducing atmosphere into a heat treating furnace.
Figure 3I:
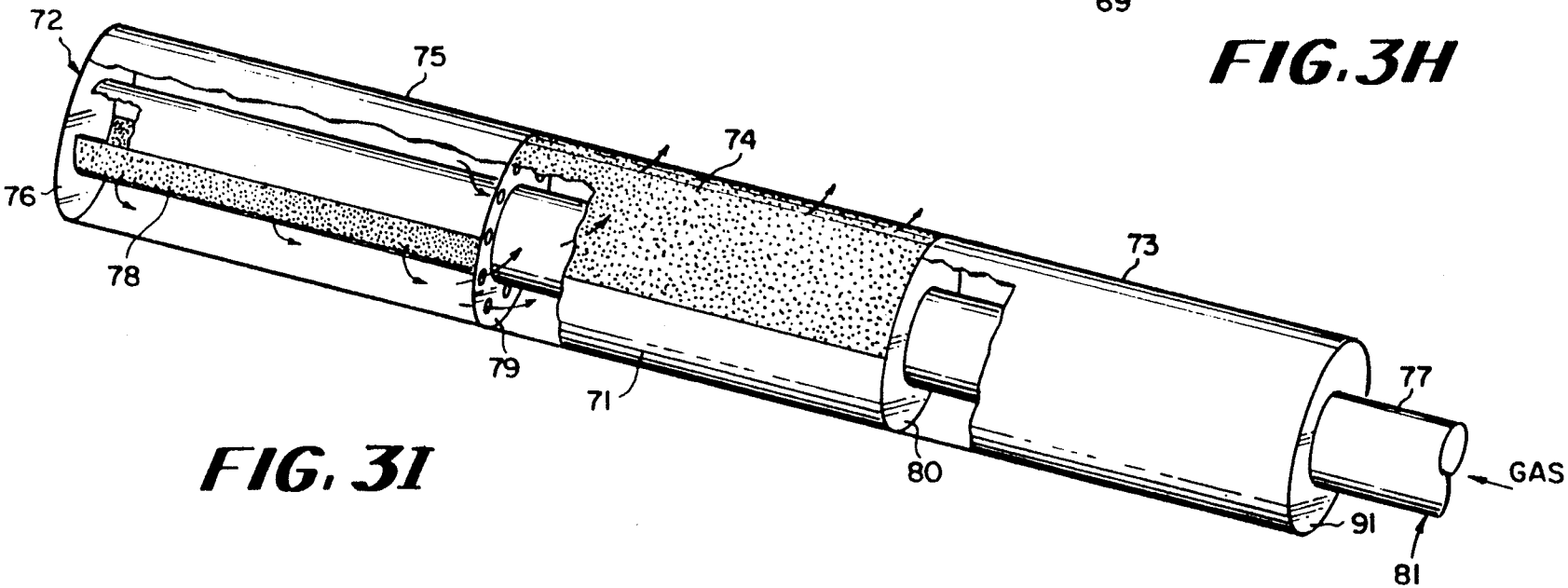

According to the present invention scaling, rusting, and oxidation problems are surprisingly resolved by feeding gaseous mixtures into the furnace in a specific manner so that the residual oxygen present in the feed gas is reacted with a reducing gas and converted to an acceptable form prior to coming in contact with the parts. This was accomplished by introducing the gaseous feed mixture into the hot zone of the furnace using non-conventional devices. The key function of the devices is to prevent the direct impingement of feed gas on the parts and/or to help in converting residual oxygen present in the gaseous feed mixture by reaction with a reducing gas to an acceptable form prior to coming in contact with the parts. The device can be an open tube 30 with its outlet 32 positioned to direct the atmosphere toward the roof 34 of the furnace and away from the parts or work being treated as shown in FIG. 3A; an open tube 36 fitted with a baffle 38 as shown in FIG. 3B to deflect and direct the atmosphere toward the roof 34 of the furnace. A particularly effective device is shown in FIG. 3C disposed horizontally in the furnace between the parts being treated and the top or roof of the furnace the tube having a closed end 42 and being a composite component of a porous section or portion 44 over about one-half of its circumference and a generally non-porous section 46 for the remaining half with the porous portion 44 positioned toward the roof of the furnace with end 43 adapted for filling to a non-porous gas feed tube which in turn is connected to the source of non-croygenically produced nitrogen. A device similar to the one shown in FIG. 3C can dispose horizontally in the furnace between the parts or conveyor (belt, roller, etc.) and the bottom or base of the furnace the device having the porous section 44 positioned toward the base of the furnace. Another device comprises a solid tube terminating in a porous diffuser 50 or terminating with a cap and a plurality of holes around the circumference for a portion of the length disposed within the furnace as shown in FIG. 3D. Alternatively, a cylindrical or semi-cylindrical porous diffuser such as shown respectively as 52 and 55 in FIGS. 3E and 3F can be disposed longitudinally in the furnace at a location either between the parts being treated and the roof of the furnace; or between the parts being treated (or conveyor) and the base of the furnace. FIG. 3G illustrates another device for introducing non-cryogenically produced nitrogen into the furnace which includes a delivery tube 59 terminating in a porous portion 60 disposed within a larger concentric cylinder 49 having a porous upper section 58. Cylinder 49 is sealed at one end by non-porous gas impervious cap 61 which also seals the end of pipe 59 containing porous portion 60 and at the other end by a gas impervious cap 62 which also is sealingly fixed to the delivery pipe 59. Another deivce for introducing gaseous atmosphere into a furnace according to the invention is shown in FIG. 3H where the delivery tube 63 is disposed within a cylinder 64 with the delivery tube 63 and cylinder 64 each having half the circumferential outer surface porous (69,66) and the other half gas impervious (65,68) with the position as shown in the structure assembly using gas impervious end caps 70, 71 similar to those of FIG. 3G. FIG. 3I illustrates another device similar in concept to the device of FIG. 3H where delivery tube elongated 81 is concentrically disposed within an elongated cylinder 72 in a manner similar to the device of FIG. 3H. Delivery tube 81 has a semi-circumferential porous position 78 at one end for approximately one-third the length with the balance 77 being gas impervious. Outer cylinder 72 has a semi-circumferential porous section 74 extending for about one-third the length and disposed between two totally impervious sections 73, 75. Baffles 79 and 80 are used to position the tube 81 concentrically within cylinder 72 with baffle 79 adapted to permit flow of gas from porous section 78 of tube 81 to porous section 74 of cylinder 72. End caps 76 and 91, as well as baffle or web 80 are gas impervious and sealingly fixed to both tube 81 and cylinder 72. Arrows are used in FIGS. 3G, 3H and 3I to show gas flow through each device.

In addition to using devices discussed above, a flow directing plate or a device facilitating premixing hot gases present in the furnace with the feed gases can also be used.

The design and dimensions of the device will depend upon the size of the furnace, the operating temperature, and the total flow rate of the feed gas used during heat treatment. For example, the internal diameter of an open tube fitted with a baffle can vary from 0.25 in. to 5 in. The porosity and the pore size of porous sintered metal or ceramic end tubes can vary from 5% to 90% and from 5 microns to 1,000 microns or less, respectively. The length of porous sintered metal or ceramic end tube can vary from about 0.25 in. to about 5 feet. The porous sintered metal end tube can be made of a material selected from stainless steel, monel, inconel, or any other high temperature resistant metal. The porous ceramic portion of the tube can be made of alumina, zirconia, magnesia, titania, or any other thermally stable material. The diameter of metallic end tube with a plurality of holes can also vary from 0.25 in. to 5 in. depending upon the size of the furnace. The metallic end tube can be made of a material selected from stainless steel, monel, inconel, or any other high temperature resistant metal. Its length can vary from about 0.25 in. to about 5 feet. The size and the number of holes in this end tube can vary from 0.05 in. to 0.5 in. and from 2 to 10,000, respectively. Finally, more than one device can be used to introduce gaseous feed mixture in the hot zone of a continuous furnace depending upon the size of the furnace and the total flow rate of feed gas or gases.

As shown in FIGS. 3A through 3I depending upon the type of the device and the size and design of the furnace used it can be inserted in the hot zone of the furnace through the top, sides, or the bottom of the furnace. The devices of FIGS. 3C, 3E, 3F, 3H and 3I can be inserted through the cooling zone vestibule by being connected to a long tube. Such devices can also be placed through the hot zone vestibule once again connected via a long tube. It is however very important that any atmosphere or gas injection or introduction device is not placed too close to the entrance or shock zone of the furnace. This is because temperatures in these areas are substantially lower than the maximum temperature in the furnace, resulting in incomplete conversion of residual oxygen to an acceptable form and concomitantly oxidation, rusting and scaling of the parts.

A continuous furnace operated at atmospheric or above atmospheric pressure with separate heating and cooling zones is most suitable for the processes of the present invention. The continuous furnace can be of the mesh belt, a roller hearth, a pusher tray, a walking beam, or a rotary hearth type.

The residual oxygen in non-cryogenically produced nitrogen can vary from 0.05% to about 5%. It can preferably vary from about 0.1% to about 3%. More preferably, it can vary from about 0.2% to about 1.0%.

The reducing gas can be selected from the group consisting of hydrogen, a hydrocarbon, an alcohol, an ether, or mixtures thereof. The hydrocarbon gas can be selected from alkanes such as methane, ethane, propane, and butane, alkenes such as ethylene, propylene, and butene, alcohols such as methanol, ethanol, and propanol, and ethers such as dimethyl ether, diethyl ether, and methyl-ethyl ether. Commercial feedstocks such as natural gas, petroleum gas, cooking gas, coke oven gas, and town gas can also be used as a reducing gas.

The selection of a reducing gas depends greatly upon the annealing and heat treating temperature used in the furnace. For example, hydrogen gas can be used in the furnace operating at temperatures ranging from about 600° C. to 1,250° C. and is preferably used in the furnaces operating at temperatures from about 600° C. to about 900° C. A hydrocarbon selected from alkanes, alkenes, ethers, alcohols, commercial feedstocks, and their mixtures can be used as a reducing gas in the furnace operating at temperatures from about 800° C. to about 1,250° C., preferably used in the furnaces operating at temperatures above 850° C. A mixture of hydrogen and a hydrocarbon selected from alkanes, alkenes, ethers, alcohols, and commercial feedstocks can be used as a reducing gas in the furnaces operating at temperatures from about 800° C. to about 1,250° C., preferably used in the furnaces operating between 850° C. to about 1,250° C.

The selection of the amount of a reducing gas depends upon the heat treatment temperature and the material being heat treated. For example, copper or copper alloys are annealed at a temperatures between about 600° C. and 750° C. using hydrogen as a reducing gas with a flow rate above about 1.10 times the stoichiometric amount required for the complete conversion of residual oxygen to moisture. More specifically, the flow rate of hydrogen is selected to be at least 1.2 times the stoichiometric amount required for the complete conversion of residual oxygen to moisture.

The controlled oxide annealing of low to high carbon and alloy steels is carried out at temperatures between 700° C. and 1,250° C. using hydrogen as a reducing gas with a flow rate varying from about 1.10 times to about 2.0 times the stoichiometric amount required for complete conversion of residual oxygen to moisture. Low to high carbon and alloy steels can be controlled oxide annealed at temperatures between 800° C. to 1,250° C. using a hydrocarbon or a mixture of a hydrocarbon and hydrogen with a total flow rate varying from about 1.10 times to about 1.5 times the stoichiometric amount required for complete conversion of residual oxygen to moisture, carbon dioxide or a mixture of carbon dioxide and moisture. An amount of hydrogen, a hydrocarbon, or a mixture of hydrogen and a hydrocarbon above about 1.5 times the stoichiometric amount required for the complete conversion of residual oxygen to moisture, carbon dioxide, or a mixture of moisture and carbon dioxide is generally not selected for controlled oxide annealing of carbon and alloy steels.

The bright, oxide-free and partially decarburized annealing of low to high carbon and alloy steels is carried out at temperatures betweem 700° C. to 1,250° C. using hydrogen as a reducing gas with a flow rate varying from about 3.0 times to about 10.0 times the stoichiometric amount required for complete conversion of residual oxygen to moisture. Low to high carbon and alloy steels are also oxide-free and partially decarburized, oxide and decarburize-free, and oxide-free and partially carburized annealed at temperatures between 800° C. to 1,250° C. using a hydrocarbon or a mixture of a hydrocarbon and hydrogen with a flow rate varying from about 1.5 times to about 10.0 times the stoichiometric amount required for complete conversion of residual oxygen to moisture, carbon dioxide or a mixture of carbon dioxide and moisture. An amount of hydrogen, a hydrocarbon, or a mixture of hydrogen and a hydrocarbon below 1.5 times the stoichiometric amount required for the complete conversion of residual oxygen to moisture, carbon dioxide, or a mixture of moisture and carbon dioxide is generally not selected for oxide and decarburize-free, oxide-free and partially decarburized, and oxide-free and partially carburized annealing of carbon and alloy steels.

The brazing of metals, sealing of glass to metals, sintering of metal and caramic powders, or annealing non-ferrous alloys is carried out at temperatures betweem 700° C. to 1,250° C. using hydrogen as a reducing gas with a flow rate varying from about 1.2 times to about 10.0 times the stoichiometric amount required for the complete conversion of residual oxygen to moisture. The brazing of metals, sealing of glass to metals, sintering of metal and ceramic powders, or annealing non-ferrous alloys is also carried out at temperatures between 800° C. to 1,250° C. using a hydrocarbon or a mixture of a hydrocarbon and hydrogen with a total flow rate varying from about 1.5 times to about 10.0 times the stoichiometric amount required for complete conversion of residual oxygen to moisture, carbon dioxide or a mixture of carbon dioxide and moisture. An amount of hydrogen, a hydrocarbon, or a mixture of hydrogen and a hydrocarbon below 1.5 times the stoichiometric amount required for complete conversion of residual oxygen to moisture, carbon dioxide, or a mixture of moisture and carbon dioxide is generally not selected for brazing of metals, sealing of glass to metals, sintering of metal and ceramic powders or annealing non-ferrous alloys.

Low and high carbon or alloy steels that can be heat treated according to the present invention can be selected from the groups 10XX, 11XX, 12XX, 13XX, 15XX, 40XX, 41XX, 43XX, 44XX, 46XX, 47XX, 48XX, 50XX, 51XX, 61XX, 81XX, 86XX, 87XX, 88XX, 92XX, 93XX, 50XXX, 51XXX or 52XXX as described in Metals Handbook, Ninth Edition, Volume 4 Heat Treating, published by American Society for Metals. Stainless steels selected from the group 2XX, 3XX, 4XX or 5XX can also be heat treated using disclosed processes. Tool steels selected from the groups AX, DX, OX or SX, iron nickel based alloys such as Incoloy, nickel alloys such as Inconel and Hastalloy, nickel-copper alloys such as Monel, cobalt based alloys such as Haynes and stellite can be heat treated according to processes disclosed in this invention. Gold, silver, nickel, copper and copper alloys selected from the groups C1XXXX, C2XXXX, C3XXXX, C4XXXX, C5XXXX, C6XXXX, C7XXXX, C8XXXX or C9XXXX can also be annealed using the processes of present invention.

Figure 5:
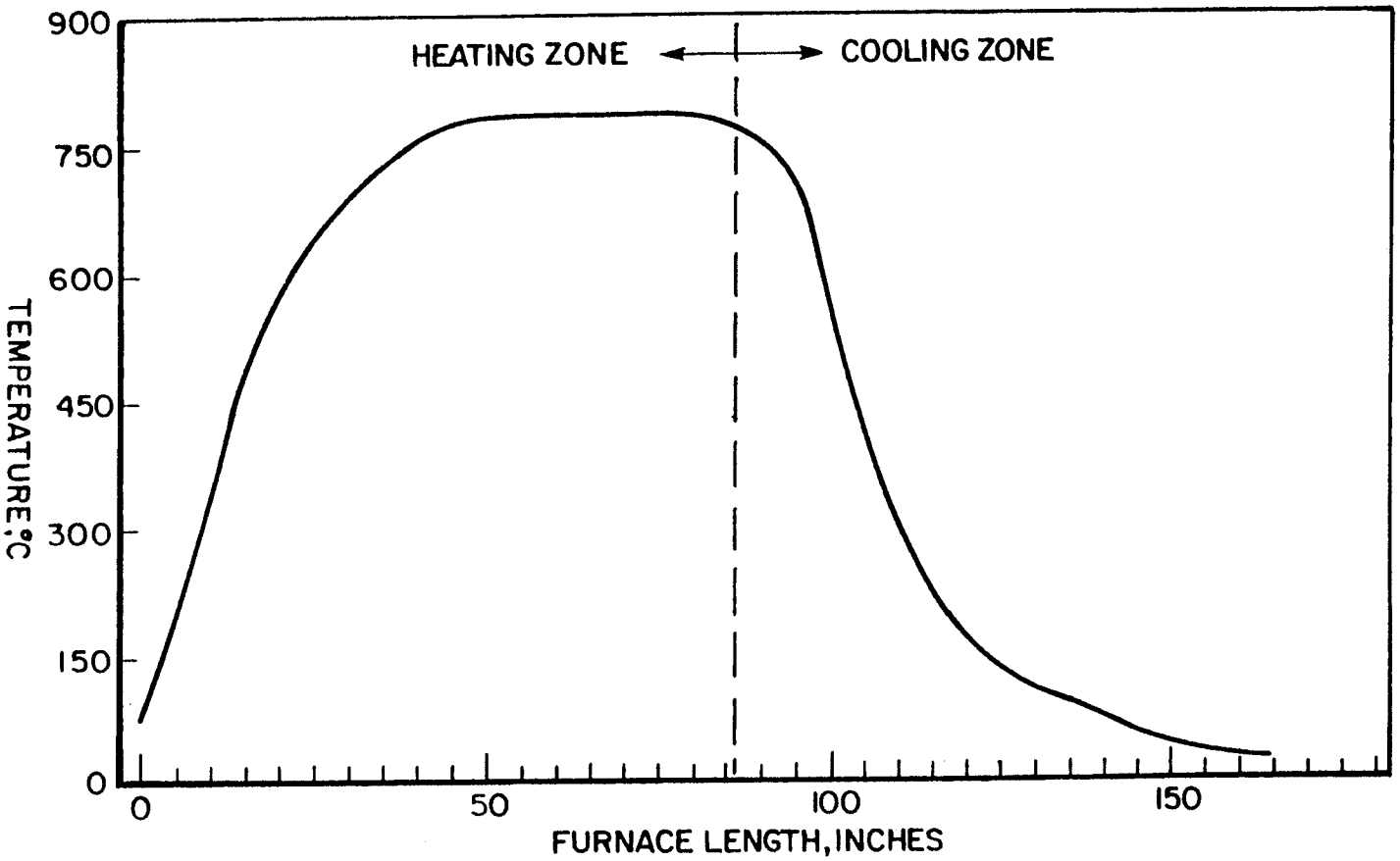
FIG. 5 is a plot of temperature against length of the furnace illustrating the experimental furnace profile for a heat treating temperature of 750° C.
Figure 6:
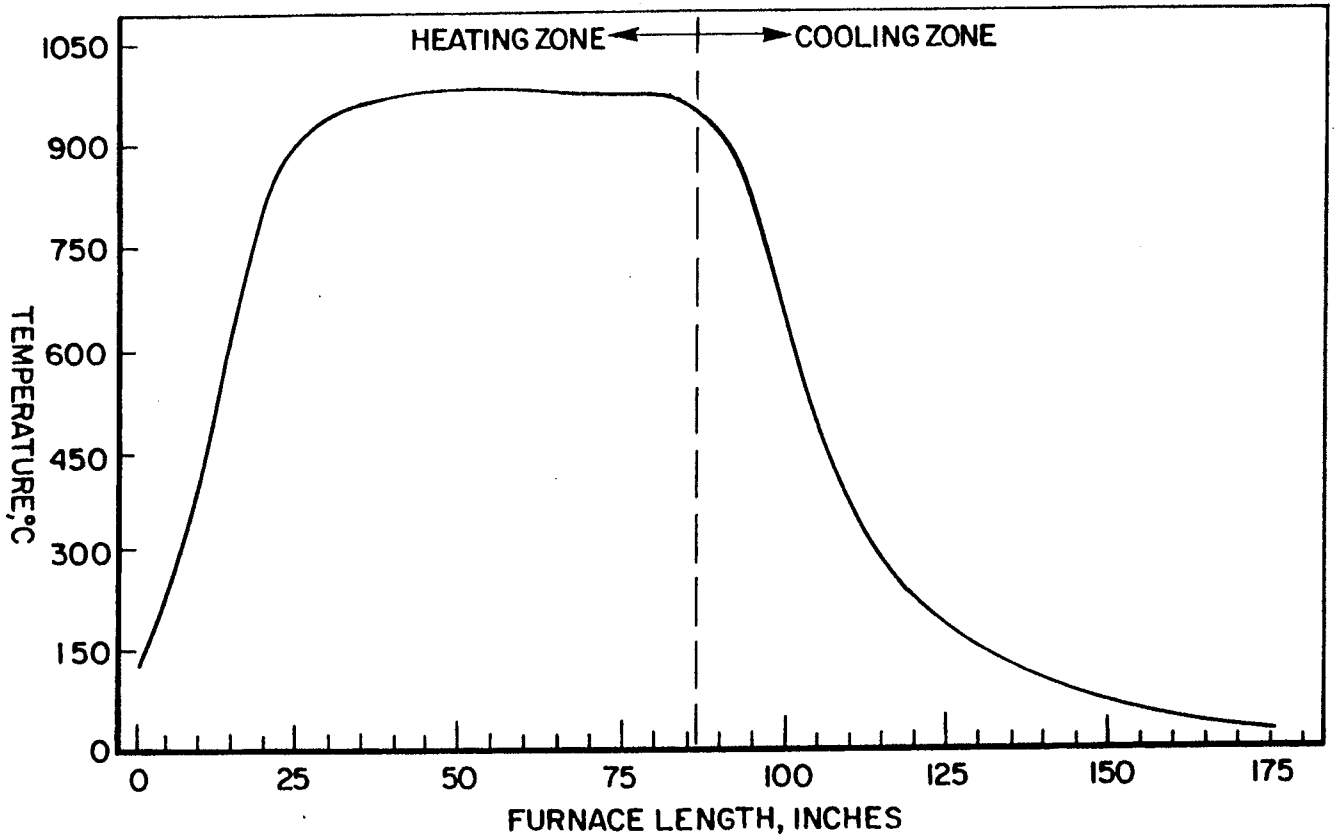
FIG. 6 is a plot similar to that of FIG. 5 for a heat treating temperature of 950° C.

In order to demonstrate the invention a series of annealing and heat treating tests were carried out in a Watkins-Johnson conveyor belt furnace capable of operating up to a temperature of 1,150° C. The heating zone of the furnace consisted of 8.75 in. wide, about 4.9 in. high, and 86 in. long Inconel 601 muffle heated resistively from the outside. The cooling zone, made of stainless steel, was 8.75 in. wide, 3.5 in. high, and 90 in. long and was water cooled from the outside. An 8.25 in. wide flexible conveyor belt supported on the floor of the furnace was used to feed the samples to be heat treated through the heating and cooling zones of the furnace. A fixed belt speed of about 6 in. per minute was used in all the experiments. The furnace shown schematically as 60 in FIG. 4 was equipped with physical curtains 62 and 64 both on entry 66 and exit 68 sections to prevent air from entering the furnace. The gaseous feed mixture containing impure nitrogen pre-mixed with hydrogen, was introduced into the transition zone via an open tube introduction device 70 or through one of the introduction devices 72, 74 placed at different locations in the heating or hot zone of the furnace 60. Introduction devices 72, 74 can be any one of the types shown in FIGS. 3A through 3I of the drawing. These hot zone feed locations 72, 74 were located well into the hottest section of the hot zone as shown by the furnace temperature profiles depicted in FIGS. 5 and 6 obtained for 750° C. and 950° C. normal furnace operating temperatures with 350 SCFH of pure nitrogen flowing into furnace 60. The temperature profiles show a rapid cooling of the parts as they move out of the heating zone and enter the cooling zone. Rapid cooling of the parts is commonly used in annealing and heat treating to help in preventing oxidation of the parts from high levels of moisture and carbon dioxide often present in the cooling zone of the furnace. The tendency for oxidation is more likely in the furnace cooling zone since a higher $pH_2/pH_2O$ and $pCO/pCO_2$ are needed at lower temperatures where $H_2$ and CO are less reducing and $CO_2$ and $H_2O$ are more oxidizing.

Figure 4:
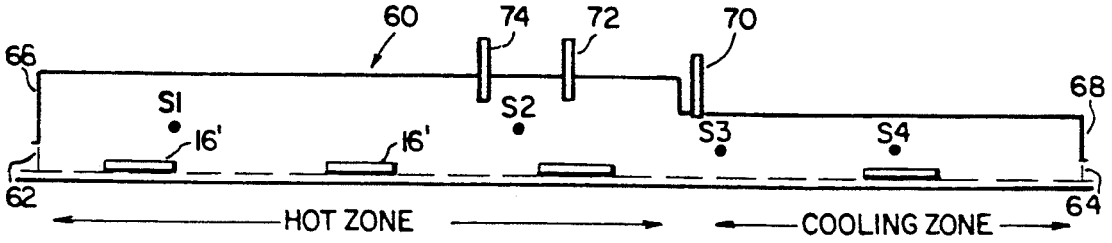
FIG. 4 is a schematic representation of a furnace used to test the heat treating processes according to the present invention.

Samples of ¼ in. to ½ in. diameter and about 8 in. long tubes or about 8 in. long, 1 in. wide and 1/32 in. thick strips made of type 102 copper alloy were used in annealing experiments carried out at temperatures ranging from 600° C. to 750° C. Flat pieces of 9-K and 14-K gold were used in annealing experiments at 750° C. A heat treating temperature between 700° C. to 1,100° C. was selected and used for heat treating 0.2 in. thick flat low-carbon steel specimens approximately 8 in. long by 2 in. wide. As shown in FIG. 4, the atmosphere composition present in the heating zone of the furnace 60 was determined by taking samples at locations designated S1 and S2 and samples were taken at locations S3 and S4 to determine atmosphere composition in the cooling zone. The samples were analyzed for residual oxygen, moisture (dew point), hydrogen, methane, CO, and $CO_2$.

Several experiments were carried out to study bright annealing of copper using non-cryogenically produced nitrogen pre-mixed with hydrogen at temperatures varying from 600° F. to 750° C. The feed gas was introduced in the transition zone or the heating zone through a straight open-ended tube simulating the conventional method of introducing gas into the furnace. A porous sintered metal diffuser, which is effective in reducing the feed gas velocity and dispersing it in the furnace, was also used for introducing gas into the heating zone of the furnace. Another porous sintered metal diffuser especially designed to prevent the direct impingement of feed gas on the parts was also used for introducing feed gas into the heating zone of the furnace. The results of these experiments are set out in Table 1.

The following summary of the data presented in Table 1 illustrates one aspect of the invention.

EXAMPLE 1

Samples of copper alloy described earlier were annealed at 700° C. in the Watkins-Johnson furnace using 350 SCFH of nitrogen containing 99.5% $N_2$ and 0.5% $O_2$. The feed gas was introduced into the furnace through a ¾ in. diameter straight open ended tube located in the transition zone of the furnace. This method of gas introduction is conventionally practiced in the heat treatment industry. The feed nitrogen composition used was similar to that commonly produced by non-cryogenic air separation techniques. The feed gas was passed through the furnace for at least one hour to purge the furnace prior to annealing the samples.

The copper samples annealed in this example were heavily oxidized and scaled. The oxidation of the samples was due to the presence of high levels of oxygen both in the heating and cooling zones of the furnace, as shown in Table 1.

This example showed that non-cryogenically produced nitrogen containing residual oxygen cannot be used for bright annealing copper.

EXAMPLE 2

The copper annealing experiment described in Example 1 was repeated using the same furnace, temperature, samples, location of feed gas, nature of feed gas device, flow rate and composition of feed gas, and annealing procedure with the exception of adding 1.2% hydrogen to the feed gas. The amount of hydrogen added was 1.2 times stoichiometric amount required for converting residual oxygen present in the feed nitrogen completely to moisture.

The copper samples heat treated in this example were heavily oxidized. The oxygen present in the feed gas was converted almost completely to moisture in the heating zone, as shown by the data in Table 1. However, oxygen present in the atmosphere in the colling zone was not converted completely to moisture, causing oxidation of annealed samples.

The parts treated according to Example 2 showed that the introduction of non-cryogenically produced nitrogen pre-mixed with hydrogen into the furnace through an open tube located in the transition zone is not acceptable for bright annealing copper.

EXAMPLE 3A

The copper annealing experiment described in Example 1 was repeated using a similar procedure and operating conditions with the exception of having a nominal furnace temperature of 750° C.

The as treated copper samples were heavily oxidized and scaled, thus showing that the introduction of non-cryogenically produced nitrogen into the furnace through an open tube located in the transition zone is not acceptable for bright annealing copper.

EXAMPLE 3B

The copper annealing experiment described in Example 2 was repeated using similar procedure and operating conditions with the exception of using a 750° C. furnace temperature. This amount of hydrogen was 1.2 times the stoichiometric amount required for the complete conversion of oxygen present in the feed nitrogen to moisture.

The copper samples once again were heavily oxidized. The oxygen present in the feed gas was converted completely to moisture in the heating zone, however, oxygen in the cooling zone did not convert completely to moisture leading to oxidation of the samples.

Again the results show that the introduction of non-cryogenically produced nitrogen pre-mixed with slightly more than a stoichiometric amount of hydrogen into the furnace through an open tube located in the transition zone is not acceptable for bright annealing copper.

EXAMPLE 3C

The copper annealing experiment described in Example 2 was repeated using similar procedure and operating conditions with the exception of using 750° C. furnace temperature and 10% hydrogen. This amount of hydrogen was ten times the stoichiometric amount required for the complete conversion of oxygen present in the feed nitrogen to moisture.

The copper samples once again were heavily oxidized. The oxygen present in the feed gas was converted completely to moisture in the heating zone but not in the cooling zone, leading to oxidation of the samples.

This example therefore showed that the introduction of non-cryogenically produced nitrogen pre-mixed with excess amounts of hydrogen into the furnace through an open tube located in the transition zone is not acceptable for bright annealing copper.

EXAMPLE 4

The copper annealing experiment described in Example 2 was repeated using similar procedure and operating conditions with the exception of feeding the gaseous mixture through an open tube located in the heating zone of the furnace (Location 72 in FIG. 4). A one-half in. diameter stainless steel tube fitted with a ¾ in. diameter elbow with the opening facing down, i.e., facing sample 16', was inserted into the furnace through the cooling zone to feed the gas into the heating zone. The feed gas therefore entered the heating zone of the furnace impinging directly on the samples. This method of introducing feed gas simulated the introduction of feed gas through an open tube into the heating zone of the furnace. The amount of hydrogen used was 1.2% of the feed gas. It was therefore 1.2 times the stoichiometric amount required for the complete conversion of oxygen to moisture.

The copper samples annealed in this example were once again oxidized. The oxygen present in the feed gas was converted completely to moisture both in the heating and cooling zones of the furnace, as shown in Table 1. The atmosphere composition in the furnace therefore was non-oxidizing to copper samples and should have resulted in good bright samples. Contrary to the expectations, the samples were oxidized. A detailed analysis of the fluid flow and temperature profiles in the furnace indicated that the feed gas was introduced at high velocity and was not heated to a temperature high enough to cause oxygen and hydrogen to react completely in the vicinity of the open feed tube, resulting in the direct impingement of cold nitrogen with unreacted oxygen on the samples and subsequently their oxidation.

This example showed that a conventional open feed tube cannot be used to feed non-cryogenically produced nitrogen pre-mixed with hydrogen in the heating zone of the furnace and produce bright annealed copper samples.

TABLE 1

| | Example 1 | Example 2 | Example 3A | Example 3B | Example 3C |
|---|---|---|---|---|---|
| Type of Sample | Copper | Copper | Copper | Copper | Copper |
| Heat Treating Temperature, °C. | 700 | 700 | 750 | 750 | 750 |
| Flow Rate of Feed Gas, SCFH | 350 | 350 | 350 | 350 | 350 |
| Feed Gas Location | Transition Zone | Transition Zone | Transition Zone | Transition Zone | Transition Zone |
| Type of Feed Device | Open Tube | Open Tube | Open Tube | Open Tube | Open Tube |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Feed Hydrogen*, % | — | 1.2 | — | 1.2 | 10.0 |
| Heating Zone Atmosphere Composition | | | | | |
| Oxygen, ppm | ~4,700 | 5-110 | ~4,300 | <6 | <6 |
| Hydrogen, % | — | 0.1 | — | 0.1 | ~9.0 |
| Dew Point, °C. | −37 | 2.9 to 4.3 | −60.0 | +7.0 | 3.9 |
| Cooling Zone | | | | | |

TABLE 1-continued

| | | | | | |
|---|---|---|---|---|---|
| Atmosphere Composition | | | | | |
| Oxygen, ppm | 4,200–4,500 | 1,800–3,300 | 4,500–4,700 | 3,100–4,300 | 470–3,500 |
| Hydrogen, % | — | 0.7–0.8 | — | 0.9 | ~9.0 |
| Dew Point, °C. | −40 | −5.9 to −17.7 | −60.0 | −7.5 to −18.6 | 3.9 |
| Quality of Heat Treated Samples | Heavily Oxidized and Scaled | Heavily Oxidized | Heavily Oxidized and Scaled | Heavily Oxidized | Heavily Oxidized |

| | Example 4 | Example 5A | Example 5B | Example 6 | Example 7 |
|---|---|---|---|---|---|
| Type of Sample | Copper | Copper | Copper | Copper | Copper |
| Heat Treating Temperature, °C. | 700 | 700 | 750 | 700 | 700 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Open Tube | Open Tube | Open Tube | Porous Diffuser | Porous Diffuser |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Feed Hydrogen*, % | 1.2 | 5.0 | 5.0 | 1.2 | 5.0 |
| Heating Zone Atmosphere Composition | | | | | |
| Oxygen, ppm | <5 | <9 | <5 | <5 | <3 |
| Hydrogen, % | 0.1–0.2 | ~4.0 | 4.0 | 0.15–0.2 | 4.0–4.1 |
| Dew Point, °C. | ~3.5 | — | 7.2 | 2.3 | 1.3 |
| Cooling Zone Atmosphere Composition | | | | | |
| Oxygen, ppm | <5 | <8 | <6 | <9 | <3 |
| Hydrogen, % | 0.1 | ~4.0 | 4.1 | 0.2 | 4.0–4.1 |
| Dew Point, °C. | ~3.5 | — | 7.0 | 2.0 | 1.3 |
| Quality of Heat Treated Samples | Oxidized | Oxidized | Partially Oxidized | Partially Oxidized | Partially Oxidized |

*Hydrogen gas was mixed with nitrogen and added as a percent of total non-cryogenically produced feed nitrogen.

EXAMPLE 5A

The copper annealing experiment described in Example 4 was repeated using similar procedure and operating conditions with the exception of adding 5% hydrogen instead of 1.2%, as shown in Table 1. This amount of hydrogen was five times the stoichiometric amount needed for the complete conversion of oxygen to moisture.

The copper samples annealed in this example were once again oxidized due to the direct impingement of cold nitrogen with unreacted oxygen on the samples.

This example showed that a conventional open feed tube cannot be used to feed non-cryogenically produced nitrogen pre-mixed with excess amounts of hydrogen in the heating zone of the furnace and produce bright annealed copper samples.

EXAMPLE 5B

The copper annealing experiment described in Example 5A was repeated using similar procedure and operating conditions with the exception of using 750° C. furnace temperature instead of 700° C., as shown in Table 1. The amount of hydrogen added was five times the stoichiometric amount needed for the complete conversion of oxygen to moisture.

The copper samples annealed in this example were once again oxidized due to the direct impingement of cold nitrogen with unreacted oxygen on the samples.

This example once again showed that a conventional open feed tube cannot be used to feed non-cryogenically produced nitrogen pre-mixed with excess amounts of hydrogen in the heating zone of the furnace and produce bright annealed copper samples.

EXAMPLE 6

The copper annealing experiment described in Example 2 was repeated using similar procedure and operating conditions with the exception of feeding the gaseous mixture through a ½ in. diameter, 6 in. long sintered Inconel porous diffuser supplied by Mott Metallurgical Corporation at Framington, Conn. The average pore size in the diffuser was approximately 20 microns and it had 40–50% open porosity and was located in the heating zone (Location 72 in FIG. 4) of the furnace 60. The porous diffuser having an open end fixed to a one-half inch diameter stainless steel tube and other end closed by a generally gas impervious cap was inserted into the furnace through the discharge door 68 into the cooling zero of furnace 60. It was expected to help not only in dispersing feed gas effectively in the heating zone, but also in heating it. The amount of hydrogen added to the feed gas containing 0.5% oxygen was 1.2%. It was 1.2 times the stoichiometric amount required for the complete conversion of oxygen to moisture.

The copper samples annealed in this example were partially oxidized. The oxygen present in the feed gas was completely converted to moisture in the heating and cooling zones, as indicated by the atmosphere analysis in Table 1. The diffuser did help in dispersing feed gas in the furnace and converting oxygen to moisture. However, it is believed that a part of feed gas was not heated to high enough temperature, resulting in the impingement of unreacted oxygen on the samples and subsequently their oxidation.

This example showed that using a porous sintered metal diffuser to feed non-cryogenically produced nitrogen pre-mixed with hydrogen in the heating zone of the furnace operated at 700° C. would not produce bright annealed copper samples.

EXAMPLE 7

The copper annealing experiment described in Example 6 was repeated using similar procedure, gas feeding device, and operating conditions with the exception of using 5% hydrogen, which was five times the stoichiometric amount required for the complete conversion of oxygen to moisture.

The copper samples annealed in this example were partially bright and partially oxidized. The oxygen present in the feed gas was converted completely to moisture in the heating and cooling zones of the furnace, as shown in Table 1. However, the samples were oxidized even with the excess amount of hydrogen due mainly to the impingement of a part of partially heated feed gas with unreacted oxygen on them, indicating that a porous sintered metal diffuser cannot be used to feed non-cryogenically produced nitrogen pre-mixed with hydrogen in the heating zone of the furnace operated at 700° C. to produce bright annealed copper samples.

The foregoing examples demonstrated that an open feed tube located in the shock or heating zone of the furnace cannot be used to introduce non-cryogenically produced nitrogen pre-mixed with hydrogen into the furnace and produce bright annealed copper samples. Although oxygen present in the feed gas was completely converted to moisture in the heating and cooling zones of the furnace in some cases, it was not converted completely to moisture in the vicinity of the feed area. It is believed that the feed gas enters the furnace at high velocity and therefore is not permitted time to heat up to cause residual oxygen and hydrogen present in it to react. This results in the impingement of feed gas with unreacted oxygen on the samples and consequently their oxidation.

The foregoing examples showed improvement in the product quality with the use of a porous diffuser due to 1) reduction in the velocity of feed gas and 2) more uniform dispersion of feed gas in the furnace. It is believed the porous diffuser helps in heating the gaseous feed mixture, but apparently not to a high enough temperature to eliminate direct impingement of unreacted oxygen on the samples. Therefore further investigation was undertaken using a combination of higher temperature (>700° C.) and porous diffuser to try and convert residual oxygen to moisture to produce bright annealed copper. As the results of the preliminary experimental work it was also believed that a porous diffuser may help converting all the residual oxygen in the vicinity of the feed area and in preventing direct impingement of feed gas with unreacted oxygen and producing bright annealed copper in furnaces with different dimensions, especially furnaces having height greater than 4 inches, and furnaces operated at higher temperatures (>700° C.).

Another series of experiments were conducted to illustrate the invention. This further series of experiments is summarized in Table 2 and discussed following the table.

TABLE 2

| | Example 2-1 | Example 2-2 | Example 2-3 | Example 2-4 | Example 2-5 |
|---|---|---|---|---|---|
| Type of Sample | Copper | Copper | Copper | Copper | Copper |
| Heat Treating Temperature, °C. | 700 | 700 | 700 | 700 | 700 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser |
| Feed Gas Composition | | | | | |
| Nitrogen, % | 99.5 | 99.5 | 99.5 | 99.5 | 99.75 |
| Oxygen, % | 0.5 | 0.5 | 0.5 | 0.5 | 0.25 |
| Hydrogen*, % | 1.2 | 1.5 | 5.0 | 10.0 | 0.6 |
| Heating Zone Atmosphere Composition | | | | | |
| Oxygen, ppm | <4 | <5 | <4 | <4 | <4 |
| Hydrogen, % | 0.2 | 0.5 | 4.0–4.1 | — | 0.1 |
| Dew Point, °C. | 3.3 | 3.3 | 2.8 | 3.3 | −7.8 |
| Cooling Zone Atmosphere Composition | | | | | |
| Oxygen, ppm | <4 | <5 | <4 | <4 | <9 |
| Hydrogen, % | 0.2 | 0.5 | 4.0 | — | 0.1 |
| Dew Point, °C. | 2.5 | 3.9 | 3.3 | 3.3 | −7.8 |
| Quality of Heat Treating Sample | Bright | Bright | Bright | Bright | Bright |

| | Example 2-6 | Example 2-7 | Example 2-8 | Example 2-9 | Example 2-10 |
|---|---|---|---|---|---|
| Type of Sample | Copper | Copper | Copper | Copper | Copper |
| Heat Treating Temperature, °C. | 700 | 700 | 700 | 700 | 700 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser |
| Feed Gas Composition | | | | | |
| Nitrogen, % | 99.75 | 99.75 | 99.75 | 99.0 | 99.0 |
| Oxygen, % | 0.25 | 0.25 | 0.25 | 1.0 | 1.0 |
| Hydrogen*, % | 1.0 | 5.0 | 10.0 | 2.2 | 4.0 |
| Heating Zone Atmosphere Composition | | | | | |
| Oxygen, ppm | <4 | <4 | <4 | <4 | <4 |
| Hydrogen, % | 0.5 | 4.5 | — | 0.2 | 0.5 |
| Dew Point, °C. | −8.3 | −8.3 | −7.2 | +12.8 | +11.1 |

TABLE 2-continued

| | | | | | |
|---|---|---|---|---|---|
| Cooling Zone | | | | | |
| Atmosphere Composition | | | | | |
| Oxygen, ppm | <6 | <5 | <4 | <4 | <7 |
| Hydrogen, % | 0.5 | 4.5 | — | 0.2 | 0.5 |
| Dew Point, °C. | −8.9 | −8.3 | −7.8 | +12.8 | +12.2 |
| Quality of Heat Treated Sample | Bright | Bright | Bright | Bright | Bright |
| | Example 2-11 | Example 2-12 | Example 2-13 | Example 2-14 | Example 2-15 |
| Type of Sample | Copper | Copper | Copper | Copper | Copper |
| Heat Treating Temperature, °C. | 650 | 650 | 650 | 600 | 600 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Hydrogen*, % | 1.2 | 1.5 | 5.0 | 1.2 | 5.0 |
| Heating Zone | | | | | |
| Atmosphere Composition | | | | | |
| Oxygen, ppm | <5 | <2 | <2 | <5 | <4 |
| Hydrogen, % | 0.25 | ~0.6 | 4.0 | ~0.25 | 4.1 |
| Dew Point, °C. | +5.0 | +3.8 | +3.9 | +2.8 | +3.3 |
| Cooling Zone | | | | | |
| Atmosphere Composition | | | | | |
| Oxygen, ppm | 140–190 | 22–24 | 13 | 1150–1550 | 225–620 |
| Hydrogen, % | 0.35 | 0.6 | 4.0 | ~0.5 | ~4.2 |
| Dew Point, °C. | +4.4 | +3.33 | +3.9 | −2.2 | +1.1 |
| Quality of Heat Treated Sample | Oxidized | Bright | Bright | Oxidized | Oxidized |
| | Example 2-16 | Example 2-17 | Example 2-18 | Example 2-19 | Example 2-20 |
| Type of Sample | Copper | Copper | Copper | Copper | Copper |
| Heat Treating Temperature, °C. | 600 | 600 | 600 | 750 | 750 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser |
| Feed Gas Composition | | | | | |
| Nitrogen, % | 99.5 | 99.75 | 99.75 | 99.5 | 99.5 |
| Oxygen, % | 0.5 | 0.25 | 0.25 | 0.5 | 0.5 |
| Hydrogen*, % | 10.0 | 7.5 | 10.0 | 1.0 | 1.5 |
| Heating Zone | | | | | |
| Atmosphere Composition | | | | | |
| Oxygen, ppm | <6 | <6 | <6 | <6 | <2 |
| Hydrogen, % | — | — | — | 0.0 | 0.5 |
| Dew Point, °C. | +4.4 | −6.7 | −6.7 | +3.9 | +4.4 |
| Cooling Zone | | | | | |
| Atmosphere Composition | | | | | |
| Oxygen, ppm | 130 | 46 | 48 | <5 | <3 |
| Hydrogen, % | — | — | — | 0.0 | 0.5 |
| Dew Point, °C. | +2.8 | −7.2 | −6.7 | +3.9 | +1.7 |
| Quality of Heat Treated Sample | Oxidized | Bright | Bright | Oxidized | Bright |
| | Example 2-21 | Example 2-22 | Example 2-23 | Example 2-24 | Example 2-25 |
| Type of Sample | Copper | Copper | Copper | Copper | Copper |
| Heat Treating Temperature, °C. | 750 | 750 | 750 | 750 | 750 |
| Flow Rate of Feed Gas, SCFH | 450 | 550 | 650 | 750 | 850 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Diffuser |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Hydrogen*, % | 1.5 | 1.5 | 1.5 | 1.5 | 1.5 |
| Heating Zone | | | | | |
| Atmosphere Composition | | | | | |
| Oxygen, ppm | <4 | <5 | <6 | <4 | <6 |
| Hydrogen, % | 0.5 | 0.5 | 0.5 | 0.5 | 0.5 |
| Dew Point, °C. | — | +3.9 | +3.9 | +3.3 | +3.3 |
| Cooling Zone | | | | | |
| Atmosphere Composition | | | | | |
| Oxygen, ppm | <4 | <9 | <15 | <30 | 60–330 |
| Hydrogen, % | 0.5 | 0.5 | ~0.6 | 0.5 | ~0.5 |
| Dew Point, °C. | — | +3.3 | +3.3 | +3.9 | +1.7 |
| Quality of Heat Treated Sample | Bright | Bright | Bright | Bright | Oxidized |
| | Example 2-26 | Example 2-27 | Example 2-28 | Example 2-29 | Example 2-30 |

TABLE 2-continued

| | | | | | |
|---|---|---|---|---|---|
| Type of Sample | Copper | Copper | Copper | Copper | Copper |
| Heat Treating Temperature, °C. | 750 | 750 | 750 | 750 | 750 |
| Flow Rate of Feed Gas, SCFH | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Hydrogen*, % | 1.2 | 5.0 | 10.0 | 1.2 | 5.0 |
| Heating Zone Atmosphere Composition | | | | | |
| Oxygen, ppm | <4 | <3 | <3 | <4 | <4 |
| Hydrogen, % | ~0.3 | ~3.8 | — | 0.2 | 4.0 |
| Dew Point, °C. | +2.8 | +6.1 | +4.4 | +5.9 | +6.4 |
| Cooling Zone Atmosphere Composition | | | | | |
| Oxygen, ppm | <4 | <3 | <4 | <4 | <4 |
| Hydrogen, % | ~0.3 | ~3.8 | — | 0.2 | 4.0 |
| Dew Point, °C. | +3.9 | +4.4 | +3.3 | +5.6 | +6.1 |
| Quality of Heat Treated Sample | Bright | Bright | Bright | Bright | Bright |

| | Example 2-31 | Example 2-32 | Example 2-33A | Example 2-33B | Example 2-33C |
|---|---|---|---|---|---|
| Type of Sample | Copper | Copper | Copper | Copper | Copper |
| Flow Rate of Feed Gas, SCFH | 350 | 350 | 350 | 500 | 850 |
| Heat Treating Temperature, °C. | 750 | 750 | 750 | 750 | 750 |
| Feed Gas Location | Heating Zone (Location 72) | Heating Zone (Location 74) | Heating Zone (Location 74) | Heating Zone (Location 74) | Heating Zone (Location 74) |
| Type of Feed Device | Open Tube Facing Ceiling of Furnace | Open Tube Facing Ceiling of Furnace | Open Tube Facing Ceiling of Furnace | Open Tube Facing Ceiling of Furnace | Open Tube Facing Ceiling of Furnace |
| Feed Gas Composition | | | | | |
| Nitrogen, % | 99.5 | 99.5 | 99.5 | 99.5 | 99.5 |
| Oxygen, % | 0.5 | 0.5 | 0.5 | 0.5 | 0.5 |
| Hydrogen*, % | 1.5 | 1.5 | 5.0 | 5.0 | 5.0 |
| Heating Zone Atmosphere Composition | | | | | |
| Oxygen, ppm | 900–5800 | <7 | <4 | <3 | <4 |
| Hydrogen, % | 0.1 | 0.45 | 4.0 | 4.2 | 4.0 |
| Dew Point, °C. | +11.3–+11.9 | +8.1 | +7.8 | +7.3 | +6.0 |
| Cooling Zone Atmosphere Composition | | | | | |
| Oxygen, ppm | <3 | <5 | <3 | <3 | <4 |
| Hydrogen, % | 0.5 | 0.45 | 4.0 | 4.3 | 4.0 |
| Dew Point, °C. | +7.2 | +7.8 | +7.9 | +6.8 | +6.0 |
| Quality of Heat Treated Sample | Heavily Oxidized | Bright | Bright | Bright | Bright |

| | Example 2-34 | | Example 2-35 | |
|---|---|---|---|---|
| Type of Sample | Copper-Nickel Alloy #706 | Cooper-Nickel Alloy #715 | Copper-Nickel Alloy #706 | Copper-Nickel Alloy #715 |
| Heat Treating Temperature, °C. | 700 | | 700 | |
| Flow Rate of Feed Gas, SCFH | 350 | | 350 | |
| Feed Gas Location | Heating Zone (Location 74) | | Heating Zone (Location 74) | |
| Type of Feed Device | Modified Porous Diffuser | | Modified Porous Diffuser | |
| Feed Gas Composition | | | | |
| Nitrogen, % | 99.5 | | 99.5 | |
| Oxygen, % | 0.5 | | 0.5 | |
| Hydrogen*, % | 1.2 | | 5.0 | |
| Heating Zone Atmosphere Composition | | | | |
| Oxygen, ppm | <5 | | <5 | |
| Hydrogen, % | 0.2 | | 3.9 | |
| Dew Point, °C. | +15.5 | | +14.5 | |
| Cooling Zone Atmosphere Composition | | | | |
| Oxygen, ppm | <6 | | <6 | |
| Hydrogen, % | 0.2 | | 3.9 | |
| Dew Point, °C. | +15.8 | | +14.6 | |
| Quality of Heat Treating Sample | Bright | Bright | Bright | Bright |

*Hydrogen gas mixed with nitrogen and added as a percent of total non-cryogenically produced feed nitrogen.

Example 2-1

The copper annealing experiment described in Example 6 was repeated using a similar procedure, flow rate and composition of feed gas, and operating conditions with the exception of using a different design of the porous diffuser located in the heating zone of the furnace (Location 72 in FIG. 4). A generally cylindrical shaped diffuser 40 shown in FIG. 3C comprising a top half 44 of ¾ in. diameter, 6 in. long sintered stainless steel material with average pore size of 20 microns and open porosity varying from 40–50% supplied by the Mott Metallurgical Corporation was assembled. Bottom half 46 of diffuser 40 was a gas impervious stainless steel with one end 42 of diffuser 40 diffuser capped and the other end 43 attached to a ½ in. diameter stainless steel feed tube inserted into the furnace 60 through the cooling end vestibule 68. The bottom half 46 of diffuser 40 was positioned parallel to the parts 16′ (prime) being treated thus essentially directing the flow of feed gas towards the hot ceiling of the furnace and preventing the direct impingement of feed gas with unreacted oxygen on the samples 16′. The flow rate of nitrogen (99.5% $N_2$ and 0.5% $O_2$) used in this example was 350 SCFH and the amount of hydrogen added was 1.2%, as shown in Table 2 with the amount of hydrogen being 1.2 times the stoichiometric amount required for the complete conversion of oxygen to moisture.

The copper samples annealed according to this example were bright without any signs of oxidation as shown by the data of Table 2. The oxygen present in the feed gas was converted completely to moisture both in the cooling and heating zones of the furnace.

This example showed that preventing the direct impingement of feed gas with unreacted oxygen on the samples was instrumental in producing annealed copper samples with good quality. It also showed that slightly more than stoichiometric amount of hydrogen is needed to produce copper samples with good bright finish. Most importantly this experimental result proved that non-cryogenically produced nitrogen pre-mixed with hydrogen can be used to bright anneal copper at 700° C.

Example 2—2

The copper annealing experiment described in Example 2-1 was repeated using identical set-up, procedure, operating conditions, and gas feeding device with the exception of adding 1.5% hydrogen to the nitrogen feed gas. The amount of hydrogen used was 1.5 times the stoichiometric amount required for the complete conversion of oxygen to moisture.

Examination of the annealed copper samples revealed them to be bright without any signs of oxidation thus demonstrating that preventing the direct impingement of feed gas with unreacted oxygen on the samples and the use of more than stoichiometric amount of hydrogen are essential for producing acceptable bright annealed copper parts.

Examples 2–3 and 2–4

Additional copper annealing tests were conducted using identical set-up, procedure, operating conditions, and gas feeding device used for Examples 2-1 and 2—2 with the exception of adding 5.0 and 10.0% hydrogen, respectively (see Table 2). These amounts of hydrogen were respectively 5.0 times and 10.0 times the stoichiometric amount required for the complete conversion of oxygen to moisture.

These annealed copper samples were bright without any signs of oxidation again showing that considerably more than stoichiometric amounts of hydrogen can be mixed with non-cryogenically produced nitrogen to bright anneal copper at 700° C.

Example 2–5

Another copper annealing experiment was completed using identical set-up, procedure, flow rate of feed gas, operating conditions, and gas feeding device of Example 2-1 with the exception of the presence of 0.25% $O_2$ in the feed nitrogen and 0.6% added hydrogen, as shown in Table 2. This amount of hydrogen was 1.2 times the stoichiometric amount required for the complete conversion of oxygen to moisture.

The annealed copper samples were bright without any signs of oxidation showing that non-cryogenically produced nitrogen containing low levels of oxygen can be used for bright annealing copper at 700° C. provided more than stoichiometric amount of $H_2$ is used and that the direct impingement of feed gas with unreacted oxygen on samples is avoided.

Examples 2–6, 2–7, and 2–8

The copper annealing experiment described in Example 2–5 was repeated under identical conditions except for the addition of 1.0%, 5.0%, and 10.0% hydrogen, respectively (see Table 2). The amount of hydrogen used was, respectively, 2.0 times, 10.0 times, and 20.0 times the stoichiometric amount required for the complete conversion of oxygen to moisture.

The annealed copper samples were bright without any signs of oxidation, once again showing that non-cryogenically produced nitrogen containing low levels of oxygen can be used for bright annealing copper at 700° C. provided more than stoichiometric amount of $H_2$ is added and that the direct impingement of feed gas with unreacted oxygen on samples is avoided.

Example 2–9

The copper annealing experiment described in Example 2-1 was again repeated in this example except that there was 1.0% $O_2$ in the feed nitrogen and 2.2% added hydrogen, as shown in Table 2. This amount of hydrogen was 1.1 times the stoichiometric amount required for the complete conversion of oxygen to moisture.

The annealed copper samples were bright without any signs of oxidation further proving that non-cryogenically produced nitrogen containing high levels of oxygen can be used for bright annealing copper at 700° C. provided more than stoichiometric amount of $H_2$ is used and that the direct impingement of feed gas with unreacted oxygen on the samples is avoided.

Example 2–10

The copper annealing experiment described in Example 2–9 was repeated except that 4.0% $H_2$ was added to the feed gas, the hydrogen amounts being 2.0 times the stoichiometric amount required for the complete conversion of oxygen to moisture.

The annealed copper samples were bright without any signs of oxidation reinforcing the conclusion that non-cryogenically produced nitrogen containing high levels of oxygen can be used for bright annealing copper at 700° C. provided more than stoichiometric amount of $H_2$ is used and that the direct impingement of feed gas with unreacted oxygen on the samples is avoided.

Example 2–11

The copper annealing experiment described in Example 2-1 was repeated using the identical set-up, procedure, gas feeding device, and operating conditions with the exception of using a nominal furnace temperature in the hot zone of 650° C. (see Table 2). The amount of oxygen in the feed gas was 0.5% and the amount of $H_2$ added was 1.2% (hydrogen = 1.2 times the stoichiometric amount required for the complete conversion of oxygen to moisture).

The annealed copper samples were oxidized, indicating that slightly more than stoichiometric amount of hydrogen is not enough for bright annealing copper at 650° C. using non-cryogenically produced nitrogen.

Example 2-12

The copper annealing experiment described in Example 2-11 and reported in Table 2 was repeated under identical conditions except for the addition of 1.5% instead of 1.2% $H_2$ (hydrogen=1.5 times the stoichiometric amount required for the complete conversion of oxygen to moisture).

The annealed copper samples were bright without any signs of oxidation demonstrate that 1.5 times the stoichiometric amount of hydrogen can be used to bright anneal copper at 650° C. using non-cryogenically produced nitrogen and that the minimum amount of hydrogen required to bright anneal copper with non-cryogenically produced nitrogen at 650° C. is higher than the one required at 700° C.

Example 2-13

As detailed in Table 2 the copper annealing experiment described in Example 2-11 was repeated under the same condition except the addition of 5.0% instead of 1.2% $H_2$ to the feed gas (hydrogen=5.0 times the stoichiometric amount required for the complete conversion of oxygen to moisture).

The annealed copper samples were bright without any signs of oxidation showing that copper can be bright annealed at 650° C. using non-cryogenically produced nitrogen provided more than 1.2 times the stoichiometric amount of hydrogen is used.

Example 2-14

Another copper annealing experiment was completed using the procedure of Example 2-1 with the exception of operating the furnace at a nominal temperature of 600° C. The amount of oxygen in the feed gas was 0.5% and the amount of $H_2$ added was 1.2% (Hydrogen=1.2 times the stoichiometric amount of hydrogen required for the complete conversion of oxygen to moisture).

These samples were oxidized showing that the addition of 1.2 times the stoichiometric amount of hydrogen is not enough to bright anneal copper at 600° C. with non-cryogenically produced nitrogen.

Example 2-15

A further copper annealing experiment using the condition described in Example 2-14 was conducted except that 5.0% instead of 1.2% $H_2$ (hydrogen=5.0 times the stoichiometric amount) was added to the feed gas.

The annealed copper samples were oxidized showing that the addition of 5.0 times the stoichiometric amount of hydrogen was not enough to bright anneal copper at 600° C. with non-cryogenically produced nitrogen.

Example 2-16

The copper annealing experiment described in Example 2-14 was repeated again except for the addition of 10.0% instead of 1.2% $H_2$ (hydrogen=10.0 times the stoichiometric amount) to the feed gas.

The annealed copper samples were oxidized due to the presence of high levels of oxygen in the cooling zone showing that the addition of even 10.0 times the stoichiometric amount of hydrogen to non-cryogenically produced nitrogen is not acceptable for bright annealing copper at 600° C.

Example 2-17

The copper annealing experiment described in Example 2-14 was repeated with the exception of 0.25% $O_2$ present in feed nitrogen and 7.5% added hydrogen, as shown in Table 2. The amount of hydrogen used was 15.0 times the stoichiometric amount.

The annealed copper samples were bright without any signs of oxidation thus showing that copper samples can be bright annealed at 600° C. in the presence of non-cryogenically produced nitrogen provided more than 10.0 times the stoichiometric amount of hydrogen is used during annealing.

Example 2-18

The copper annealing experiment described in Example 2-17 was repeated with 10% added hydrogen (hydrogen=20.0 times the stoichiometric amount) resulting in samples that were bright annealed without any signs of oxidation. This example also showed that copper can be bright annealed at 600° C. with non-cryogenically produced nitrogen provided more than 10.0 times the stoichiometric amount of hydrogen is used during annealing.

Example 2-19

A copper annealing experiment was conducted using the procedure described in Example 2-1 with the exception of heating the furnace to a temeprature of 750° C. and using stoichiometric amount of hydrogen instead of more than stoichiometric, as shown in Table 2.

The annealed copper samples were oxidized even though most of the oxygen present in the feed was converted to moisture thus showing that the addition of stoichiometric amount of hydrogen is not sufficient enough to bright anneal copper with non-cryogenically produced nitrogen.

Example 2-20

The copper annealing experiment described in Example 2-19 was repeated with 1.5% $H_2$ (hydrogen=1.5 times the stoichiometric amount) producing samples that were bright annealed without any signs of oxidation. This example therefore showed that more than stoichiometric amount of hydrogen is required for bright annealing copper samples at 750° C. with non-cryogenically produced nitrogen.

Examples 2-21 to 2-24

The copper annealing experiment described in Example 2-19 was repeated four times using an addition of 1.5% $H_2$ and total flow rate of non-cryogenically produced nitrogen varying from 450 SCFH to 750 SCFH, as set out in Table 2. The amount of $O_2$ in the feed nitrogen was 0.5% and the amount of hydrogen added was 1.5 times the stoichiometric amount.

The annealed copper samples were bright without any signs of oxidation demonstrating that high flow rates of non-cryogenically produced nitrogen can be used to bright anneal copper provided more than a stoichiometric amount of $H_2$ is employed.

Example 2-25

The copper annealing experiment of Example 2-19 was repeated with 1.5% $H_2$ and 850 SCFH total flow rate of non-cryogenically produced nitrogen having 0.5% $O_2$. The amount of hydrogen added was 1.5 times the stoichiometric amount resulting in oxidized annealed copper samples due to incomplete conversion of oxygen to moisture in the cooling zone, as shown in Table 2. It is believed that the feed gas did not have enough time to heat-up and cause oxygen to react with hydrogen at high flow rate.

Example 2-26

The copper annealing experiment described in Example 2-1 was repeated at a furnace temperature of 750° C. using an identical diffuser design with the exception of diffuser having a length of four inches instead of six inches. The flow rate of nitrogen (99.5% $N_2$ and 0.5% $O_2$) was 350 SCFH and the amount of hydrogen added was 1.2%, as shown in Table 2 (hydrogen=1.2 times the stoichiometric amount).

The copper samples annealed according to this procedure were bright without any signs of oxidation indicating oxygen present in the feed gas was converted completely to moisture both in the heating and cooling zones of the furnace.

Therefore a small modified porous diffuser can be used to bright anneal copper with non-cryogenically produced nitrogen as long as more than a stoichiometric amount of hydrogen is used, i.e. the feed gas has enough time to heat up, and the direct impingement of feed gas with unreacted oxygen on the samples is avoided.

Example 2-27 and 2-28

The copper annealing experiment described in Example 2-26 was repeated using 5.0% and 10.0% hydrogen addition, respectively (amount of hydrogen=5.0 times and 10.0 times the stoichiometric amount).

The samples were bright annealed without any signs of oxidation, showing that a small porous diffuser can be used to bright anneal copper with non-cryogenically produced nitrogen as long as more than stoichiometric amount of hydrogen is used and the direct impingement of feed gas with unreacted oxygen on the samples is avoided.

Example 2-29

A copper annealing experiment under the condition described in Example 2-1 was conducted with the exception of using 750° C. furnace temperature and 2 in. long diffuser. The flow rate of nitrogen (99.5% $N_2$ and 0.5% $O_2$) was 350 SCFH and the amount of hydrogen added was 1.2%, as shown in Table 2 (hydrogen=1.2 times the stoichiometric amount).

Samples annealed according to this procedure were bright without any signs of oxidation indicating oxygen present in the feed gas was converted completely to moisture both in the cooling and heating zones.

Thus a small diffuser can be used to bright anneal copper with non-cryogenically produced nitrogen as long as more than stoichiometric amount of hydrogen is used and the direct Impingement of feed gas with unreacted oxygen on the samples is avoided.

Example 2-30

The copper annealed experiment described in Example 2-29 was repeated with 5.0% $H_2$ addition (hydrogen=5.0 times the stoichiometric amount) resulting samples that were bright annealed without any signs of oxidation.

Once again the results of tests show a small diffuser can be used to bright anneal copper with non-cryogenically produced nitrogen as long as more than stoichiometric amount of hydrogen Is used and the direct impingement of feed gas with unreacted oxygen on the samples is avoided.

Example 2-31

A copper annealing experiment under condition described in Example 4 was repeated except that a feed tube 30 similar to the one shown in FIG. 3A was located in the heating (hot) zone (Location 72 or A FIG. 4). Tube 30 was fabricated from ¾ in. diameter tubing with elbow having a discharge end 32 facing the ceiling 34 of the furnace 60. The feed gas therefore did not impinge directly on the samples and was heated by the furnace ceiling, causing oxygen to react with hydrogen prior to coming in contact with the samples. The concentration of oxygen in the feed nitrogen was 0.5% and the amount of hydrogen added was 1.5% (hydrogen=1.5 times the stoichiometric amount).

The copper samples annealed in this example were heavily oxidized due to the presence of high concentration of oxygen in the heating zone, as shown in Table 2. Careful analysis of the furnace revealed that this method of introducing feed gas allowed suction of large amounts of air from outside into the heating zone, resulting in severe oxidation of the samples.

Example 2-32

The copper annealing experiment described in Example 2-31 was repeated using feed tube 30 with the open end 32 of the elbow portion facing furnace ceiling 34 with the exception of locating the open end of the elbow in Location 74 instead of Location 72 of furnace 60 as shown in FIG. 4. Introducing feed gas in Location B apparently allowed no suction of air into the heating zone from the outside. The concentration of oxygen in the feed nitrogen was 0.5% and the amount of hydrogen added was 1.5% (hydrogen=1.5 times the stoichiometric amount).

The copper samples annealed according to this method were bright without any signs of oxidation showing that copper samples can be bright annealed using non-cryogenically produced nitrogen provided more than stoichiometric amount of hydrogen is used, the direct impingement of feed gas with unreacted oxygen on the samples is avoided, and the feed tube is properly shaped and located in the appropriate area of the heating zone of the furnace.

Example 2-33A

The copper annealing experiment described in Example 2-32 was repeated with the exception of using 5.0% (hydrogen=5.0 times the stoichiometric amount).

The copper samples annealed by this method were bright without any signs of oxidation confirming that an open tube with the outlet facing furnace ceiling can be used to bright anneal copper with non-cryogenically produced nitrogen provided that more than stoichiometric amount of hydrogen is used.

Example 2-33B

The copper annealing experiment described in Example 2-33A was repeated with the exception of using a 500 SCFH flow rate of nitrogen (amount of hydrogen=5.0 times the stoichiometric amount).

The copper samples annealed in this example were bright without any signs of oxidation further confirming that an open tube with the outlet facing furnace ceiling can be used to bright anneal copper with non-cryogenically produced nitrogen provided that more than a stoichiometric amount of hydrogen is used.

Example 2-33C

The copper annealing experiment described in Example 33A was repeated with the exception of using a 850 SCFH flow rate of nitrogen (amount of hydrogen=5.0 times the stoichiometric amount).

The copper samples annealed in this example were bright without any signs of oxidation showing that an open tube with the outlet facing furnace ceiling can be used to bright anneal copper with non-cryogenically produced nitrogen provided that more than a stoichiometric amount of hydrogen is used.

Figure 7:
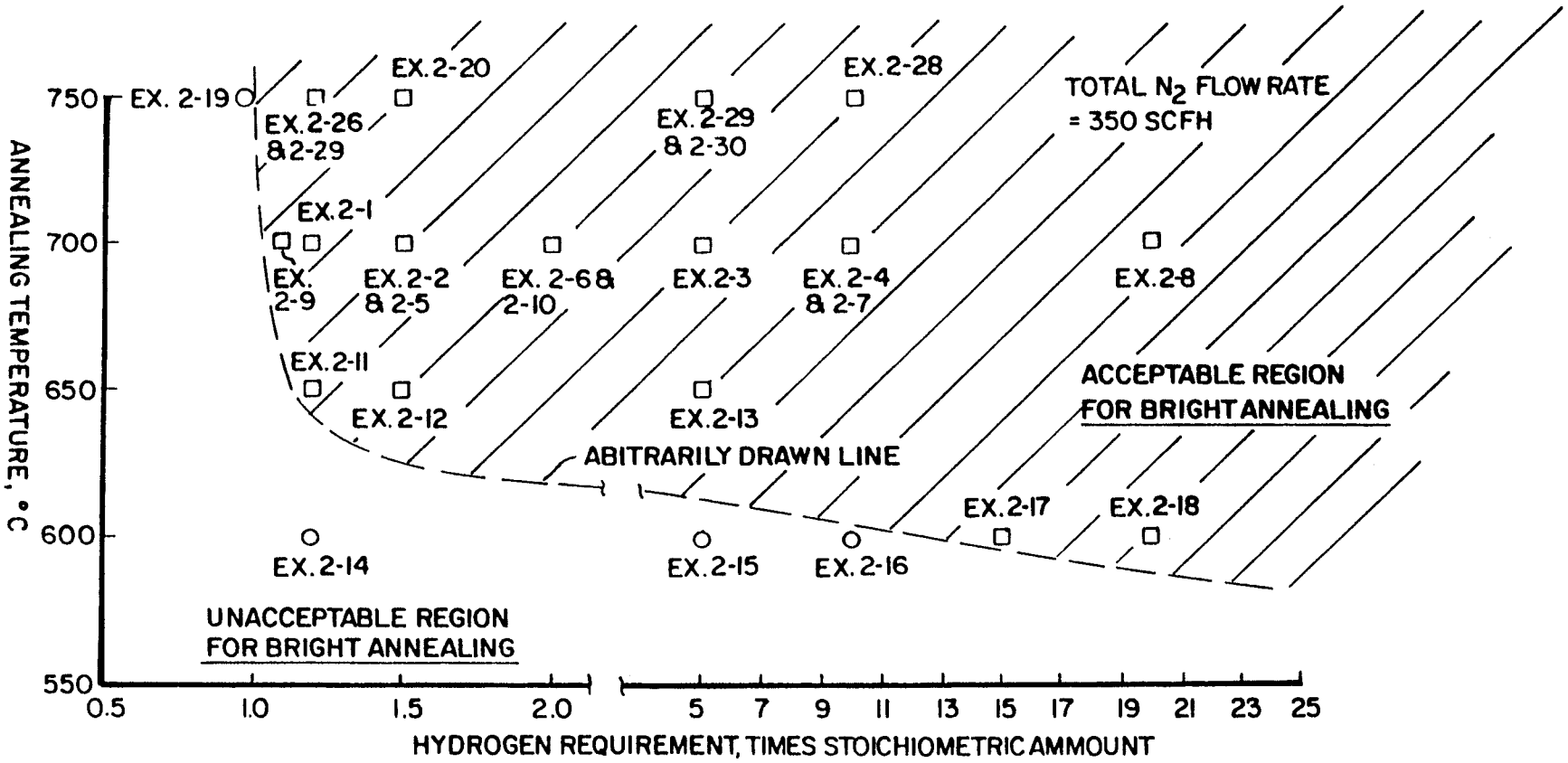
FIG. 7 is a plot of annealing temperature against hydrogen requirement for bright annealing copper according to the present invention.

From the above data as summarized in Table 2 the results clearly show that a modified porous diffuser, which helps in heating and dispersing feed gas as well as avoiding the direct impingement of feed gas with unreacted oxygen on the parts, can be used to bright anneal copper as long as more than stoichiometric amount of hydrogen is added to the gaseous feed mixture while annealing with non-cryogenically produced nitrogen. Additionally, the examples surprisingly showed that the amount of hydrogen required for bright annealing copper varies with the furnace temperature. The data of Table 2 with 350 SCFH total flow of non-cryogenically produced nitrogen was plotted and is shown in FIG. 7. From FIG. 7 the acceptable and unacceptable operating regions for bright annealing copper using non-cryogenically produced nitrogen can be ascertained. The acceptable region for bright annealing copper may change with the total flow rate of feed gas and the furnace design.

Experiments were carried out to demonstrate a process of bright annealing of copper alloys using non-cryogenically produced nitrogen pre-mixed with hydrogen at a constant furnace temperature of 700° C. The copper alloys annealed in these experiments were alloys of copper and nickel. They were classified as alloy #706 and #715 which contained 10% and 30% nickel, respectively.

Example 2-34

Samples of copper-nickel alloys #706 and #715 were annealed at 700° C. in the Watkins-Johnson furnace using 350 SCFH of non-cryogenically produced nitrogen containing 99.5% $N_2$ and 0.5% $O_2$. These samples were in the form of ¾ inch diameter and 7 inch long tubes. The nitrogen gas was pre-mixed with 1.2% hydrogen, which was slightly more than stoichiometric amount required for the complete conversion of oxygen to moisture.

The feed gas was introduced into the heating zone of the furnace (Location 74 in FIG. 4) using a 6 in. long modified porous diffuser such as shown as 40 in FIG. 3C and described in relation to Example 2-1 inserted into the furnace through the cooling zone.

The copper-nickel alloy samples annealed according to this procedure were bright without any signs of oxidation indicating that the oxygen present in the feed gas was converted completely to moisture both in the cooling and heating zones.

This example showed that preventing the direct impingement of feed gas with unreacted oxygen on the samples was instrumental in producing annealed copper-nickel alloy samples with good quality. It also showed that slightly more than stoichiometric amount of hydrogen is needed to anneal copper-nickel alloy samples at 700° C. with good bright finish when using non-cryogenically produced nitrogen.

Example 2-35

The annealing experiment described in Example 2-34 was repeated with the exception of adding 5.0% hydrogen, as shown in Table 2. The amount of hydrogen used was 5.0 times the stoichiometric amount required for the complete conversion of oxygen to moisture.

The annealed copper-nickel alloy samples were bright without any signs of oxidation indicating prevention of the direct impingement of feed gas with unreacted oxygen on the samples and the use of more than stoichiometric amount of hydrogen are essential for annealing copper-nickel alloys with good bright finish.

In addition to working with copper and copper-nickel alloys, several experiments were carried out to study controlled oxide and bright annealing of carbon steel using non-cryogenically produced nitrogen pre-mixed with hydrogen and temperatures varying from 650° C. to 1,100° C. The feed gas was introduced either in the transition or in heating zone through an open tube simulating conventional method of introducing gas into the furnace. A porous sintered metal diffuser, which is effective in reducing the feed gas velocity and dispersing it in the furnace, was also used for introducing gas into the heating zone of the furnace. Additionally, a porous sintered metal diffuser especially designed to prevent the direct impingement of feed gas on the parts was used for introducing feed gas into the heating zone of the furnace.

Tabulated in Table 3 are the results of a series of experiments relating to atmosphere annealing of carbon steel using methods according to its prior art and the present invention.

Samples of carbon steel annealed using non-cryogenically produced nitrogen pre-mixed with hydrogen were examined for decarburization. Examination of incoming material showed no decarburization while the carbon steel heated in a non-cryogenically produced nitrogen atmosphere pre-mixed with hydrogen produced surface decarburization that ranged from 0.003 to 0.010 inches in depth.

TABLE 3

| | Example 3-8 | Example 3-9 | Example 3-10 | Example 3-11 | Example 3-12A | Example 3-12B | Example 3-12C |
|---|---|---|---|---|---|---|---|
| Type of Samples | Carbon Steel | Carbon Steel | Carbon Steel | Carbon Steel | Carbon Steel | Carbon Steel | Carbon Steel |
| Heat Treating Temperature, °C. | 750 | 750 | 750 | 750 | 850 | 850 | 850 |
| Flow Rate of Feed Gas, SCFH | 350 | 350 | 350 | 350 | 350 | 350 | 350 |
| Feed Gas Location | Transition Zone | Transition Zone | Transition Zone | Transition Zone | Transition Zone | Transition Zone | Transition Zone |
| Type of Feed Device | Open Tube | Open Tube | Open Tube | Open Tube | Open Tube | Open Tube | Open Tube |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 |
| Hydrogen*, % | — | 1.2 | 5.0 | 10.0 | 1.2 | 3.0 | 5.0 |
| Heating Zone Atmosphere Composition | | | | | | | |
| Oxygen, ppm | 4,300 | <6 | <4 | <6 | <4 | <3 | <2 |
| Hydrogen*, % | — | ~0.25 | 4.0 | — | ~0.4 | ~2.0 | ~4.0 |
| Dew Point, °C. | −60.0 | +7.0 | +7.2 | +7.0 | +6.5 | +7.0 | +7.0 |
| Cooling Zone Atmosphere Composition | | | | | | | |
| Oxygen, ppm | 4,700 | 3,100 to 4,300 | 4,300 | 4,300 | 3,500 | 3,300 | 3,100 |
| Hydrogen, % | — | 0.9 | 4.6 | — | 1.0 | 2.7 | 4.0 |
| Dew Point, °C. | −60.0 | −7.5 to −18.6 | −12.2 | −10.8 | −8.4 | −7.7 | −5.4 |
| Quality of Heat Treated Samples | Heavily Oxidized and Scaled | Uniform Tightly Packed Oxide | Uniform Tightly Packed Oxide | Uniform Tightly Packed Oxide | Uniform Tightly Packed Oxide | Uniform Tightly Packed Oxide | Uniform Tightly Packed Oxide |

| | Example 3-12D | Example 3-13A | Example 3-13B | Example 3-13C | Example 3-13D | Example 3-14A | Example 3-14B | Example 3-14C | Example 3-14D |
|---|---|---|---|---|---|---|---|---|---|
| Type of Samples | Carbon Steel | Carbon Steel | Carbon Steel | Carbon Steel | Carbon Steel | Carbon Steel | Carbon Steel | Carbon Steel | Carbon Steel |
| Heat Treating Temperature, °C. | 850 | 950 | 950 | 950 | 950 | 1,100 | 1,100 | 1,100 | 1,100 |
| Flow Rate of Feed Gas, SCFH | 350 | 350 | 350 | 350 | 350 | 350 | 350 | 350 | 350 |
| Feed Gas Location | Transition Zone | Transition Zone | Transition Zone | Transition Zone | Transition Zone | Transition Zone | Transition Zone | Transition Zone | Transition Zone |
| Type of Feed Device | Open Tube | Open Tube | Open Tube | Open Tube | Open Tube | Open Tube | Open Tube | Open Tube | Open Tube |
| Feed Gas Composition | | | | | | | | | |
| Nitrogen, % | 99.5 | 99.5 | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 | 0.5 | 0.5 |
| Hydrogen*, % | 10.0 | 1.2 | 3.0 | 5.0 | 10.0 | 1.2 | 3.0 | 5.0 | 10.0 |
| Heating Zone Atmosphere Composition | | | | | | | | | |
| Oxygen, ppm | <3 | <2 | <4 | <4 | <5 | <2 | <2 | <2 | <4 |
| Hydrogen*, % | — | ~0.3 | 2.0 | ~4.1 | — | ~0.3 | 2.2 | 4.2 | — |
| Dew Point, °C. | +6.1 | +6.5 | +6.6 | +6.6 | +6.4 | +2.6 | +3.5 | +3.7 | +3.2 |
| Cooling Zone Atmosphere Composition | | | | | | | | | |
| Oxygen, ppm | 2,700 | 3,300 | 3,000 | 2,900 | 2,400 | 2,800 | 2,400 | 2,100 | 2,000 |
| Hydrogen, % | — | 0.9 | 2.6 | — | — | 0.8 | 2.5 | 4.5 | — |
| Dew Point, °C. | −4.0 | −6.8 | −6.2 | −6.1 | −3.8 | −4.9 | −3.3 | −1.1 | −1.5 |
| Quality of Heat Treated Samples | Uniform Tightly Packed Oxide | Uniform Tightly Packed Oxide | Uniform Tightly Packed Oxide | Non-Uniform Oxide | Non-Uniform Oxide | Non-Uniform Oxide | Non-Uniform Oxide | Non-Uniform Oxide | Non-Uniform Oxide |

| | Example 3-15 | Example 3-16 | Example 3-17 | Example 3-18 | Example 3-19 | Example 3-20 |
|---|---|---|---|---|---|---|
| Type of Samples | Carbon Steel | Carbon Steel | Carbon Steel | Carbon Steel | Carbon Steel | Carbon Steel |

TABLE 3-continued

| | | | | | | |
|---|---|---|---|---|---|---|
| Heat Treating Temperature, °C. | 750 | 750 | 750 | 1,100 | 1,100 | 1,100 |
| Flow Rate of Feed Gas, SCFH | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Open Tube Facing Down | Open Tube Facing Down | Open Tube Facing Down | Open Tube Facing Down | Open Tube Facing Down | Open Tube Facing Down |
| Feed Gas Composition | | | | | | |
| Nitrogen, % | 99.5 | 99.5 | 99.5 | 99.5 | 99.5 | 99.5 |
| Oxygen, % | 0.5 | 0.5 | 0.5 | 0.5 | 0.5 | 0.5 |
| Hydrogen*, % | 1.2 | 5.0 | 10.0 | 1.2 | 5.0 | 5.0 |
| Heating Zone Atmosphere Composition | | | | | | |
| Oxygen, ppm | <6 | <5 | <5 | <5 | <4 | <4 |
| Hydrogen*, % | ~0.2 | 4.0 | — | ~0.1 | ~4.0 | ~4.0 |
| Dew Point, °C. | +7.0 | +7.2 | +6.7 | — | — | — |
| Cooling Zone Atmosphere Composition | | | | | | |
| Oxygen, ppm | <6 | <6 | <3 | <3 | <2 | <2 |
| Hydrogen, % | ~0.2 | 4.1 | — | ~0.1 | 4.0 | 4.0 |
| Dew Point, °C. | +7.1 | +7.0 | +6.1 | — | — | — |
| Quality of Heat Treated Samples | Non-Uniform Oxide | Non-Uniform Oxide | Non-Uniform Oxide | Non-Uniform Oxide | Partly Bright and Partly Oxidized | Partly Bright and Partly Oxidized |

*Hydrogen gas was mixed with nitrogen and added as a percent of total non-cryogenically produced feed nitrogen.

Example 3-8

Samples of carbon steel described earlier were annealed at 750° C. in the Watkins-Johnson furnace using 350 SCFH of nitrogen containing 99.5% $N_2$ and 0.5% $O_2$. The feed gas was introduced into the furnace through a ¾ in. diameter tube located in the transition zone of the furnace as is conventionally practiced in the heat treating industry. The gaseous feed nitrogen similar in composition to that commonly produced by non-cryogenic air separation techniques was passed through the furnace for at least one hour to purge the furnace prior to heat treating the samples.

The steel samples were then annealed and found to be heavily oxidized and scaled due to the presence of high levels of oxygen both in the heating and cooling zones of the furnace indicating that non-cryogenically produced nitrogen containing residual oxygen cannot be used for annealing steel.

Example 3-9

The carbon steel annealing experiment described in Example 3-8 was repeated using the same furnace, temperature, samples, location of feed gas, nature of feed gas device, flow rate and composition of feed gas, and annealing procedure with the exception of adding 1.2% hydrogen to the feed gas with the amount of hydrogen added being 1.2 times stoichiometric amount required for converting residual oxygen present in the feed nitrogen completely to moisture.

Steel samples heat treated in accord with this procedure were found to have a uniform tightly packed oxide layer on the surface. Oxygen present in the feed gas was converted completely to moisture in the heating zone, as shown in Table 3 but not converted completely to moisture in the cooling zone, however the process is acceptable for oxidizing samples uniformly without formation of surface scale and rust.

Thus the introduction of non-cryogenically produced nitrogen pre-mixed with more than a stoichiometric amount of hydrogen into a heat treating furnace through an open tube located in the transition zone would result in an acceptable process for oxide annealing steel at 750° C.

Examples 3-10 and 3-11

The carbon steel heat treating process described in Example 3-9 was repeated using identical equipment and operating conditions with the exception of using 5% and 10% hydrogen addition respectively (amount of hydrogen=5.0 and 10.0 times the stoichiometric amount required for the complete conversion of oxygen present in the feed nitrogen to moisture).

Samples treated in accord with this method resulted in a tightly packed uniform oxide layer on the surface without the presence of any scale and rust. Oxygen present in the feed gas was converted completely to moisture in the heating zone, but not converted completely to moisture in the cooling zone, resulting in a process acceptable for oxide annealing steel at 750° C.

The treated sample showed that an open feed tube located in the transition zone cannot be used to produce bright annealed product with non-cryogenically produced nitrogen even in the presence of a large excess amount of hydrogen.

Example 3-12A

Carbon steel annealing in accord with the process used in Example 3-9 was repeated with the exception of using 850° C. furnace temperature, the amount of hydrogen used being 1.2 times the stoichiometric amount, as shown in Table 3.

Steel samples so treated had a tightly packed, uniform oxide layer on the surface without the presence of any scale and rust. As the data in Table 3 shows oxygen present in the feed gas was converted completely to moisture in the heating zone, but not converted completely to moisture in the cooling zone, again resulting in an acceptable process for oxide annealing steel at 850° C.

Examples 3-12B, 3-12C, 3-12D

Another set of carbon steel samples were subjected to heat treatment by the process used in Example 3-12A with the exception of using 3%, 5%, and 10% hydrogen, respectively (hydrogen=3.0, 5.0, and 10.0 times the stoichiometric amount required for the complete conversion of oxygen to moisture).

The heat treated steel samples were found to oxidize uniformly with a tightly packed oxide layer on the surface without the presence of any scale and rust. According to the data in Table 3 oxygen present in the feed gas was converted completely to moisture in the heating zone but was not converted completely to moisture in the cooling zone, again resulting in an acceptable process for oxide annealing steel at 850° C. using non-cryogenically produced nitrogen pre-mixed with excess amounts of hydrogen introduced into the furnace through an open tube located in the transition zone.

Example 3-13A

Another carbon steel annealing experiment was completed using similar procedure and operating conditions fo Example 3-9 except that the furnace temperature was 950° C. (hydrogen=1.2 times the stoichiometric amount).

These samples were oxidized uniformly with a tightly packed oxide layer on the surface without the presence of any scale and rust.

Again this example showed that the introduction of non-cryogenically produced nitrogen pre-mixed with more than stoichiometric amounts of hydrogen into the furnace through an open tube located in the transition zone is acceptable for oxide annealing steel at 950° C.

Example 3-13B

Carbon steel was annealed in accord with the process used in Example 3-13A with the exception of using 3% hydrogen (hydrogen=3.0 times the stoichiometric amount required for the complete conversion of oxygen to moisture).

The samples were oxidized uniformly and had a tightly packed oxide layer on the surface without the presence of any scale and rust. Here again the data shows oxygen present in the feed gas was converted completely to moisture in the heating zone but not in the cooling zone.

Therefore, it can be concluded the introduction of non-cryogenically produced nitrogen pre-mixed with more than stoichiometric amounts of hydrogen into a furnace through an open tube located in the transition zone is acceptable for oxide annealing steel at 950° C.

Examples 3-13C and 3-13D

More carbon steel samples were heat treated in accord with the process used in Example 3-13A except for using 5% and 10% hydrogen, respectively resulting in hydrogen being present at 5.0 and 10.0 times the stoichiometric amount required for the complete conversion of oxygen to moisture.

These samples were oxidized non-uniformly showing the addition of 5% and 10% hydrogen to non-cryogenically produced nitrogen would not result in an acceptable process for oxide as well as bright annealing steel at 950° C.

Example 3-14A

The carbon steel annealing experiment described in Example 3-9 was repeated using the same procedure and operating conditions with the exception of operating the furnace at 1,100° C. (hydrogen=1.2 times the stoichiometric amount).

These samples were oxidized non-uniformly again showing that the introduction of non-cryogenically produced nitrogen pre-mixed with more than stoichiometric amount of hydrogen into the furnace through an open tube located in the transition zone is not acceptable for oxide annealing steel at 1,100° C.

Examples 3-14B, 3-14C, and 3-14D

More carbon steel annealing experiments were conducted in accord with the process of Example 14A with 3%, 5%, and 10% hydrogen, respectively (hydrogen=3.0, 5.0 and 10.0 times the stoichiometric amount required for the complete conversion of oxygen to moisture).

The samples thus treated showed that carbon steel cannot be oxide annealed at 1,100° C. by introducing non-cryogenically produced nitrogen pre-mixed with hydrogen into the transition zone of the furnace.

The data presented in Table 3 and discussed above resulted from annealing steel samples using non-cryogenically produced nitrogen injected into the furnace through a straight open tube located in the transition zone. This conventional way of introducing gases into the furnace for heat treating showed that non-cryogenically produced nitrogen containing residual oxygen cannot be used for bright or controlled oxide annealing steel because as the data shows severe scaling and rusting of the product resulted. Non-cryogenically produced nitrogen can be used to oxide anneal carbon steel at temperatures ranging from 750° C. to 950° C. provided it is mixed with more than a stoichiometric amount of hydrogen required for the complete conversion of oxygen to water vapor or moisture. Because of the high temperature in the heating zone, the hydrogen added to the feed gas reacts with the residual oxygen and converts it completely to moisture helping to prevent oxidation of parts by elementary free oxygen in the heating zone. The temperature in the cooling zone is not high enough to convert all the residual oxygen to moisture producing an atmosphere consisting of a mixture of free-oxygen, nitrogen, moisture, and hydrogen. Presence of moisture and hydrogen in the cooling zone along with rapid cooling of the parts is believed to be responsible for facilitating controlled surface oxidation. It is conceivable that unusual furnace operating conditions (e.g. belt speed, furnace loading, temperature in excess of 1,100° C.) could result in uncontrolled oxidation of the parts.

Examples 3-9 through 3-13B demonstrate that carbon steel can be oxide annealed using a mixture of non-cryogenically produced nitrogen and hydrogen using a conventional feed gas introduction device in the furnace transition zone, and that non-cyrogenically produced nitrogen cannot be used for bright, oxide-free annealing of carbon steel even with the addition of excess amounts of hydrogen.

Example 3-15

Carbon steel was treated by the process of Example 3-9 with the exception of feeding the gaseous mixture through a ½ in. diameter stainless steel tube fitted with a ¾ in. diameter elbow with the opening facing down, i.e., facing the samples and the open feed tube inserted into the furnace through the cooling zone to introduce feed gas into the heating zone of the furnace 60 at location 72 in FIG. 4. The feed gas entering the heating zone of the furnace impinged directly on the samples simulating the introduction of feed gas through an open tube into the heating zone of the furnace. The amount of hydrogen used was 1.2% of the feed gas. It was therefore 1.2 times the stoichiometric amount required for the complete conversion of oxygen to moisture. This experiment resulted in samples having a non-uniformly oxidized surface.

Oxygen present in the feed gas was converted completely to moisture both in the heating and cooling zones of the furnace, as shown by the data in Table 3 which should have resulted in controlled and uniformly oxidized samples. A detailed analysis of the fluid flow and temperature profiles in the furnace indicated that the feed gas was introduced at high velocity and was not heated to a temperature high enough to cause oxygen and hydrogen to react completely in the vicinity of the open feed tube, resulting in the direct impingement of cold nitrogen with unreacted oxygen on the samples and concommittantly in uncontrolled oxidation.

Thus a conventional open feed tube cannot be used to introduce non-cryogenically produced nitrogen pre-mixed with hydrogen into the heating zone of a furnace to produce controlled oxidized steel samples.

Examples 3-16 and 3-17

Heat treatment experiments in accord with the process of Example 3-15 were performed using 5% and 10% hydrogen, respectively, instead of 1.2%. As shown in Table 3, the amount of hydrogen therefore was 5.0 and 10.0 times the stoichiometric amount needed for the complete conversion of oxygen to moisture.

The treated samples were non-uniformly oxidized showing that a conventional open feed tube cannot be used to feed non-cryogenically produced nitrogen pre-mixed with excess amounts of hydrogen in the heating zone of the furnace and produce controlled oxidation and/or bright annealed steel samples.

Example 3-18

Additional heat treating experiments were performed using the process and operating conditions of Example 3-15 except for increasing the furnace temperature to 1,100° C. The amount of hydrogen used was 1.2 times the stoichiometric amount, as shown in Table 3 with the resulting samples being non-uniformly oxidized.

Once again it was demonstrated that a conventional open feed tube cannot be used to feed non-cryogenically produced nitrogen pre-mixed with more than stoichiometric amount of hydrogen in the heating zone of the furnace and produce controlled oxidized samples even at 1,100° C. temperature.

Examples 3-19 and 3-20

The heat treating process used in Example 3-18 was repeated twice with the exception of adding 5% hydrogen to the nitrogen, the amount of hydrogen was 5.0 times the stoichiometric amount required for the complete conversion of oxygen to moisture.

The treated samples in these examples were non-uniformly oxidized showing that a conventional open feed tube cannot be used to feed non-cryogenically produced nitrogen pre-mixed with excess amounts of hydrogen in the heating zone of the furnace and produce controlled oxidized and/or bright annealed steel samples.

Analysis of the data of Table 3 relating to the above examples showed that a straight open tube located in the heating zone of the furnace cannot be used to introduce non-cryogenically produced nitrogen pre-mixed with hydrogen into the furnace and produce controlled oxidized and/or bright, oxide-free annealed carbon steel samples at temperatures ranging from 750° C. to 1,100° C. Although oxygen present in the feed gas was converted to moisture in the heating and cooling zones of the furnace, it was not converted completely to moisture in the vicinity of the feed area. This is because of the fact that the feed gas enters the furnace at high velocity and therefore does not get time to heat up and cause residual oxygen and hydrogen present in it to react. This results in the impingement of feed gas with unreacted oxygen on the samples and consequently their uncontrolled oxidation.

Since most of the manufacturers generally switch back and forth between oxide annealing and bright (oxide-free) annealing, it is desirable to develop processes for oxide annealing and bright, oxide-free annealing carbon steel utilizing the same furnace without making major process changes. Such a technique or process was developed by introducing a gaseous feed mixture in the heating zone of the furnace as will be shown by the results of samples processed and reported in Table 4 below.

TABLE 4

| | Example 4-38 | Example 4-39 | Example 4-40 | Example 4-41 | Example 4-42 | Example 4-43 | Example 4-44 |
|---|---|---|---|---|---|---|---|
| Type of Samples | Carbon Steel | Carbon Steel | Carbon Steel | Carbon Steel | Carbon Steel | Carbon Steel | Carbon Steel |
| Heat Treating Temperature, °C. | 1,100 | 1,100 | 1,100 | 950 | 950 | 950 | 950 |
| Flow Rate of Feed Gas, SCFH | 350 | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Porous Diffuser FIG. 3E | Porous Diffuser FIG. 3E | Porous Diffuser FIG. 3E | Porous Diffuser FIG. 3E | Porous Diffuser FIG. 3E | Porous Diffuser FIG. 3E | Porous Diffuser FIG. 3E |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 |
| Hydrogen*, % | 1.2 | 3.0 | 5.0 | 1.2 | 1.2 | 3.0 | 5.0 |
| Heating Zone Atmosphere Composition | | | | | | | |
| Oxygen, ppm | <3 | <3 | <3 | <4 | <2 | <3 | <2 |
| Hydrogen*, % | 0.2 | ~2.2 | 4.0 | ~0.3 | ~0.2 | ~2.1 | ~4.1 |
| Dew Point, °C. | — | — | — | — | +7.0 | +7.0 | +6.6 |
| Cooling Zone Atmosphere Composition | | | | | | | |
| Oxygen, ppm | <4 | <3 | <3 | 42-62 | <3 | <3 | <3 |
| Hydrogen, % | 0.2 | ~2.1 | 4.0 | 0.2 | 0.2 | ~2.1 | ~4.1 |
| Dew Point, °C. | — | — | — | — | +7.0 | +6.9 | +6.6 |
| Quality of Heat Treated Samples | Uniform Tightly Packed Oxide | Uniform Shiny Bright | Uniform Shiny Bright | Uniform Tightly Packed Oxide | Uniform Tightly Packed Oxide | Non-Uniform Bright | Uniform Bright |

| | Example 4-45 | Example 4-46 | Example 4-47A | Example 4-47B | Example 4-48 | Example 4-49 | Example 4-50A |
|---|---|---|---|---|---|---|---|
| Type of Samples | Carbon Steel | Carbon Steel | Carbon Steel | Carbon Steel | Carbon Steel | Carbon Steel | Carbon Steel |
| Heat Treating Temperature, °C. | 850 | 850 | 850 | 850 | 750 | 750 | 750 |
| Flow Rate of Feed Gas, SCFH | 350 | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Porous Diffuser FIG. 3E | Porous Diffuser FIG. 3E | Porous Diffuser FIG. 3E | Porous Diffuser FIG. 3E | Porous Diffuser FIG. 3E | Porous Diffuser FIG. 3E | Porous Diffuser FIG. 3E |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 |
| Hydrogen*, % | 1.2 | 3.0 | 5.0 | 10.0 | 1.2 | 3.0 | 5.0 |
| Heating Zone Atmosphere Composition | | | | | | | |
| Oxygen, ppm | <3 | <3 | <2 | <3 | <3 | <4 | <2 |
| Hydrogen*, % | 0.2 | 1.8 | 4.1 | — | ~0.3 | 2.0 | 4.1 |
| Dew Point, °C. | +7.0 | +7.5 | +7.0 | +6.1 | +6.8 | +7.1 | +7.0 |
| Cooling Zone Atmosphere Composition | | | | | | | |
| Oxygen, ppm | 5-35 | <3 | <2 | <3 | 150 | 35-40 | 53 |

TABLE 4-continued

| | | | | | | | |
|---|---|---|---|---|---|---|---|
| Hydrogen, % | 0.1 | 1.8 | ~4.1 | — | 0.4 | ~2.1 | 4.1 |
| Dew Point, °C. | +6.9 | +7.0 | +7.0 | +6.1 | 6.0 | +6.9 | +6.3 |
| Quality of Heat Treated Samples | Uniform Tightly Packed Oxide | Uniform Tightly Packed Oxide | Non-Uniform Bright | Non-Uniform Bright | Uniform Tightly Packed Oxide | Non-Uniform Oxide | Non-Uniform Oxide |
| | Example 4-50B | Example 4-51 | Example 4-52 | Example 4-53 | Example 4-54 | Example 4-55 | Example 4-56 |
| Type of Samples | Carbon Steel | Carbon Steel | Carbon Steel | Carbon Steel | Carbon Steel | Carbon Steel | Carbon Steel |
| Heat Treating Temperature, °C. | 750 | 1,100 | 1,100 | 1,100 | 950 | 950 | 950 |
| Flow Rate of Feed Gas, SCFH | 350 | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Porous Diffuser FIG. 3E | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 |
| Hydrogen*, % | 10.0 | 1.2 | 3.0 | 5.0 | 1.2 | 3.0 | 5.0 |
| Heating Zone Atmosphere Composition | | | | | | | |
| Oxygen, ppm | <2 | <3 | <3 | <2 | <3 | <1 | <1 |
| Hydrogen*, % | — | ~0.3 | 2.0 | 4.0 | 0.2 | ~2.1 | ~4.1 |
| Dew Point, °C. | +6.2 | +2.8 | +4.3 | +5.1 | +8.6 | +8.8 | +6.8 |
| Cooling Zone Atmosphere Composition | | | | | | | |
| Oxygen, ppm | 45 | <4 | <2 | <3 | <3 | <3 | <1 |
| Hydrogen, % | — | 0.2 | 2.0 | 4.0 | 0.2 | 2.0 | ~4.1 |
| Dew Point, °C. | 6.2 | +2.5 | +6.3 | +6.4 | +9.1 | +8.6 | +7.1 |
| Quality of Heat Treated Samples | Non-Uniform Oxide | Uniform Tightly Packed Oxide | Uniform Shiny Bright | Uniform Shiny Bright | Uniform Tightly Packed Oxide | Uniform Shiny Bright | Uniform Shiny Bright |
| | Example 4-57 | Example 4-58 | Example 4-59 | Example 4-60 | Example 4-61 | Example 4-62 | Example 4-63 |
| Type of Samples | Carbon Steel | Carbon Steel | Carbon Steel | Carbon Steel | Carbon Steel | Carbon Steel | Carbon Steel |
| Heat Treating Temperature, °C. | 850 | 850 | 850 | 750 | 750 | 750 | 750 |
| Flow Rate of Feed Gas, SCFH | 350 | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Modified Porous Diffuser | Modified Porous Diffuser | Modified Porous Diffuser | Modified Porous Diffuser | Modified Porous Diffuser | Modified Porous Diffuser | Modified Porous Diffuser |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 1.0 | 0.5 | 0.5 | 0.5 | 0.5 |
| Hydrogen*, % | 1.2 | 3.0 | 6.0 | 1.0 | 1.2 | 5.0 | 10.0 |
| Heating Zone Atmosphere Composition | | | | | | | |
| Oxygen, ppm | <2 | <2 | <3 | <6 | <3 | <2 | <2 |
| Hydrogen*, % | 0.2 | 2.0 | 4.0 | 0 | 0.2 | 4.0 | — |
| Dew Point, °C. | +4.4 | +5.6 | +10.6 | +3.9 | +4.4 | +5.0 | +5.0 |
| Cooling Zone Atmosphere Composition | | | | | | | |
| Oxygen, ppm | <3 | <2 | <3 | <5 | <3 | <2 | <2 |
| Hydrogen, % | 0.2 | 2.0 | 4.0 | 0 | 0.2 | ~4.0 | — |
| Dew Point, °C. | +3.9 | +4.4 | +10.6 | +3.3 | +2.8 | +3.9 | 5.0 |
| Quality of Heat Treated Samples | Uniform Tightly Packed Oxide | Uniform Shiny Bright | Uniform Shiny Bright | Heavily Oxidized and Scaled | Uniform Tightly Packed Oxide | Uniform Shiny Bright | Uniform Shiny Bright |
| | Example 4-64 | Example 4-65 | Example 4-66 | Example 4-67 | Example 4-68 | Example 4-69 | Example 4-70 |
| Type of Samples | Carbon Steel | Carbon Steel | Carbon Steel | Carbon Steel | Carbon Steel | Carbon Steel | Carbon Steel |
| Heat Treating Temperature, °C. | 750 | 750 | 750 | 750 | 750 | 750 | 750 |
| Flow Rate of Feed Gas, SCFH | 350 | 350 | 350 | 350 | 350 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | | | | |
| Nitrogen, % | 99.75 | 99.75 | 99.75 | 99.75 | 99.75 | 99.0 | 99.0 |
| Oxygen, % | 0.25 | 0.25 | 0.25 | 0.25 | 0.25 | 1.0 | 1.0 |

TABLE 4-continued

| | | | | | | | |
|---|---|---|---|---|---|---|---|
| Hydrogen*, % | 0.6 | 1.00 | 2.75 | 3.25 | 5.00 | 2.20 | 2.50 |
| Heating Zone Atmosphere Composition | | | | | | | |
| Oxygen, ppm | <5 | <5 | <4 | <3 | <2 | <2 | <2 |
| Hydrogen*, % | 0.1 | 0.5 | ~2.3 | ~2.7 | 4.5 | ~0.1 | ~0.6 |
| Dew Point, °C. | −7.2 | −7.2 | −6.7 | −5.0 | −5.0 | +11.7 | +9.4 |
| Cooling Zone Atmosphere Composition | | | | | | | |
| Oxygen, ppm | <4 | <6 | <4 | <3 | <2 | <2 | <3 |
| Hydrogen, % | 0.1 | 0.5 | ~2.2 | ~2.7 | 4.5 | ~0.1 | 0.5 |
| Dew Point, °C. | −6.7 | −7.2 | −5.0 | −7.2 | −6.7 | +11.2 | +9.4 |
| Quality of Heat Treated Samples | Uniform Tightly Packed Oxide | Mixture of Bright and Oxide | Uniform Shiny Bright | Uniform Shiny Bright | Uniform Shiny Bright | Uniform Tightly Packed | Uniform Tightly Packed Oxide |

| | Example 4-71 | Example 4-72 | Example 4-73 | Example 4-74 | Example 4-75 | Example 4-76 | Example 4-77 |
|---|---|---|---|---|---|---|---|
| Type of Samples | Carbon Steel | Carbon Steel | Carbon Steel | Carbon Steel | Carbon Steel | Carbon Steel | Carbon Steel |
| Heat Treating Temperature, °C. | 750 | 750 | 750 | 750 | 750 | 750 | 750 |
| Flow Rate of Feed Gas, SCFH | 350 | 450 | 550 | 650 | 850 | 350 | 350 |
| Feed Gas Location | Heating Zone (Location 72) | Heating Zone (Location 72) | Heating Zone (Location 72) | Heating Zone (Location 72) | Heating Zone (Location 72) | Heating Zone (Location 72) | Heating Zone (Location 72) |
| Type of Feed Device | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | | | | |
| Nitrogen, % | 99.0 | 99.5 | 99.5 | 99.5 | 99.5 | 99.5 | 99.5 |
| Oxygen, % | 1.0 | 0.5 | 0.5 | 0.5 | 0.5 | 0.5 | 0.5 |
| Hydrogen*, % | 4.00 | 1.5 | 1.5 | 1.5 | 1.5 | 1.5 | 1.20 |
| Heating Zone Atmosphere Composition | | | | | | | |
| Oxygen, ppm | <2 | <5 | <9 | ~35 | ~60 | <4 | <4 |
| Hydrogen*, % | ~2.1 | 0.5 | 0.5 | 0.5 | 0.5 | 0.5 | 0.2 |
| Dew Point, °C. | +11.7 | — | +3.9 | +3.9 | +3.3 | +6.6 | +5.9 |
| Cooling Zone Atmosphere Composition | | | | | | | |
| Oxygen, ppm | <3 | <2 | <9 | ~70 | ~330 | <4 | <4 |
| Hydrogen, % | ~2.1 | 0.5 | 0.5 | ~0.6 | ~0.6 | 0.5 | 0.2 |
| Dew Point, °C. | +11.1 | — | +3.3 | +2.8 | +1.7 | +5.9 | +5.6 |
| Quality of Heat Treated Samples | Mixture of Bright and Oxide | Uniform Tightly Packed Oxide | Uniform Tightly Packed Oxide | Non-Uniform Oxide | Severely Oxidized and Scaled | Uniform Tightly Packed Oxide | Uniform Tightly Packed Oxide |

| | Example 4-78 | Example 4-79 | Example 4-80 | Example 4-81 | Example 4-82 | Example 83 | Example 4-84 |
|---|---|---|---|---|---|---|---|
| Type of Samples | Carbon Steel | Carbon Steel | Carbon Steel | Carbon Steel | Carbon Steel | Carbon Steel | Carbon Steel |
| Heat Treating Temperature, °C. | 750 | 750 | 750 | 700 | 700 | 700 | 700 |
| Flow Rate of Feed Gas, SCFH | 350 | 350 | 350 | 350 | 350 | 350 | 350 |
| Feed Gas Location | Heating Zone (Location 74) | Heating Zone (Location 74) | Heating Zone (Location 74) | Heating Zone (Location 72) | Heating Zone (Location 72) | Heating Zone (Location 72) | Heating Zone (Location 72) |
| Type of Feed Device | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | | | | |
| Nitrogen, % | 99.5 | 99.5 | 99.5 | 99.5 | 99.5 | 99.5 | 99.5 |
| Oxygen, % | 0.5 | 0.5 | 0.5 | 0.5 | 0.5 | 0.5 | 0.5 |
| Hydrogen*, % | 1.5 | 3.00 | 5.0 | 1.2 | 1.5 | 5.0 | 10.0 |
| Heating Zone Atmosphere Composition | | | | | | | |
| Oxygen, ppm | <3 | <3 | <3 | <2 | <5 | <4 | <4 |
| Hydrogen*, % | 0.5 | 2.0 | 4.0 | 0.2 | 0.5 | 4.0 | — |
| Dew Point, °C. | +6.2 | +6.2 | +6.0 | +3.3 | +3.9 | +3.3 | +3.3 |
| Cooling Zone Atmosphere Composition | | | | | | | |
| Oxygen, ppm | <3 | <4 | <2 | <4 | <5 | <4 | <4 |
| Hydrogen, % | 0.5 | 2.0 | 4.0 | 0.2 | 0.5 | 4.0 | — |
| Dew Point, °C. | +6.3 | +6.1 | +5.5 | +2.8 | +3.9 | +3.3 | +3.9 |
| Quality of Heat Treated Samples | Uniform Tightly Packed Oxide | Uniform Shiny Bright | Uniform Shiny Bright | Uniform Tightly Packed Oxide | Uniform Tightly Packed Oxide | Mixture of Oxide & Bright | Mixture of Oxide & Bright |

| | Example 4-85 | Example 4-86 | Example 4-87 | Example 4-88 | Example 4-89 | Example 4-90 |
|---|---|---|---|---|---|---|
| Type of Samples | Carbon Steel | Carbon Steel | Carbon Steel | Carbon Steel | Carbon Steel | Carbon Steel |
| Heat Treating Temperature, °C. | 700 | 650 | 650 | 750 | 750 | 750 |
| Flow Rate of Feed Gas, | 350 | 350 | 350 | 350 | 350 | 350 |

TABLE 4-continued

| SCFH | | | | | | |
|---|---|---|---|---|---|---|
| Feed Gas Location | Heating Zone (Location 72) | Heating Zone (Location 72) | Heating Zone (Location 72) | Heating Zone (Location 72) | Heating Zone (Location 74) | Heating Zone (Location 74) |
| Type of Feed Device | Modified Porous Diffuser FIG. 3C | Modified Porous Diffuser FIG. 3C | Modified Porous Diffuser FIG. 3C | Open Tube Facing Furnace Ceiling | Open Tube Facing Furnace Ceiling | Open Tube Facing Furnace |
| Feed Gas Composition | | | | | | |
| Nitrogen, % | 99.75 | 99.5 | 99.5 | 99.5 | 99.5 | 99.5 |
| Oxygen, % | 0.25 | 0.5 | 0.5 | 0.5 | 0.5 | 0.5 |
| Hydrogen*, % | 10.0 | 1.2 | 5.0 | 1.5 | 1.5 | 5.0 |
| Heating Zone Atmosphere Composition | | | | | | |
| Oxygen, ppm | <4 | ~620 | ~62 | ~5800 | <6 | <4 |
| Hydrogen*, % | — | ~0.25 | ~4.0 | ~0.1 | 0.45 | 4.0 |
| Dew Point, °C. | −7.2 | +5.0 | +3.9 | +11.9 | +8.1 | +7.9 |
| Cooling Zone Atmosphere Composition | | | | | | |
| Oxygen, ppm | <4 | ~190 | ~80 | <3 | <5 | <3 |
| Hydrogen, % | — | ~0.4 | ~4.0 | 0.5 | ~0.5 | 4.0 |
| Dew Point, °C. | −7.8 | +5.0 | +3.9 | +7.2 | +7.9 | +7.9 |
| Quality of Heat Treated Samples | Uniform Bright | Oxidized and Scaled | Mixture of Bright and Oxide | Oxidized and Scaled | Uniform Tightly Packed Oxide | Uniform Shiny Bright |

*Hydrogen gas was mixed with nitrogen and added as a percent of total non-cryogenically produced feed nitrogen.

The analysis of Examples 4–38 through 4–90 detail a series of experiments where the process of the present invention was used to perform annealing of carbon steels.

Example 4–38

The carbon steel heat treating process described in Example 3–18 was repeated with the exception of feeding the gaseous mixture through a ½ in. diameter, 6 in. long sintered Inconel porous diffuser of the type shown in FIG. 3E located in the heating zone (Location 72 in FIG. 4). The amount of hydrogen added to the feed gas containing 0.5% oxygen was 1.2%, i.e. 1.2 times the stoichiometric amount required for the complete conversion of oxygen to moisture.

The treated samples were uniformly oxidized and had a tightly packed oxide layer on the surface. The oxygen present in the feed gas was apparently converted completely to moisture in the heating and cooling zones. Not only did the diffuser help in heating and dispersing feed gas in the furnace, it was instrumental in reducing the feed gas velocity thus converting all the residual oxygen to moisture before impinging on the samples. The theoretical ratio of moisture to hydrogen in the furnace was high enough (5.0) to oxidize samples as reported in the literature.

This example showed that a porous sintered metal diffuser can be be used to feed non-cryogenically produced nitrogen pre-mixed with slightly more than stoichiometric amount of hydrogen in the heating zone of the furnace operated at 1,100° C. and produce annealed samples with a controlled oxide layer.

Example 4–39

The heat treating process described in Example 4–38 was repeated with the exception of using 3% hydrogen, e.g. 3.0 times the stoichiometric amount required for the complete conversion of oxygen to moisture.

The steel samples heat treated by this process were shiny bright because it is believed that all the oxygen present in the feed gas was converted completely to moisture in the heating and cooling zones of the furnace, as shown in Table 4 showing that a porous sintered metal diffuser can be used to feed non-cryogenically produced nitrogen pre-mixed with three times the stoichiometric amount of hydrogen in the heating zone of the furnace operated at 1,100° C. and produce bright annealed steel samples. The theoretical ratio of moisture to hydrogen in the furnace was 0.5, which per literature is believed to result in bright product.

The steel sample annealed in example 4–39 was examined for decarburization. Examination of incoming material showed no decarburization while the steel sample heated in the non-cryogenically produced nitrogen atmosphere pre-mixed with hydrogen produced decarburization of approximately 0.007 inches.

Example 4–40

The heat treating process described in Example 4–38 was repeated using similar procedure and operating conditions with the exception of using 5% hydrogen, e.g. 5.0 times the stoichiometric amount required for the complete conversion of oxygen to moisture.

Steel samples heat treated by this process were shiny bright, again because it is believed oxygen present in the feed gas was converted completely to moisture in the heating and cooling zones of the furnace, as shown in Table 4.

Again it was demonstrated that a porous sintered metal diffuser can be used to feed non-cryogenically produced nitrogen pre-mixed with 5.0 times the stoichiometric amount of hydrogen in the heating zone of the furnace operated at 1,100° C. and produce bright annealed steel samples.

The steel sample annealed in Example 4–40 was examined for decarburization. Examination of incoming material showed no decarburization while the steel sample heated in the non-cryogenically produced nitrogen atmosphere pre-mixed with hydrogen produced decarburization of approximately 0.008 inches.

Examples 4–41 and 4–42

The heat treating process described in Example 4–38 was repeated twice on steel samples using identical set-up, procedure, flow rate of feed gas, operating conditions, and gas feeding device with the exception of operating the furnace with a heating zone temperature of 950° C. The amount of hydrogen used was 1.2 times the stoichiometric amount required for the complete conversion of oxygen to moisture.

The annealed steel samples were oxidized uniformly and had a tightly packed oxide layer on the surface. It is believed the porous diffuser helped in dispersing feed gas in the furnace and converting oxygen to moisture and reducing the feed gas velocity, thus converting residual oxygen to moisture.

Again using a porous sintered metal diffuser to feed non-cryogenically produced nitrogen pre-mixed with slightly more than stoichiometric amount of hydrogen in the heating zone of the furnace operated at 950° C. can produce controlled oxide annealed steel samples.

Example 4–43

Carbon steel samples were heat treatment using the process of Example 4–41 with the addition of 3.0% hydrogen. The amount of hydrogen used was 3.0 times the stoichiometric amount required for the complete conversion of oxygen to moisture with all other operating conditions (e.g. set-up, gas feeding device, etc.) identical to those of Example 4–41.

The annealed steel samples were non-uniformly bright. Parts of the samples were bright and the remaining parts were oxidized showing that the addition of 3.0 times the stoichiometric amount of hydrogen is not good enough to bright anneal steel at 950° C.

The $pH_2/pH_2O$ for this test, after reacting residual oxygen in the non-cryogenically produced nitrogen was approximately 2.0. At this $pH_2/pH_2O$ the furnace protective atmosphere is reducing in the furnace heating zone at 950° C., however, in the furnace cooling zone a $pH_2/pH_2O$ value of 2 is oxidizing. The direction at which this reaction will go will be dependent on the cooling rate of steel in the furnace cooling zone. Slower cooling rates will likely cause oxidation while fast cooling rates will likely result in a non-oxidized surface.

Example 4–44

The carbon steel heat treating process of Example 4–41 was repeated with the addition of 5.0% hydrogen (hydrogen=5.0 times the stoichiometric amount required for the complete conversion of oxygen to moisture).

The annealed steel samples were bright without any signs of oxidation indicating that all the residual oxygen present in the feed gas was reacted with excess hydrogen before impinging on the parts. This example showed that non-cryogenically produced nitrogen can be used for bright annealing steel at 950° C. provided more than 3.0 times the stoichiometric amount of $H_2$ is added and that the gaseous mixture is introduced into the heating zone using a porous diffuser.

The steel sample annealed in Example 4–44 was examined for decarburization. Examination of incoming material showed no decarburization while the steel sample heated in the non-cryogenically produced nitrogen atmosphere pre-mixed with hydrogen produced decarburization of approximately 0.004 inches.

Example 4–4

The carbon steel heat treating process of Example 4–38 was repeated using a hot zone furnace temperature of 850° C. instead of 1,100° C., hydrogen being present in an amount 1.2 times the stoichiometric amount required for the complete conversion of oxygen to moisture.

The annealed steel samples were uniformly oxidized and had a tightly packed layer of oxide on the surface indicating oxygen present in the feed gas was converted completely to moisture both in the heating and cooling zones of the furnace, as shown in Table 4, with the diffuser helping in dispersing feed gas in the furnace and converting oxygen to moisture.

This example showed that a porous sintered metal diffuser can be used to feed non-cryogenically produced nitrogen pre-mixed with slightly more than stoichiometric amount of hydrogen in the heating zone of the furnace operated at 850° C. to produce controlled oxide annealed steel samples.

Example 4–46

The carbon steel heat process of Example 4–45 was repeated with the addition of 3.0% hydrogen, e.g., 3.0 times the stoichiometric amount of hydrogen required for the complete conversion of oxygen to moisture.

The annealed steel samples were oxidized uniformly, showing that non-cryogenically produced nitrogen can be used for oxide annealing steel at 850° C. provided 3.0 times the stoichiometric amount of $H_2$ is added and that the gaseous mixture is introduced into the heating zone using a porous diffuser.

Examples 4–47A and 4–47B

The carbon steel heat treating process described in Example 4–45 was repeated with the addition of 5% and 10% hydrogen, respectively. The amount of hydrogen used was 5.0 times and 10.0 times the stoichiometric amount required for the complete conversion of oxygen to moisture.

The annealed steel samples were non-uniformly bright is showing that non-cryogenically produced nitrogen pre-mixed with excess amounts of hydrogen cannot be used to bright anneal steel at 850° C.

Example 4–48

The heat treating process described in Example 4–38 was repeated using carbon steel at a furnace hot zone temperature of 750° C. The amount of hydrogen used was 1.2 times the stoichiometric amount required for the complete conversion of oxygen to moisture.

The annealed samples were oxidized uniformly indicating the oxygen present in the feed gas was substantially converted in the heating and cooling zones of the furnace, as shown in Table 4, further showing a porous sintered metal diffuser can be used to feed non-cryogenically produced nitrogen pre-mixed with slightly more than stoichiometric amount of hydrogen in the heating zone of the furnace operated at 750° C. and produce controlled oxide annealed steel samples.

Examples 4–49, 4–50A, an 4–50B

The carbon steel heat treating process of Example 4–48 was repeated with the addition of 3.0%, 5.01., and 10% hydrogen, respectively (see Table 4). The amount of hydrogen used was 3.0 times, 5.0 times, and 10 times the stoichiometric amount required for the complete conversion of oxygen to moisture.

The annealed steel samples were partly oxidized and partly bright. These examples showed that non-cryogenically produced nitrogen cannot be used to bright annealing steel at 750° C. even with the use of excess amounts of hydrogen.

Figure 8:
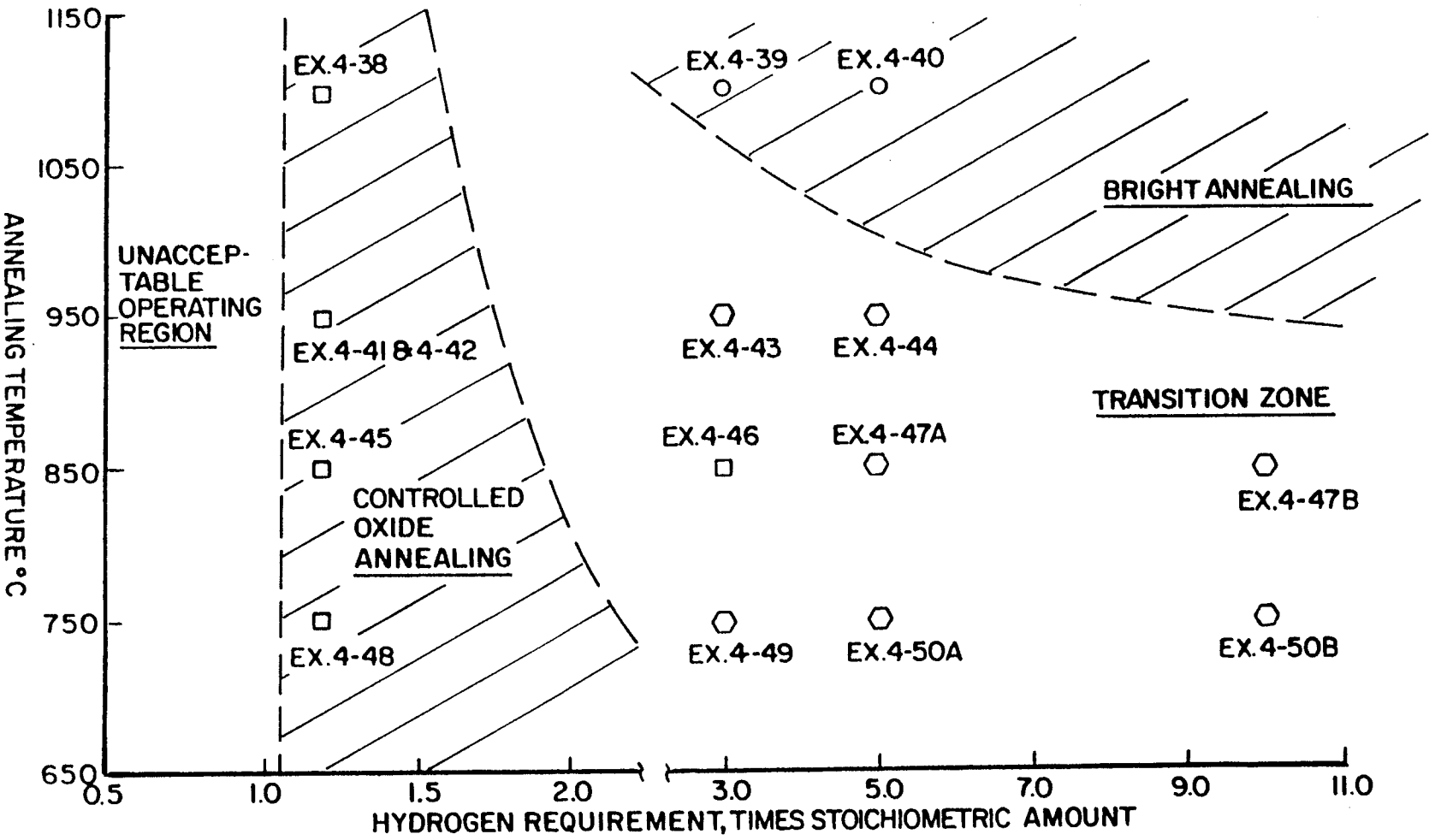
FIG. 8 is a plot of annealing temperature against hydrogen requirement for annealing of carbon steel according to the invention.

The experiments detailed above relating to annealing using a porous diffuser showed that carbon steel can be oxide annealed at temperatures ranging from 750° to 1100° C. with non-cryogenically produced nitrogen provided more than stoichiometric amount of hydrogen is added to the feed gas. The experiments also showed that carbon steel can only be bright annealed at temperatures above 950° C. with non-cryogenically produced nitrogen premixed with approximately three times or more hydrogen required for the complete conversion of oxygen to moisture. The operating regions for oxide and bright annealing of carbon steel using a porous diffuser to distribute non-cryogenically produced nitrogen in the furnace are very narrow, as shown in FIG. 8. These operating regions will most probably change with the furnace size, design, and loading as well as the total flow rate of feed gas used during annealing.

The following discussion details experimental results of an annealing process according to the present invention where a unique porous diffuser is used.

Example 4–51

The carbon steel heat treating process of Example 4–38 was repeated using 9.5" long modified porous diffuser of the type shown as 40 in FIG. 3C located in the heating zone of the furnace (Location 72 in FIG. 4) inserted into the furnace through the cooling zone. The flow rate of nitrogen (99.5% $N_2$ and 0.5% $O_2$) used in this example was 350 SCFH and the amount of hydrogen added was 1.2%, as shown in Table 4. The amount of hydrogen used was 1.2 times the stoichiometric amount required for the complete conversion of oxygen to moisture.

The steel samples heat treated in this example were uniformly oxidized and had a tightly packed oxide layer on the surface showing that a porous diffuser, designed according to the present invention to prevent direct impingement of feed gas on the samples, can be used to feed non-cryogenically produced nitrogen pre-mixed with slightly more than stoichiometric amount of hydrogen in the heating zone of the furnace operated at 1,100° C. and produce controlled oxide annealed samples.

Example 4–52

The carbon steel heat treating process of Example 4–51 was repeated with the exception of adding 3% hydrogen, as shown in Table 4. The amount of hydrogen used was 3.0 times the stoichiometric amount required for the complete conversion of oxygen to moisture. The annealed steel samples were shiny bright without any signs of oxidation showing that the porous diffuser of FIG. 3C can be used to feed non-cryogenically produced nitrogen pre-mixed with three times the stoichiometric amount of hydrogen in the heating zone of the furnace operated at 1,100° C. and produce bright annealed steel samples.

The steel sample annealed in Example 4–52 was examined for decarburization. Examination of incoming material showed no decarburization while the steel sample heated in the non-cryogenically produced nitrogen atmosphere pre-mixed with hydrogen produced decarburization of approximately 0.008 inches.

Example 4–53

The carbon steel heat treating process of Example 4–51 was repeated with the exception of adding 5.0% hydrogen (see Table 4). This amount of hydrogen was 5.0 times the stoichiometric amount required for the complete conversion of oxygen to moisture.

The annealed steel samples were shiny bright without any signs of oxidation showing considerably more than a stoichiometric amount of hydrogen mixed with non-cryogenically produced nitrogen can be used to bright anneal steel samples at 1,100° C. by feeding the gaseous mixture into the heating zone with a modified porous diffuser.

The steel sample annealed in Example 4–53 was examined for decarburization. Examination of incoming material showed no decarburization while the steel sample heated in the non-cryogenically produced nitrogen atmosphere pre-mixed with hydrogen produced decarburization of approximately 0.008 inches.

Example 4–54

The carbon steel heat treating process of Example 4–51 was repeated with the exception of using a 950° C. hot zone furnace temperature instead of 1,100° C., as shown in Table 4 with an amount of hydrogen 1.2 times the stoichiometric amount required for the complete conversion of oxygen to moisture.

The annealed steel samples were uniformly oxidized with a tightly packed oxide layer on the surface indicating that the modified diffuser helped in dispersing feed gas and preventing direct impingement of unreacted oxygen on the samples.

This example showed that a modified diffuser can be used to feed non-cryogenically produced nitrogen pre-mixed with slightly more than stoichiometric amount of hydrogen in the heating zone of the furnace operated at 950° C. and produce controlled oxide annealed steel samples.

Examples 4–55 and 4–96

The carbon steel heat treating process of Example 4–54 was repeated with 3.0% and 5.0% $H_2$, respectively. The amount of hydrogen used was 3.0 and 5.0 times the stoichiometric amount required for the complete conversion of oxygen to moisture.

The annealed steel samples were bright without any signs of oxidation indicating that non-cryogenically produced nitrogen can be used for bright annealing steel at 950° C. provided more than stoichiometric amount of $H_2$ is used and that the direct impingement of feed gas with unreacted oxygen on the samples is avoided.

The steel samples annealed in Examples 4–55 and 4–56 was examined for decarburization. Examination of incoming material showed no decarburization while the steel samples heated in the non-cryogenically produced nitrogen atmosphere pre-mixed with hydrogen produced decarburization of approximately 0.0065 to 0.007 inches.

Example 4–57

The carbon steel heat treating process of Example 4–38 was repeated with the exception of using a 6 in. long modified porous diffuser of the type shown as 40 in FIG. 3C located in the heating zone of the furnace maintained at a temperature of 850° C. (Location 72 in FIG. 4) and inserted into the furnace through the cooling zone. The flow rate of nitrogen (99.5% $N_2$ and 0.5% $O_2$) used in this example was 350 SCFH and the amount of hydrogen added was 1.2%, as shown in Table 4, the amount of hydrogen used being 1.2 times the stoichiometric amount required for the complete conversion of oxygen to moisture.

The steel samples heat treated in this example were uniformly oxidized and had a tightly packed oxide layer on the surface indicating the oxygen present in the feed gas was converted completely to moisture both in the cooling and heating zones, as shown in Table 4.

This example showed that a modified porous diffuser according to the present invention, which prevented the direct impingement of feed gas with unreacted oxygen on the samples, can be used to feed non-cryogenically produced nitrogen pre-mixed with slightly more than stoichiometric amount of hydrogen in the heating zone of the furnace operated at 850° C. and produce controlled oxide annealed samples.

Example 4–58

The carbon steel heat treating process of Example 4–57 was repeated with the exception of adding 3% hydrogen, as shown in Table 4, the amount of hydrogen being 3.0 times the stoichiometric amount required for the complete conversion of oxygen to moisture.

The annealed steel samples were shiny bright without any signs of oxidation showing that the porous diffuser can be used to feed non-cryogenically produced nitrogen pre-mixed with three times the stoichiometric amount of hydrogen in the heating zone of the furnace operated at 850° C. and produce bright annealed steel samples by preventing the impingement of unreacted oxygen on the samples.

The steel sample annealed in Example 4–58 was examined for decarburization. Examination of incoming material showed no decarburization while the steel sample heated in the non-cryogenically nitrogen atmosphere pre-mixed with hydrogen produced decarburization of approximately 0.005 inches.

Example 4–59

The carbon steel heat treating experiment process of Example 4–57 was repeated with the exception of using 1.0% oxygen in the feed and adding 6.0% hydrogen (see Table 4), the amount of hydrogen being 3.0 times the stoichiometric amount required for the complete conversion of oxygen to moisture.

The annealed steel samples were shiny bright without any signs of oxidation showing that a considerably more than stoichiometric amount of hydrogen mixed with non-cryogenically produced nitrogen can be used to bright anneal steel samples at 850° C. by feeding the gaseous mixture into the heating zone in a manner to prevent direct impingement of unreacted oxygen on the samples.

The steel sample annealed in Example 4–59 was examined for decarburization. Examination of incoming material showed no decarburization while the steel sample heated in the non-cryogenically nitrogen atmosphere pre-mixed with hydrogen produced decarburization of approximately 0.005 inches.

Example 4–60

The carbon steel heat treating process of Example 4–57 was repeated with the exception of using 750° C. furnace hot zone temperature instead of 850° C. The flow rate of nitrogen (99.5% $N_2$ and 0.5% $O_2$) used in this example was 350 SCFH and the amount of hydrogen added was 1.0%, as shown in Table 4, the amount of hydrogen being equal to the stoichiometric amount required for the complete conversion of oxygen to moisture.

The steel samples thus treated were heavily oxidized and scaled indicating the porous diffuser of the invention cannot be used to feed non-cryogenically produced nitrogen pre-mixed with stoichiometric amount of hydrogen in the heating zone of the furnace operated at 750° C. to produce controlled oxide annealed samples.

Example 4–61

The carbon steel heat treating process of Example 4–60 was repeated with the exception of adding 1.2% hydrogen, as shown in Table 4, the amount of hydrogen being 1.2 times the stoichiometric amount required for the complete conversion of oxygen to moisture.

The annealed steel samples were uniformly oxidized and had a tightly packed oxide layer on the surface showing that the porous diffuser of the invention can be used in the process of the invention to feed non-cryogenically produced nitrogen pre-mixed with 1.2 times the stoichiometric amount of hydrogen in the heating zone of the furnace operated at 750° C. and produce controlled oxide annealed steel samples.

Examples 4–62 and 4–63

The carbon steel heat treating process of Example 4–60 was repeated with 5.0% and 10.0% $H_2$, respectively, the amount of hydrogen used being 5.0 and 10.0 times the stoichiometric amount required for the complete conversion of oxygen to moisture.

The annealed steel samples were shiny bright without any signs of oxidation. These examples therefore showed that non-cryogenically produced nitrogen can be used for bright annealing steel at 750° C. provided considerably more than stoichiometric amount of $H_2$ is used and that the direct impingement of feed gas with unreacted oxygen on the samples was avoided.

The steel sample annealed in Example 4–62 and 4–63 were examined for decarburization. Examination of incoming material showed no decarburization while the steel samples heated in a non-cryogenically produced nitrogen atmosphere pre-mixed with hydrogen produced decarburization of approximately 0.005 inches in both examples.

Example 4–64

The carbon steel heat treating process of Example 4–60 was repeated with the exception of using 0.25% oxygen in the feed and adding 0.6% hydrogen (see Table 4), the amount of hydrogen being 1.2 times the stoichiometric amount required for the complete conversion of oxygen to moisture.

The annealed steel samples were uniformly oxidized and had a tightly packed oxide layer on the surface showing that a 1.2 times stoichiometric amount of hydrogen mixed with non-cryogenically produced nitrogen containing 0.25% oxygen can be used to controlled oxide anneal steel samples at 750° C. by feeding the gaseous mixture into the heating zone according to the process of the present invention.

Example 4–65

The carbon steel heat treating process of in Example 4–64 was repeated with 1.0% $H_2$. The amount of hydrogen used was 2.0 times the stoichiometric amount required for the complete conversion of oxygen to moisture.

The annealed steel samples had a combination of bright and oxidized finish. This kind of surface finish is generally not acceptable. This example therefore showed that non-cryogenically produced nitrogen containing 0.25% oxygen cannot be used for bright and/or oxide annealing steel at 750° C. when 2.0 times stoichiometric amount of $H_2$ is used even if the direct impingement of feed gas with unreacted oxygen on the samples is avoided.

Examples 4–66, 4–67, and 4–68

The carbon steel heat treating experiment process of Example 4–64 was repeated with 2.75%, 3.25%, and 5.0% $H_2$, respectively. The amount of hydrogen used was 5.5, 6.5, and 10.0 times the stoichiometric amount required for the complete conversion of oxygen to moisture.

The annealed steel samples were bright without any signs of oxidation. These examples therefore showed that non-cryogenically produced nitrogen containing 0.25% oxygen can be used for bright annealing steel at 750° C. provided more than 5.0 times the stoichiometric amount of $H_2$ is used and that the direct impingement of feed gas with unreacted oxygen on the samples is avoided.

The steel samples annealed in Examples 4–66, 4–67, and 4–68 were examined for decarburization. Examination of incoming material showed no decarburization while the steel samples heated in a non-cryogenically produced nitrogen atmosphere pre-mixed with hydrogen produced decarburization of approximately 0.0035 inches.

Example 4–69

The carbon steel heat treating process of Example 4–60 was repeated with the exception of using 1.0% oxygen in the feed gas and adding 2.20% hydrogen see Table 4), the amount of hydrogen used being 1.1 times the stoichiometric amount required for the complete conversion of oxygen to moisture.

The steel samples heat treated in this example were uniformly oxidized and had a tightly packed oxide layer on the surface, indicating as shown in Table 4 that the oxygen present in the feed gas was converted completely to moisture both in the cooling and heating zones.

This example showed that a process according to the present invention of preventing the direct impingement of feed gas with unreacted oxygen on the samples, can be used to feed non-cryogenically produced nitrogen containing 1.0% oxygen and pre-mixed with slightly more than stoichiometric amount of hydrogen in the heating zone of the furnace operated at 750° C. and produce controlled oxide annealed samples.

Example 4–70

The carbon steel heat treating process of Example 4–69 was repeated with the exception of adding 2.5% hydrogen, as shown in Table 4, the amount of hydrogen used being 1.25 times the stoichiometric amount required for the complete conversion of oxygen to moisture.

The annealed steel samples were uniformly oxidized and had a tightly packed oxide layer on the surface. This example showed that a modified porous diffuser as in FIG. 3C can effect the process of the present invention to feed non-cryogenically produced nitrogen pre-mixed with 1.25 times the stoichiometric amount of hydrogen in the heating zone of the furnace operated at 750° C. and produce controlled oxide annealed steel samples.

Example 4–71

The carbon steel heat treating process of Example 4–69 was repeated with the exception of adding 4.0% hydrogen (see Table 4), the amount of hydrogen being 2.0 times the stoichiometric amount required for the complete conversion of oxygen to moisture.

The annealed steel samples were non-uniformly oxidized showing that 2.0 times the stoichiometric amount of hydrogen mixed with non-cryogenically produced nitrogen containing 1.0% oxygen cannot be used to bright and/or oxide anneal steel samples at 750° C. by feeding the gaseous mixture into the heating zone according to the process of the present invention.

Examples 4–72 and 4–73

The carbon steel heat treating process of Example 4–61 was repeated with a total flow rate of 450 and 550 SCFH, respectively. The amount of hydrogen used was 1 .5 times the stoichiometric amount required for the complete conversion of oxygen to moisture.

The annealed steel samples were uniformly oxidized and had a tightly packed oxide layer on the surface. These examples therefore showed that a total flow rate varying up to 550 SCFH of non-cryogenically produced nitrogen can be used for oxide annealing steel at 750° C. provided more than stoichiometric amount of $H_2$ is used and that the direct impingement of feed gas with unreacted oxygen on the samples is avoided.

Example 4–74

The carbon steel heat treating process of Example 4–72 was repeated with the exception of using 650 SCFH total flow rate as shown in Table 4, the amount of hydrogen used being 1.5 times the stoichiometric amount required for the complete conversion of oxygen to moisture.

The annealed steel samples were non-uniformly oxidized and the quality of the samples was unacceptable. The residual oxygen present in the feed gas appeared not to have reacted completely with hydrogen at 650 SCFH total flow rate prior to impinging on the samples, thereby oxidizing them non-uniformly. This example showed that the process of the present invention cannot be used at a total flow rate greater than 550 SCFH of non-cryogenically produced nitrogen pre-mixed with 1.5 times the stoichiometric amount of hydrogen in the heating zone of the furnace operated at 750° C. and produce oxide annealed steel samples where the diffuser of FIG. 3C is used. This example shows that the high flow rate of non-cryogenically produced nitrogen can be used by dividing it into multiple streams and feeding the streams into different locations in the heating zone in accord with the process of the invention.

Example 4–75

The carbon steel heat treating process of Example 4–72 was repeated with the exception of using 850 SCFH total flow rate (see Table 4). The amount of hydrogen added was 1 .5 times the stoichiometric amount required for the complete conversion of oxygen to moisture.

The annealed steel samples were severely oxidized and scaled. This example once again showed that a total flow rate higher than 550 SCFH of non-cryogenically produced nitrogen pre-mixed with more than stoichiometric amount of hydrogen cannot be used to oxide anneal steel samples at 750° C. by feeding the gaseous mixture into the heating zone with the porous diffuser of FIG. 3C.

Example 4–76

The carbon steel heat treating process of Example 4–60 was repeated with the exceptions of using a 4 in. long modified porous diffuser located in the heating zone of the furnace (Location 72 in FIG. 4) maintained at a temperature of 750° C. The flow rate of nitrogen (99.5% $N_2$ and 0.5% $O_2$) used in this example was 350 SCFH and the amount of hydrogen added was 1.5%, the amount of hydrogen used being 1.5 times the stoichiometric amount required for the complete conversion of oxygen to moisture.

The steel samples heat treated in this example were uniformly oxidized and had a tightly packed oxide layer on the surface. The oxygen present in the feed gas was converted completely to moisture both in the cooling and heating zones, as shown in Table 4.

This example showed that a modified porous diffuser design, which prevented the direct impingement of feed gas with unreacted oxygen on the samples, can be used to feed non-cryogenically produced nitrogen pre-mixed with slightly more than stoichiometric amount of hydrogen in the heating zone of the furnace operated at 750° C. and produce controlled oxide annealed samples.

Example 4–77

The carbon steel heat treating process of Example 4–60 was repeated with the exceptions of using a 2 inch long modified porous diffuser located in the heating zone of the furnace (Location 72 in FIG. 4) maintained at 750° C. The flow rate of nitrogen (99.5% $N_2$ and 0.5% $O_2$) used in this example was 350 SCFH and the amount of hydrogen added was 1.2%, as shown in Table 4, the amount of hydrogen used being 1.2 times the stoichiometric amount required for the complete conversion of oxygen to moisture.

The steel samples heat treated in this example were uniformly oxidized and had a tightly packed oxide layer on the surface as indicated by the data in Table 4 the oxygen present in the feed gas was converted completely to moisture both in the cooling and heating zones, showing that a shortened modified porous diffuser which prevented the direct impingement of feed gas with unreacted oxygen on the samples can be used to feed non-cryogenically produced nitrogen pre-mixed with slightly more than stoichiometric amount of hydrogen in the heating zone of the furnace operated at 750° C. and produce controlled oxide annealed samples.

Example 4–78

The carbon steel heat treating process of Example 4–77 was repeated with the exceptions of placing the modified diffuser in location 74 of furnace 60 (see FIG. 4) and adding 1.5% hydrogen. As shown in Table 4 the amount of hydrogen used was 1.5 times the stoichiometric amount required for the complete conversion of oxygen to moisture.

The annealed steel samples were oxidized uniformly and had a tightly packed oxide layer on the surface, showing that a slightly more than stoichiometric amount of hydrogen mixed with non-cryogenically produced nitrogen can be used to oxide anneal steel samples by feeding the gaseous mixture into the heating zone and without impingement on the parts being treated.

Example 4–79

The carbon steel heat treating process of Example 4–78 was repeated with the exception of adding 3.0% hydrogen (see Table 4). This amount of hydrogen was 3.0 times the stoichiometric amount required for the complete conversion of oxygen to moisture.

The annealed steel samples were shiny bright without any signs of oxidation showing that feeding non-cryogenically produced nitrogen pre-mixed with three times the stoichiometric amount of hydrogen in the heating zone of the furnace operated at 750° C. in accord with the invention can produce bright annealed steel samples.

Example 4–80

The carbon steel heat treating process of Example 4–78 was repeated with the exception of adding 5.0% hydrogen (see Table 4) which was 5.0 times the stoichiometric amount required for the complete conversion of oxygen to moisture.

The annealed steel samples were shiny bright without any signs of oxidation showing that a considerably more than stoichiometric amount of hydrogen mixed with non-cryogenically produced nitrogen can be used to bright anneal steel samples at 750° C. by feeding the gaseous mixture into the heating zone in accord with the process of present invention.

Example 4–81

The carbon steel heat treating process of Example 4–60 was repeated with the exception of using a ¾ in. diameter 6 in. long modified porous diffuser such as shown as 40 in FIG. 3C located in the heating zone of the furnace (Location 72 in FIG. 4) operating at 700° C. furnace hot zone temperature. The diffuser was inserted into the furnace through the cooling zone. The flow rate of nitrogen (99.5% $N_2$ and 0.5% $O_2$) used in this test was 350 SCFH and the amount of hydrogen added was 1.2 times the stoichiometric amount required for the complete conversion of oxygen to moisture (e.g. 1.2%).

The treated sample were uniformly oxidized and had a tightly packed oxide layer on the surface indicating the oxygen present in the feed gas was converted completely to moisture both in the cooling and heating zones, as shown in Table 4.

This result again proves that a process based upon preventing the direct impingement of feed gas with unreacted oxygen on the samples, can be used to feed non-cryogenically produced nitrogen pre-mixed with slightly more than stoichiometric amount of hydrogen in the heating zone of the furnace operated at 700° C. and produce controlled oxide annealed samples.

Example 4–82

The carbon steel heat treating process of Example 4–81 was repeated with the exception of adding 1.5% hydrogen or 1.5 times the stoichiometric amount of hydrogen required for the complete conversion of oxygen to moisture.

The annealed steel samples were oxidized uniformly that the process of the present invention can be used to feed non-cryogenically produced nitrogen pre-mixed with 1.5 times the stoichiometric amount of hydrogen in the heating zone of the furnace operated at 700° C. and produce oxide annealed steel samples.

Example 4–83

The carbon steel heat treating process of Example 4–81 was repeated with the exception of adding 5.0% hydrogen or 5.0 times the stoichiometric amount of hydrogen required for the complete conversion of oxygen to moisture.

The annealed steel samples were partly bright and partly oxidized indicating that 5.0 times the stoichiometric amount of hydrogen mixed with non-cryogenically produced nitrogen cannot be used to bright and/or oxide anneal steel samples by feeding the gaseous mixture into the heating zone of a furnace operated at 700° C. using the process of the present invention.

Example 4–84

The carbon steel heat treating process of Example 4–81 was repeated with the exception of adding 10.07. hydrogen (see Table 4). This amount of hydrogen was 10.0 times the stoichiometric amount required for the complete conversion of oxygen to moisture.

The annealed steel samples were partly oxidized and partly bright showing that 10.0 times the stoichiometric amount of hydrogen mixed with non-cryogenically produced nitrogen cannot be used to bright and/or oxide anneal steel samples by feeding the gaseous mixture into the heating zone of a furnace operated at 700° C. according to the process of the present invention.

Example 4–85

The carbon steel heat treating process of Example 4–81 was repeated with the exception of using 0.25% oxygen in the feed and adding 10.0% hydrogen (see Table 4). This amount of hydrogen was 20.0 times the stoichiometric amount required for the complete conversion of oxygen to moisture.

The annealed steel samples were shiny bright without any signs of oxidation indicating that a considerably more than stoichiometric amount of hydrogen mixed with non-cryogenically produced nitrogen can be used to bright anneal steel samples by feeding the gaseous mixture into the heating zone of a furnace operated at 700° C. according to the process of the present invention provided $H_2 > 10X$ stoichiometric.

Example 4–86

The carbon steel heat treating experiment described in Example 4–81 was repeated with the exception of using a 650° C. furnace hot zone temperature. The flow rate of nitrogen (99.5% $N_2$ and 0.5% $O_2$) used in this example was 350 SCFH and the amount of hydrogen added was 1.2%. The amount of hydrogen used was 1.2 times the stoichiometric amount required for the complete conversion of oxygen to moisture.

The steel samples heat treated in this example were oxidized and scaled indicating the oxygen present in the feed gas was not converted completely to moisture both in the cooling and heating zones and that the process of the invention cannot be used to feed non-cryogenically produced nitrogen pre-mixed with slightly more than stoichiometric amount of hydrogen in the heating zone of the furnace operated at 650° C. and produce controlled oxide annealed surface.

Example 4–87

The carbon steel heat treating process of Example 4–86 was repeated with the exception of adding 5.0% hydrogen or 5.0 times the stoichiometric amount required for the complete conversion of oxygen to moisture.

The annealed steel samples were partly oxidized and partly bright indicating the process of the present invention cannot be used with non-cryogenically produced nitrogen pre-mixed with 5.0 times the stoichiometric amount of hydrogen in the heating zone of the furnace operated at 650° C. and produce bright and/or oxide annealed steel samples.

Example 4–88

The annealing process of Example 2–31 was repeated using similar procedure, operating conditions, and a feed tube such as 30 of FIG. 3A located in the heating zone (Location 72 of FIG. 4) with the open end 32 facing the ceiling or roof 34 of the furnace to heat treat carbon steel samples. The feed gas therefore did not impinge directly on the samples and was heated by the furnace ceiling, causing oxygen to react with hydrogen prior to coming in contact with the samples. The concentration of oxygen in the feed nitrogen was 0.5% and the amount of hydrogen added was 1.5% (hydrogen added being 1.5 times the stoichiometric amount).

The treated samples were heavily oxidized and scaled due to the presence of high concentrations of oxygen in the heating zone, as shown in Table 4. Careful analysis of the furnace revealed that this method of introducing feed gas caused a lot of turbulence inside the furnace permitting suction of large amounts of air from outside into the heating zone, resulting in severe oxidation of the samples. It is therefore not preferable to locate an open tube facing the furnace ceiling in Location 72 of furnace 60.

Example 4–89

The carbon steel heat treating process of Example 4–88 was repeated with the exception of locating the open end 32 of tube 30 in Location 74 instead of Location 72 in the furnace 60. The feed gas therefore did not impinged directly on the samples and there was no apparent suction of air into the heating zone from the outside. The concentration of oxygen in the feed nitrogen was 0.5% and the amount of hydrogen added was 1.5% or 1.5 times the stoichiometric amount.

The steel samples heat treated in this process oxidized uniformly and had a tightly packed oxide layer on the surface showing that steel samples can be oxide annealed at 750° C. using non-cryogenically produced nitrogen provided more than stoichiometric amount of hydrogen is used providing the feed gas is introduced into the furnace at the proper location and the direct impingement of feed gas with unreacted oxygen on the samples is avoided.

Example 4–90

The carbon steel heat treating process of Example 4–89 was repeated with the exception of using 5.0% hydrogen or 5.0 times the stoichiometric amount.

The steel samples heat treated by this process were bright without any signs of oxidation confirming that an open tube facing furnace ceiling can be used to bright anneal steel at 750° C. with non-cryogenically produced nitrogen provided that more than stoichiometric amount of hydrogen is used.

Figure 9:
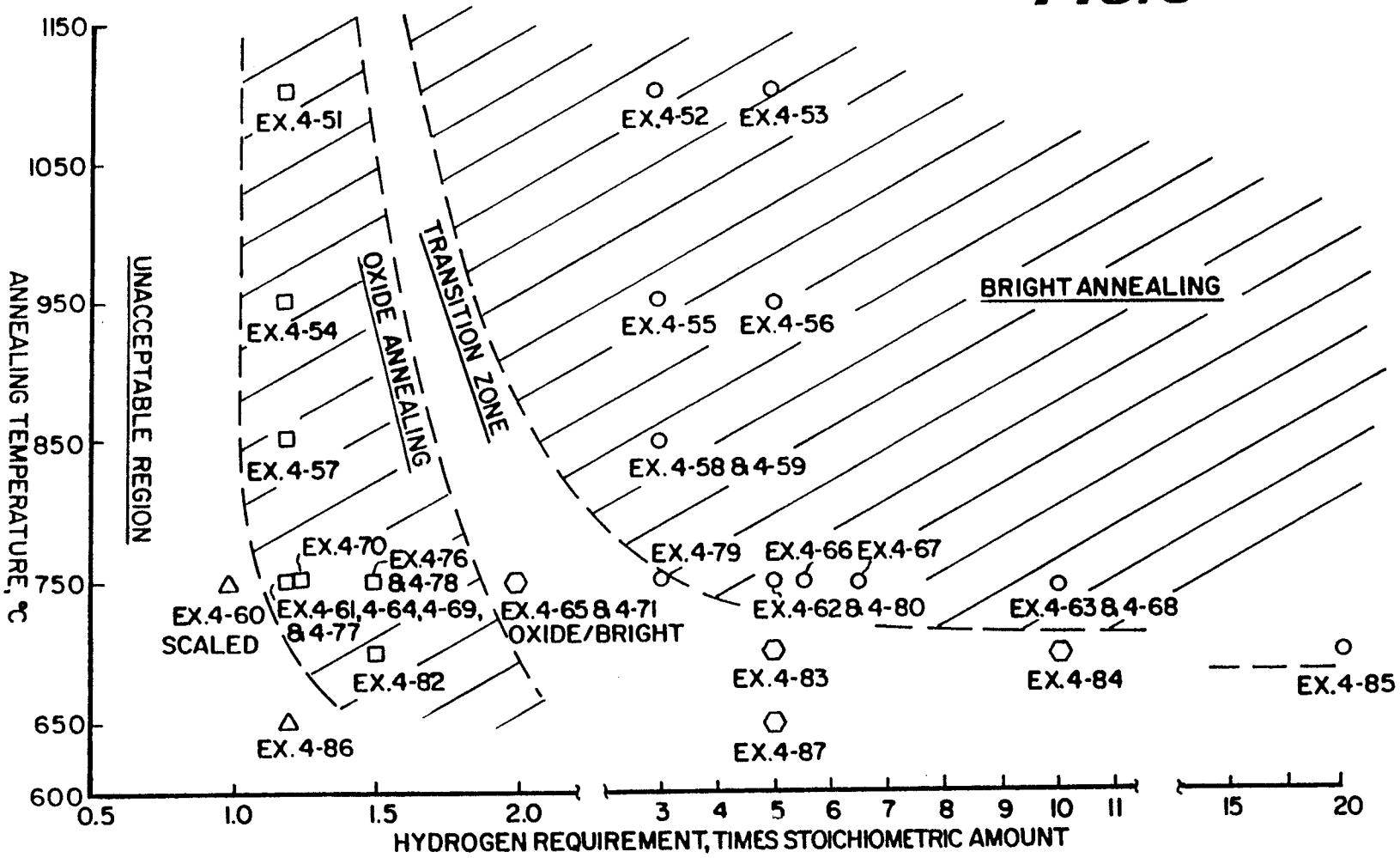
FIG. 9 is a plot of annealing temperature against hydrogen requirement for annealing of carbon steel according to the invention.

The Examples 4–51 through 4–90 relate to annealing using a modified porous diffuser or modified gas feed device to show that carbon steel can be annealed at temperatures ranging from 700° C. to 1100° C. with non-cryogenically produced nitrogen provided more than stoichiometric amount of hydrogen is added to the feed gas. The process of the present invention employing method of introducing the feed gas into the furnace (e.g. using a modified porous diffuser) enables a user to perform oxide annealing and oxide-free (bright annealing) of carbon steel, as shown in FIG. 9. The operating regions shown in FIG. 9 are considerably broader using the process of the present invention than those noted with conventional gas feed devices, as is evident by comparing FIGS. 8 and 9. The above experiments therefore demonstrate the importance of preventing the impingement of feed gas with unreacted oxygen on the parts.

Table 5 and the discussion relating thereto details several experiments that were carried out to study bright annealing of 9-K and 14-K gold, alloys of gold, silver, zinc and copper, using non-cryogenically produced nitrogen at a constant 750° C. temperature. Pieces of 9-K and 14-K gold measuring 0.5 in. wide, 2.5 in. long and 0.040 in. thick were used in all the annealing experiments described below.

TABLE 5

| | Example 5-21 | Example 5-22 | Example 5-23 | Example 5-24 | Example 5-25 | Example 5-26 | Example 5-27 |
|---|---|---|---|---|---|---|---|
| Type of Samples | 14-K Gold | 9-K Gold | 9-K Gold | 9-K Gold | 14-K Gold | 14-K Gold | 9-K Gold |
| Heat Treating Temperature, °C. | 750 | 750 | 750 | 700 | 750 | 750 | 750 |
| Flow Rate of Feed Gas, SCFH | 350 | 350 | 350 | 350 | 350 | 350 | 350 |
| Feed Gas Location | Transition Zone | Transition Zone | Transition Zone | Transition Zone | Heating Zone (Location 72) | Heating Zone (Location 72) | Heating Zone (Location 74) |
| Type of Feed Device | Open Tube | Open Tube | Open Tube | Open Tube | Porous Diffuser FIG. 3E | Porous Diffuser FIG. 3E | Porous Diffuser FIG. 3E |
| Feed Gas Composition | | | | | | | |
| Nitrogen, % | 99.0 | 99.5 | 99.5 | 99.5 | 99.0 | 99.5 | 99.5 |
| Oxygen, % | 1.0 | 0.5 | 0.5 | 0.5 | 1.0 | 0.5 | 0.5 |
| Hydrogen*, % | — | 5.0 | 10.0 | 10.0 | 2.5 | 5.0 | 5.0 |
| Heating Zone Atmosphere Composition | | | | | | | |
| Oxygen, ppm | 9,500 | <4 | <5 | <4 | <4 | <2 | <6 |
| Hydrogen*, % | — | 4.0 | — | — | ~0.5 | ~4.1 | 4.0 |
| Dew Point, °C. | — | +6.8 | +7.1 | +4.2 | +5.9 | +7.0 | +7.0 |
| Cooling Zone Atmosphere Composition | | | | | | | |
| Oxygen, ppm | 9,900 | 3,000 | 3,200 | 2,800 | <3 | <5 | <4 |
| Hydrogen, % | — | 4.1 | — | — | ~0.5 | ~4.1 | 4.0 |
| Dew Point, °C. | — | −6.9 | −2.2 | +4.3 | +5.7 | +6.4 | +7.2 |
| Quality of Heat Treated Samples | Severely Oxidized & Scaled | Oxidized | Oxidized | Oxidized | Oxidized | Partially Oxidized | Oxidized Oxide |

| | Example 5-28 | Example 5-29 | Example 5-30 | Example 5-31 | Example 5-32 | Example 5-33 | Example 5-34 |
|---|---|---|---|---|---|---|---|
| Type of Samples | 9-K Gold | 14-K Gold | 14-K Gold | 14-K Gold | 14-K Gold | 9-K Gold | 9-K Gold |
| Heat Treating Temperature, °C. | 750 | 750 | 750 | 750 | 750 | 750 | 750 |
| Flow Rate of Feed Gas, SCFH | 350 | 350 | 350 | 350 | 350 | 350 | 350 |
| Feed Gas Location | Heating Zone (Location 74) | Heating Zone (Location 72) | Heating Zone (Location 72) | Heating Zone (Location 72) | Heating Zone (Location 74) | Heating Zone (Location 74) | Heating Zone (Location 74) |
| Type of Feed Device | Porous Diffuser FIG. 3E | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | | | | |
| Nitrogen, % | 99.5 | 99.0 | 99.5 | 99.5 | 99.5 | 99.0 | 99.0 |
| Oxygen, % | 0.5 | 1.0 | 0.5 | 0.5 | 0.5 | 1.0 | 1.0 |
| Hydrogen*, % | 10.0 | 4.0 | 5.0 | 5.0 | 5.0 | 3.0 | 5.0 |
| Heating Zone Atmosphere Composition | | | | | | | |
| Oxygen, ppm | <4 | <3 | <3 | <2 | <4 | <4 | <3 |
| Hydrogen*, % | — | ~2.1 | ~4.0 | 4.0 | 4.0 | 1.2 | 3.3 |
| Dew Point, °C. | +5.4 | +11.4 | +5.9 | +8.8 | +6.1 | +6.2 | +6.3 |
| Cooling Zone Atmosphere Composition | | | | | | | |
| Oxygen, ppm | <4 | <3 | <3 | <2 | <4 | <4 | <4 |
| Hydrogen, % | — | ~2.1 | ~4.1 | 4.0 | 4.0 | 1.2 | 3.4 |
| Dew Point, °C. | +6.5 | +11.6 | +5.6 | +8.3 | +6.1 | +6.2 | 6.2 |
| Quality of Heat Treated Samples | Partially Oxidized | Partially Oxidized | Bright | Bright | Oxidized | Oxidized | Oxidized |

| | Example 5-35 | Example 5-36 | Example 5-37 | Example 5-38 | Example 5-39 |
|---|---|---|---|---|---|
| Type of Samples | 9-K Gold | 9-K Gold | 9-K Gold | 9-K Gold | 9-K Gold |
| Heat Treating Temperature, °C. | 750 | 750 | 750 | 750 | 750 |
| Flow Rate of Feed Gas, SCFH | 350 | 350 | 350 | 350 | 450 |
| Feed Gas Location | Heating Zone (Location 74) | Heating Zone (Location 74) | Heating Zone (Location 74) | Heating Zone (Location 74) | Heating Zone (Location 74) |
| Type of Feed Device | Modified | Modified | Modified | Modified | Modified |

TABLE 5-continued

| | Porous Diffuser FIG. 3C | Porous Diffuser FIG. 3C | Porous Diffuser FIG. 3C | Porous Diffuser FIG. 3C | Porous Diffuser FIG. 3C |
|---|---|---|---|---|---|
| Feed Gas Composition | | | | | |
| Nitrogen, % | 99.0 | 99.0 | 99.5 | 99.5 | 99.5 |
| Oxygen, % | 1.0 | 1.0 | 0.5 | 0.5 | 0.5 |
| Hydrogen*, % | 7.5 | 10.0 | 3.0 | 5.0 | 5.0 |
| Heating Zone Atmosphere Composition | | | | | |
| Oxygen, ppm | <3 | <4 | <7 | <5 | <5 |
| Hydrogen*, % | — | — | 2.1 | 4.0 | 4.0 |
| Dew Point, °C. | 4.3 | +4.3 | +4.6 | +5.6 | +3.6 |
| Cooling Zone Atmosphere Composition | | | | | |
| Oxygen, ppm | <4 | <4 | <7 | <5 | <4 |
| Hydrogen, % | — | — | 2.1 | 4.2 | 4.1 |
| Dew Point, °C. | +4.6 | 4.2 | +4.8 | +5.6 | +3.8 |
| Quality of Heat Treated Samples | Bright | Shiny Bright | Oxidized | Bright | Bright |

| | Example 5-40 | Example 5-41 | Example 5-42 | Example 5-43 |
|---|---|---|---|---|
| Type of Samples | 9-K Gold | 9-K Gold | 9-K Gold | 9-K Gold |
| Heat Treating Temperature, °C. | 750 | 700 | 700 | 700 |
| Flow Rate of Feed Gas, SCFH | 550 | 650 | 850 | 350 |
| Feed Gas Location | Heating Zone (Location 74) | Heating Zone (Location 74) | Heating Zone (Location 74) | Heating Zone (Location 74) |
| Type of Feed Device | Modified Porous Diffuser FIG. 3C | Modified Porous Diffuser FIG. 3C | Modified Porous Diffuser FIG. 3C | Modified Porous Diffuser FIG. 3C |
| Feed Gas Composition | | | | |
| Nitrogen, % | 99.5 | 99.5 | 99.5 | 99.5 |
| Oxygen, % | 0.5 | 0.5 | 0.5 | 0.5 |
| Hydrogen*, % | 10.0 | 3.0 | 5.0 | 10.0 |
| Heating Zone Atmosphere Composition | | | | |
| Oxygen, ppm | <4 | <3 | <3 | <3 |
| Hydrogen*, % | — | 2.1 | 4.1 | — |
| Dew Point, °C. | +3.5 | +2.1 | +1.1 | +6.5 |
| Cooling Zone Atmosphere Composition | | | | |
| Oxygen, ppm | <5 | <4 | <3 | <4 |
| Hydrogen, % | — | 2.2 | 4.2 | — |
| Dew Point, °C. | +3.3 | +1.8 | +1.1 | +6.3 |
| Quality of Heat Treated Samples | Shiny Bright | Oxidized | Oxidized | Oxidized |

*Hydrogen gas was mixed with nitrogen and added as a percent of total non-cryogenically produced feed nitrogen.

Example 5-21

A sample of 14-K gold was annealed at 750° C. in the Watkins-Johnson furnace using 350 SCFH of nitrogen containing 99.0% $N_2$ and 1.0% residual oxygen. The feed gas was introduced into the furnace through a ¾ in. diameter tube located at 70 in furnace 60 (FIG. 4). This method of gas introduction is conventionally practiced in the heat treatment industry. The composition of feed nitrogen, similar to that commonly produced by non-cryogenic air separation techniques, was passed through the furnace for at least one hour to purge it prior to annealing the gold sample.

The sample annealed in this manner was severely oxidized and scaled. The oxidation of the sample was due to the presence of high levels of oxygen both in the heating and cooling zones of the furnace, as shown by the data in Table 5 indicating that non-cryogenically produced nitrogen containing residual oxygen cannot be used for annealing gold alloys.

Example 5-22

The annealing example described in Example 5-21 was repeated using similar furnace, set-up, and operating temperature and procedure with the exceptions of using 9-K gold piece, non-cryogenically produced nitrogen containign 99.5% $N_2$ and 0.5% residual oxygen, and 5% added hydrogen, as shown in Table 5. The amount of hydrogen was five times the stoichiometric amount required for the complete conversion of oxygen to moisture.

The sample annealed in this manner was oxidized. The oxidation of the sample was due to the presence of high levels of oxygen in the cooling zone of the furnace, as shown in Table 5, indicating that non-cryogenically produced nitrogen pre-mixed with five times the stoichiometric amount cannot be introduced into the furnace through a conventional device and used for bright annealing gold alloys.

Example 5-23

The annealing example described in Example 5-22 was repeated using similar piece of gold, furnace, set-up, operating temperature and procedure, and flow rate of non-cryogenically produced nitrogen with the exception of using 10% hydrogen, which was ten times the stoichiometric amount.

The sample annealed in this example was oxidized due to the presence of high levels of residual oxygen in the cooling zone of the furnace (see Table 5), indicating once again that non-cryogenically produced nitrogen pre-mixed with ten times the stoichiometric amount cannot be introduced into the furnace through a conventional device and used for bright annealing dold alloys at 750° C.

Example 5-24

The annealing experiment described in Example 5-23 was repeated using similar piece of gold, furnace, set-up, operating procedure, flow rate of non-cryogenically produced nitrogen, and amount of added hydrogen with the exception of using 700° C. furnace temperature.

The sample annealed in this example was oxidized due to the presence of high levels of residual oxygen in the cooling zone of the furnace (see Table 5), indicating that non-cryogenically produced nitrogen pre-mixed with excess amounts of hydrogen cannot be introduced into the furnace through a conventional device and used for bright annealing gold alloys at 700° C.

Example 5-25

A sample of 14-K gold was annealed at 750° C. using 350 SCFH of nitrogen containing 99% $N_2$ and 1% $O_2$. The feed gas was mixed with 2.5% $H_2$ which was 1.25 times the stoichiometric amount required for the complete conversion of oxygen to moisture. The feed gas was introduced into the furnace through a ½ in. diameter, 6 in. long sintered Inconel porous diffuser (52 of FIG. 3E) located in the heating zone (Location 72 in FIG. 4) of furnace 60. One end of the porous diffuser was sealed, whereas the other was connected to a ½ in. diameter stainless steel tube inserted into the furnace through the cooling zone.

The heat treated sample was oxidized. As shown in Table 5 the oxygen present in the feed gas was converted completely to moisture in the heating and cooling zones. While diffuser appeared to help in dispersing feed gas in the furnace and converting oxygen to moisture, a part of feed gas was not heated to high enough temperature, resulting in the impingement of unreacted oxygen on the sample and subsequently its oxidation. Analysis of the fluid flow and temperature profiles in the furnace confirmed the direct impingement of partially heated feed gas on the sample.

Thus unless impingement of unreacted oxygen on the part being treated is effected using non-cryogenically produced nitrogen pre-mixed with 1.25 times the stoichiometric amount of hydrogen in the heating zone of the furnace operated at 750° C. cannot result in bright annealed gold alloys.

Example 5-26

The 14-K gold annealing process of Example 5-25 was repeated with the exception of using nitrogen containing 99.5% $N_2$ and 0.5% oxygen and adding 5% hydrogen, which was 5.0 times the stoichiometric amount required for the complete conversion of oxygen to moisture.

Sample treated in this manner were partially bright and partially oxidized. The oxygen present in the feed gas was converted completely to moisture in the heating and cooling zones of the furnace. However, the sample was partially oxidized even with the presence of excess amount of hydrogen due mainly to the impingement of feed gas with unreacted oxygen on the sample, once again indicating a need to control the process.

Example 5-27

A sample of 9-K gold was annealed at 750° C. using 350 SCFH of nitrogen containing 99.5% $N_2$ and 0.5% $O_2$. The feed gas was mixed with 5% $H_2$ which was 5.0 times the stoichiometric amount required for the complete conversion of oxygen to moisture. The feed gas was introduced into the furnace through a ½ in. diameter, 6 in. long sintered Inconel porous diffuser (52 of FIG. 3E) located in the heating zone (Location 74 in FIG. 4) of furnace 60. One end of the porous diffuser was sealed, whereas the other was connected to a non-half-inch diameter stainless steel tube inserted into the furnace through the cooling zone.

The heat treated sample was oxidized. The oxygen present in the feed gas was converted completely to moisture in the heating and cooling zones, as indicated by the atmosphere analysis in Table 5.

The sample was oxidized due mainly to the impingement of feed gas with unreacted oxygen, once again indicating a need to control the process.

Example 5-28

The 9-K gold annealing experiment described in Example 5-27 was repeated using similar procedure, gas feeding device, operating temperature, and non-cryogenically produced nitrogen containing 99.5% $N_2$ and 0.5% oxygen with the exception of adding 10% hydrogen, which was ten times the stoichiometric amount required for the complete conversion of oxygen to moisture.

The sample annealed in this example was partially bright and partially oxidized. The oxygen present in the feed gas was converted completely to moisture in the heating and cooling zones of the furnace, as shown in Table 5. However, the sample was partially oxidized even with the presence of excess amount of hydrogen due mainly to the impingement of feed gas with unreacted oxygen on the sample.

Examples 5-21 through 5-24 show that prior art processes of introduction of non-cryogenically produced nitrogen into the transition zone of the furnace cannot be used to bright anneal 9-K and 14-K gold samples. Examples 5-24 to 5-28 show that a type of unrestricted diffuser appears to help in reducing the velocity of feed gas and dispersing it effectively in the furnace and in heating the gaseous feed mixture, but does not appear to eliminate impingement of unreacted oxygen on the samples.

Example 5-29

The 14-K gold annealing process of Example 5-26 was repeated with the exception of using a ¾ in. diameter 6 in. long porous diffuser of the type shown by 40 in FIG. 3C located in the heating zone of the furnace (Location 72 in FIG. 4) by being inserted into the furnace through the cooling zone to direct the flow of feed gas towards the hot ceiling of the furnace and to prevent the direct impingement of feed gas with unreacted oxygen on the samples. The flow rate of nitrogen (99.0% $N_2$ and 1.0% $O_2$) used in this example was 350 SCFH and the amount of hydrogen added was 4.0%, as shown in Table 5. The amount of hydrogen used was 2.0 times the stoichiometric amount required for the complete conversion of oxygen to moisture.

The sample annealed by this process was oxidized although the oxygen present in the feed gas was converted completely to moisture both in the cooling and heating zones, it appears that the sample was oxidized due to the presence of high levels of moisture in the furnace.

This example showed that preventing the direct impingement of feed gas with unreacted oxygen on the sample was instrumental in eliminating its oxidation by unconverted oxygen, however, the use of 2.0 times the stoichiometric amount of hydrogen is not enough to bright anneal gold alloys.

Example 5-30

The 14-K gold annealing process of Example 5-29 was repeated with the exceptions of using nitrogen containing 99.5% $N_2$ and 0.5% $O_2$ and adding 5.0% hydrogen, the amount of hydrogen used being 5.0 times the stoichiometric amount required for the complete conversion of oxygen to moisture.

The annealed 14-K gold sample was bright without any signs of oxidation showing that preventing the direct impingement of feed gas with unreacted oxygen on the sample and the use of more than 2.0 times the stoichiometric amount of hydrogen are essential for bright annealing gold alloys.

Example 5-31

The 14-K gold annealing process of Example 5-30 was repeated with the amount of hydrogen used being 5.0 times the stoichiometric amount required for the complete conversion of oxygen to moisture.

The annealed sample was bright without any signs of oxidation again showing that preventing the direct impingement of feed gas with unreacted oxygen on the sample and the use of more than 2.0 times the stoichiometric amount of hydrogen are essential for bright annealing gold alloys.

Example 5-32

The 14-K gold annealing process of Example 5-30 was repeated with the exception of placing the modified porous diffuser at location 74 instead of location 72 (see FIG. 4). The amount of hydrogen used was 5.0 times the stoichiometric amount required for the complete conversion of oxygen to moisture.

The annealed 14-K gold sample was bright without any signs of oxidation, showing that preventing the direct impingement of feed gas with unreacted oxygen on the sample and the use of more than 2.0 times the stoichiometric amount of hydrogen are essential for bright annealing gold alloys.

Example 5-33

The 14-K annealing process of Example 5-29 was repeated using similar procedure, flow rate, and operating conditions with the exceptions of placing the modified porous diffuser at location 74 instead of location 72 (see FIG. 4), using 9-K gold sample, and adding 3.0% hydrogen. The amount of hydrogen used was 1.5 times the stoichiometric amount required for the complete conversion of oxygen to moisture.

The 9-K gold sample annealed in this manner was oxidized. The oxygen present in the feed gas was converted completely to moisture both in the cooling and heating zones, as shown in Table 5. However, the sample was oxidized due to the presence of high levels of moisture in the furnace, indicating that the use of 1.5 times the the stoichiometric amount of hydrogen is not enough to bright anneal gold alloys.

Example 5-34

The 9-K gold annealing process of Example 5-33 was repeated using identical set-up, procedure, operating conditions, and gas feeding device with the exception of adding 5.0% hydrogen, as shown in Table 5. The amount of hydrogen used was 2.5 times the stoichiometric amount required for the complete conversion of oxygen to moisture.

The annealed 9-K gold sample was oxidized, due to the presence of high levels of moisture in the furnace. This example showed that the use of 2.5 times the stoichiometric amount of hydrogen is not enough for bright annealing gold alloys.

Example 5-35

The 9-K gold annealing process of Example 5-33 was repeated using similar set-up, procedure, operating conditions, gas feeding device, and feed gas composition with the exception of adding 7.5% hydrogen, as shown in Table 5. The amount of hydrogen used was 3.75 times the stoichiometric amount required for the complete conversion of oxygen to moisture.

The annealed sample was bright without any signs of oxidation. This example showed that preventing the direct impingement of feed gas with unreacted oxygen on the sample and the use of more than 3.0 times the stoichiometric amount of hydrogen are essential for bright annealing gold alloys.

Example 5-36

The 9-K gold annealing process of Example 5-33 was repeated using identical set-up, procedure, operating conditions, gas feeding device, and feed gas composition with the exception of adding 10% hydrogen, as shown in Table 5. The amount of hydrogen used was 5.0 times the stoichiometric amount required for the complete conversion of oxygen to moisture.

The annealed 9-K gold sample was bright without any signs of oxidation. This example showed that preventing the direct impingement of feed gas with unreacted oxygen on the sample and the use of more than 3.0 times the stoichiometric amount of hydrogen are essential for bright annealing gold alloys.

Example 5-37

The 9-K gold annealing process of Example 5-29 was repeated using similar procedure, flow rate, and operating conditions with the exception of using 350 SCFH of nitrogen containing 99.5% $N_2$ and 0.5% $O_2$. The amount of hydrogen added was 3.0%, as shown in Table 5. The amount of hydrogen used was 3.0 times the stoichiometric amount required for the complete conversion of oxygen to moisture.

The annealed 9-K gold sample was oxidized. The oxygen present in the feed gas was converted completely to moisture both in the cooling and heating zones, as shown in Table 5. However, the sample was oxidized due to the presence of high levels of moisture in the furnace, indicating that the use of 3.0 times the stoichiometric amount of hydrogen is not enough to bright anneal gold alloys.

Example 5-38

The 9-K gold annealing process of Example 5-37 was repeated using identical set-up, procedure, operating conditions, and gas feeding device with the exception of adding 5.0% hydrogen, as shown in Table 5. The amount of hydrogen used was 5.0 times the stoichiometric amount required for the complete conversion of oxygen to moisture.

The annealed 9-K gold sample was bright without any signs of oxidation. This example showed that preventing the direct impingement of feed gas with unreacted oxygen on the sample and the use of more than 3.0 times the stoichiometric amount of hydrogen are essential for bright annealing gold alloys.

Example 5-39

The 9-K gold annealing process of Example 5-38 was repeated using identical set-up, procedure, operating conditions, gas feeding device, and feed gas composition, as shown in Table 5. The amount of hydrogen used was 5.0 times the stoichiometric amount required for the complete conversion of oxygen to moisture.

The annealed sample was bright without any signs of oxidation. This example showed that preventing the direct impingement of feed gas with unreacted oxygen on the sample and the use of more than 3.0 times the stoichiometric amount of hydrogen are essential for bright annealing gold alloys.

Example 5-40

The 9-K gold annealing process of Example 5-37 was repeated using identical set-up, procedure, operating conditions, gas feed device, and feed gas composition with the exception of adding 10.0% hydrogen. The amount of hydrogen used was 10.0 times the stoichiometric amount required for the complete conversion of oxygen to moisture.

The annealed 9-K gold sample was bright without any signs of oxidation. This example showed that preventing the direct impingement of feed gas with unreacted oxygen on the sample and the use of more than 3.0 times the stoichiometric amount of hydrogen are essential for bright annealing gold alloys.

Example 5-41

The 9-K gold annealing process of Example 5-37 was repeated using similar procedure, flow rate, and operating conditions with the exceptions of using 700° C. furnace temperature. The flow rate of nitrogen (99.5% $N_2$ and 0.5% $O_2$) used in this example was 350 SCFH and the amount of hydrogen added was 3.0%, as shown in Table 5. The amount of hydrogen used was 3.0 times the stoichiometric amount required for the complete conversion of oxygen to moisture.

The 9-K gold sample annealed in this example was oxidized. The oxygen present in the feed gas was converted completely to moisture both in the cooling and heating zones, as shown in Table 5. However, the sample was oxidized due to the prosence of high levels of moisture in the furnace, indicating that the use of 3.0 times the stoichiometric amount of hydrogen is not enough to bright anneal gold alloys at 700° C.

Example 5-42

The 9-K gold annealing process of Example 5-41 was repeated using identical set-up, procedure, operating conditions, and gas feeding device with the exception of adding 5.0% hydrogen, as shown in Table 5. The amount of hydrogen used was 5.0 times the stoichiometric amount required for the complete conversion of oxygen to moisture.

The annealed 9-K gold sample was oxidized. This example showed that preventing the direct impingement of feed gas with unreacted oxygen on the sample and the use of 5.0 times the stoichiometric amount of hydrogen are not good enough for bright annealing gold alloys at 700° C.

Example 5-43

The 9-K gold annealing process of Example 5-41 was repeated using identical set-up, procedure, operating conditions, and gas feeding device, with the exception of using 10.0 times the stoichiometric amount required for the complete conversion of oxygen to moisture, as shown in Table 5.

The annealed sample was oxidized. This example showed that preventing the direct impingement of feed gas with unreacted oxygen on the sample and the use of even 10.0 times the stoichiometric amount of hydrogen are not sufficient for bright annealing gold alloys at 700° C.

Figure 10:
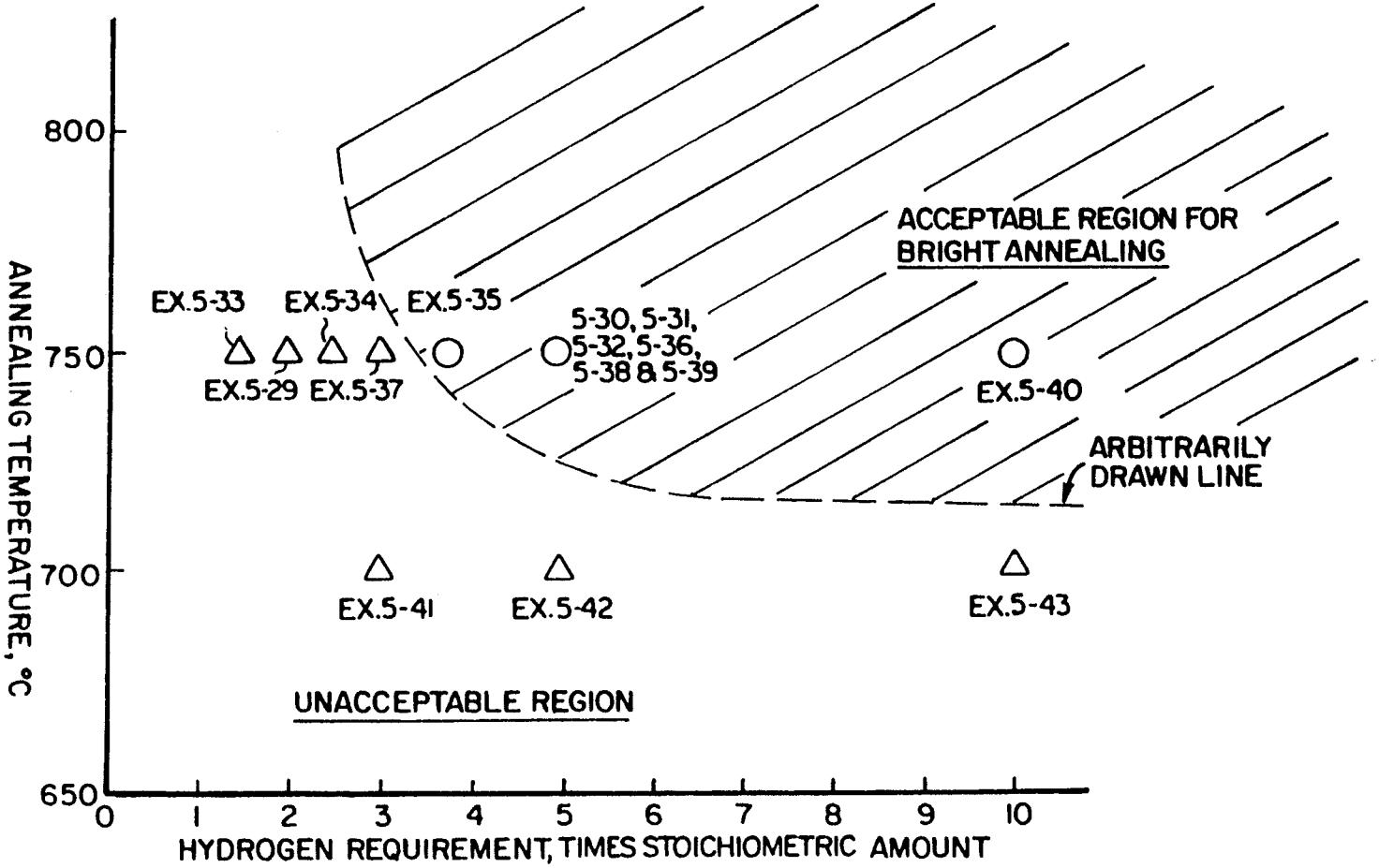
FIG. 10 is a plot of annealing temperature against hydrogen reuqirement for annealing of gold alloys according to the invention.

Examples 5-30 through 5-32, 5-35 through 5-36, and 5-38 through 5-40 clearly show that a process according to the invention using a modified porous diffuser, which helps in heating and dispersing feed gas as well as avoiding the direct impingement of feed gas with unreacted oxygen on the parts, can be used to bright anneal gold alloys as long as more than 3.0 times the stoichiometric amount of hydrogen is added to the gaseous feed mixture while annealing with non-cryogenically produced nitrogen. The operating region for bright annealing gold alloys is shown in FIG. 10.

The treated gold alloy samples surprisingly showed that the amount of hydrogen required for bright annealing gold alloys is considerably higher than the one required for bright annealing copper. It is worthwhile mentioning at this point that the amount of hydrogen required for bright annealing gold alloys may depend greatly upon their composition, the total flow rate of feed gas and the furnace design.

Experiments summarized in Table 6 were carried out to study glass-to-metal sealing of parts using non-cryogenically produced nitrogen. The metallic elements of the parts and the composition of the glass used in these experiments were selected to minimize the difference between their coefficient of thermal expansion and stresses generated during cooling and subsequent thermal cycling. This type of glass-to-metal sealing operation is commonly referred as matched sealing.

TABLE 6

| | Example 6-1 | | | Example 6-2 | | |
|---|---|---|---|---|---|---|
| | Step 1 | Step 2 | Step 3 | Step 1 | Step 2 | Step 3 |
| Maximum Heat Treating Temp., °C. | 990 | 980 | 980 | 990 | 980 | 980 |
| Flow Rate of Feed Gas, SCFH | 350 | 350 | 350 | 350 | 350 | 350 |
| Feed Gas Location | Heating Zone (Location 74) | Heating Zone (Location 74) | Heating Zone (Location 74) | Heating Zone (Location 74) | Heating Zone (Location 74) | Heating Zone (Location 74) |
| Type of Feed Device | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C | Modified Porous Diffuser FIG. 3C |

TABLE 6-continued

| | Example 6-1 | | | Example 6-2 | | |
|---|---|---|---|---|---|---|
| | Step 1 | Step 2 | Step 3 | Step 1 | Step 2 | Step 3 |
| Feed Gas Composition | | | | | | |
| Nitrogen, % | 99.63 | 99.16 | 99.60 | 99.63 | 99.16 | 99.60 |
| Oxygen, % | 0.37 | 0.84 | 0.40 | 0.37 | 0.84 | 0.40 |
| Hydrogen*, % | 10.0 | 3.2 | 1.30 | 10.0 | 3.2 | 1.30 |
| Heating Zone Atmosphere Composition | | | | | | |
| Oxygen, ppm | <5 | <4 | <4 | <5 | <4 | <5 |
| Hydrogen*, % | — | 1.0 | 0.50 | — | 1.0 | 0.45 |
| Dew Point, °C. | ~1.0 | 12.0 | ~5.0 | ~1.0 | 12.0 | 3.3 |
| Cooling Zone Atmosphere Composition | | | | | | |
| Oxygen, ppm | <5 | <4 | <4 | <5 | <4 | <5 |
| Hydrogen, % | — | 1.0 | 0.5 | — | 1.0 | 0.5 |
| Dew Point, °C. | 1.0 | 11.7 | 4.0 | 1.0 | 1.7 | 3.3 |
| Quality of Parts | → | Good Glass-to-Metal Sealing | ← | → | Good Glass-to-Metal Sealing | ← |

*Hydrogen gas was mixed with nitrogen and added as a percent total non-cryogenically produced feed nitrogen.

Example 6-1

A three-step glass-to-metal sealing experiment was carried out in the Watkins-Johnson furnace using non-cryogenically produced nitrogen. The glass-to-metal sealing parts used in this example are commonly called transistor outline consisting of a Kovar base header with twelve feed through in which Kovar electrodes are sealed with lead borosilicate glass and were supplied by AIRPAX of Cambridge, Md. The base metal Kovar and lead borosilicate glass are selected to minimize differences between their coefficient of thermal expansion. The total flow rate of nitrogen containing residual oxygen used in this example was 350 SCFH was mixed with hydrogen to not only convert residual oxygen to moisture, but also to control hydrogen to moisture ratio in the furnace. The feed gas was introduced through a ¾ in. diameter 2 in. long Inconel porous diffuser of the type shown in FIG. 3C, attached to a ½ in. diameter stainless steel feed tube inserted into the hot zone of the furnace (Location 74 in FIG. 4) through the cooling zone positioned to prevent the direct impingement of feed gas on the parts.

In the first step of the three-step glass-to-metal sealing experiment, the parts were degassed/decarburized at a maximum temperature of 990° C. using the composition of feed gas summarized in Table 6. The amount of hydrogen used was considerably more than the stoichiometric amount required for the complete conversion of oxygen to moisture to ensure decarburization of the parts. It was approximately 13.5 times the stoichiometric amount required for the complete conversion of oxygen to moisture. In the second step, the amount of residual oxygen in the feed gas was increased and that of hydrogen reduced to provide 12° C. dew point and a hydrogen to moisture ratio of ~0.9 in the furnace, as shown in Table 6. The amount of hydrogen used was slightly less than two times the stoichiometric amount required for the complete conversion of oxygen to moisture. These conditions were selected to ensure surface oxidation of the metallic elements and bonding of glass to the metallic elements. In the third step (sealing step), the amounts of residual oxygen and hydrogen were adjusted again to ensure good glass flow and decent glass-to-metal sealing, as shown in Table 6. The amount of hydrogen used was ~1.6 times the stoichiometric amount required for the complete conversion of oxygen to moisture. The residual oxygen present in the non-cryogenically produced nitrogen was converted completely to moisture in the heating and cooling zones of the furnace, as shown in Table 6.

Visual examination of the sealed parts showed good glass flow, good bonding of glass to the metallic elements, and absence of cracks in the glass.

This example therefore showed that non-cryogenically produced nitrogen can be used to provide good glass-to-metal sealing provided more than stoichiometric amount of hydrogen required for the complete conversion of residual oxygen to moisture is used and that the direct impingement of feed gas with unreacted oxygen on the parts is avoided.

Example 6-2

The glass-to-metal sealing experiment described in Example 6-1 was repeated using identical set-up, parts, feed gas composition, operating conditions, and gas feeding device, as shown in Table 6.

Visual examination of the sealed parts showed good glass flow, absence of cracks and bubbles in the glass, absence of glass splatter, and good glass-to-metal sealing. The parts were found to be hermetically sealed with less than $1.0\times10^{-8}$ atm.-cc/sec helium leak rate even after thermal shock.

This example therefore confirmed that non-cryogenically produced nitrogen can be used to provide good glass-to-metal sealing provided more than stoichiometric amount of hydrogen is used and that the direct impingement of feed gas with unreacted oxygen on the parts is avoided.

The operating conditions such as furnace temperature, dew point, and hydrogen content used in Examples 6-1 and 6-2 were selected to provide good sealing of lead borosilicate glass to Kovar. These conditions can be varied somewhat to provide good sealing between Kovar and lead borosilicate glass. The operating conditions, however, needed to be changed depending upon the type of metallic material and the composition of the glass used during glass-to-metal sealing.

Having thus described our invention what is desired to be secured by Letters Patent of the United States is set forth in the appended claims.

I claim:

1. A method for annealing copper or copper alloy parts comprising the steps of:

heating said parts in a furnace having a hot zone maintained at a temperature above 600° C.;

injecting into said furnace gaseous nitrogen containing from 0.05% to 5% by volume oxygen together with a reducing gas, said reducing gas injected into said furnace with a flow rate above about 1.10 times the stoichiometric amount required for the complete conversion of residual oxygen, said gaseous nitrogen and said reducing gas introduced into said furnace by directing said gaseous nitrogen and said reducing gas away from direct impingement on said parts in order to permit said reaction of oxygen and said reducing gas to be essentially complete prior to said mixture contacting said parts; and moving said parts through said furnace for a time sufficient to achieve the desired as annealed properties in said parts.

2. A method according to claim 1 wherein said residual oxygen is converted to moisture.

3. A method according to claim 1 wherein said residual oxygen is converted to carbon dioxide, moisture, carbon monoxide or mixtures thereof.

4. A method according to claim 1 wherein said reducing gas is a mixture of hydrogen and a hydrocarbon and said residual oxygen is converted to a mixture of carbon dioxide, moisture, carbon monoxide or mixtures thereof.

5. A method according to claim 1 wherein said nitrogen is generated by non-cryogenic means.

6. A method according to claim 1 wherein said furnace is heated to a temperature of between 600° C. and 800° C.

7. A method according to claim 1 wherein said reducing gas is hydrogen.

8. A method according to claim 1 wherein said reducing gas is a hydrocarbon.

9. A method according to claim 1 wherein said reducing gas is a mixture of hydrogen and a hydrocarbon.

10. A method according to claim 1 wherein said reducing gas is selected from the group consisting of methane, ethane, propane, butane, ethylene, propylene, butene, methanol, ethanol, propanol, dimethylether, diethyl ether, methyl-ethyl ether, natural gas, petroleum gas, cooking gas, coke oven gas, town gas, exothermic and endothermic generated gas, dissociated ammonia and mixtures thereof.

11. A method according to claim 9 wherein said reducing gas is selected from the group consisting of methane, ethane, propane, butane, ethylene, propylene, butene, methanol, ethanol, propanol, dimethylether, diethyl ether, methyl-ethyl ether, natural gas, petroleum gas, cooking gas, coke oven gas, town gas, exothermic and endothermic generated gas, dissociated ammonia and mixtures thereof.

12. A method of generating an in-situ atmosphere inside furnace used for performing a process selected from the group consisting of brazing, sealing of glass to metals, sintering metal and ceramic powders, or non-ferrous metal and alloy annealing wherein a selected process is effected by the steps of:

heating said furnace to a temperature above 600° C.;

injecting into said furnace gaseous nitrogen containing from 0.05% to 5% by volume oxygen together with a reducing, said reducing gas injected into said furnace with a flow rate varying from about 1.2 times to 15.0 times the stoichiometric amount required for a complete conversion of oxygen, said gaseous nitrogen and said reducing gas introduced into said furnace by directing said gaseous nitrogen and said reducing gas away from parts being subjected to the selected process in order to permit said reaction of oxygen and said reducing gas to be essentially complete prior to said mixture contacting parts being subjected to said selected process; and exposing said parts to said temperature and said atmosphere for a time sufficient to complete said selected process.

13. A method according to claim 12 wherein said residual oxygen is converted to moisture.

14. A method according to claim 12 wherein said residual oxygen is converted to carbon dioxide, moisture, carbon monoxide or mixtures thereof.

15. A method according to claim 1 wherein said reducing gas is a mixture of hydrogen and a hydrocarbon and said residual oxygen is converted to carbon dioxide, moisture, carbon monoxide or mixtures thereof.

16. A method according to claim 12 wherein said nitrogen is generated by non-cryogenic means.

17. A method according to claim 12 wherein said furnace is heated to a temperature of between 700° C. and 1,250° C.

18. A method according to claim 12 wherein said reducing gas is hydrogen.

19. A method according to claim 12 wherein said reducing gas is a hydrocarbon.

20. A method according to claim 12 wherein the reducing gas is a mixture of hydrogen and a hydrocarbon.

21. A method according to claim 12 wherein said reducing gas is selected from the group consisting of methane, ethane, propane, butane, ethylene, propylene, butene, methanol, ethanol, propanol, dimethylether, diethyl ether, methyl-ethyl ether, natural gas, petroleum gas, cooking gas, coke oven gas, town gas, exothermic and endothermic generated gas, dissociated ammonia and mixtures thereof.

22. A method according to claim 20 wherein the hydrocarbon is selected from the group consisting of methane, ethane, propane, butane, ethylene, propylene, butene, methanol, ethanol, propanol, dimethylether, diethyl ether, methyl-ethyl ether, natural gas, petroleum gas, cooking gas, coke oven gas, town gas, exothermic and endothermic generated gas, dissolved ammonia and mixtures thereof.

* * * * *